US006593841B1

(12) United States Patent
Mizoguchi et al.

(10) Patent No.: US 6,593,841 B1
(45) **Date of Patent: *Jul. 15, 2003**

(54) PLANAR MAGNETIC ELEMENT

(75) Inventors: Tetsuhiko Mizoguchi, Yokohama (JP); Toshiro Sato, Yokohama (JP); Masashi Sahashi, Yokohama (JP); Michio Hasegawa, Yokohama (JP); Hiroshi Tomita, Tokyo (JP); Atsuhito Sawabe, Yokosuka (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1375 days.

(21) Appl. No.: 08/701,918

(22) Filed: Aug. 23, 1996

Related U.S. Application Data

(62) Division of application No. 08/248,679, filed on May 25, 1994, now Pat. No. 5,583,474, which is a continuation of application No. 07/708,881, filed on May 31, 1991, now abandoned.

(30) Foreign Application Priority Data

| | | |
|---|---|---|
| May 31, 1990 | (JP) | 2-139989 |
| Oct. 9, 1990 | (JP) | 2-269397 |
| Oct. 9, 1990 | (JP) | 2-269398 |
| Mar. 29, 1991 | (JP) | 3-91614 |
| Mar. 30, 1991 | (JP) | 3-93434 |
| Mar. 30, 1991 | (JP) | 3-93717 |

(51) Int. Cl.[7] ..... H01F 5/00

(52) U.S. Cl. ..... 336/200; 336/223; 336/234; 336/83

(58) Field of Search ..... 336/83, 212, 218, 336/232, 234, 200

(56) References Cited

U.S. PATENT DOCUMENTS

| | | | | |
|---|---|---|---|---|
| 2,980,874 A | * | 4/1961 | Tarbox | 336/232 |
| 2,998,583 A | * | 8/1961 | Worcester | 336/232 |

(List continued on next page.)

FOREIGN PATENT DOCUMENTS

| | | |
|---|---|---|
| JP | 57-52114 | 3/1982 |
| JP | 57-111008 | 7/1982 |

(List continued on next page.)

OTHER PUBLICATIONS

IEEE Trans. on Magnetics, vol. 26, No 3, May 1990, pp 1204–1209, Yamasawa et al, "High–Frequency Operation on a Planar–Type Microtransformer and Its Application to Multilayered Switching Regulators".*

IEEE Trans. on Power Electronics, vol. 4, No 1, Jan. 1989 Goldberg et al, "Issues Related to 1–10 MHz Transformer Design".*

(List continued on next page.)

*Primary Examiner*—Anh Mai

(74) *Attorney, Agent, or Firm*—Oblon, Spivak, McClelland, Maier & Neustadt, P.C.

(57) ABSTRACT

Disclosed herein is a planar magnetic element comprising a substrate, a first magnetic layer arranged over the substrate, a first insulation layer arranged over the first magnetic layer, a planer coil formed of a conductor, having a plurality of turns, arranged over the first insulation layer and having a gap aspect ratio of at least 1, the gap aspect ratio being the ratio of the thickness of the conductor to the gap between any adjacent two of the turns, a second insulation layer arranged over the planar coil, and a second magnetic layer arranged over the second insulation layer. When used as an inductor, the planar magnetic element has a great quality coefficient Q. When used as a transformer, it has a large gain and a high voltage ratio. Since the element is small and thin, it is suitable for use in an integrated circuit, and can greatly contribute to miniaturization of electronic devices.

12 Claims, 58 Drawing Sheets

U.S. PATENT DOCUMENTS

| | | | | | |
|---|---|---|---|---|---|
| 4,029,926 | A | * | 6/1977 | Austin | 336/223 |
| 4,959,631 | A | * | 9/1990 | Hasegawa et al. | 336/83 |

FOREIGN PATENT DOCUMENTS

| | | |
|---|---|---|
| JP | 60-223014 | 11/1985 |
| JP | 62-101010 | 5/1987 |
| JP | 63-72102 | 4/1988 |
| JP | 1-157507 | 6/1989 |
| JP | 1-310518 | 12/1989 |
| JP | 2-123706 | 5/1990 |

OTHER PUBLICATIONS

*Spiral–Type Planar Inductor*; S. Ohshiro (and 2 others); Institute of Electric Engineering; Papers of Magnetics Study Group; MAG 86–69; Jul. 11, 1986; pp. 17–24.

*Magnetic Thin Film Inductors for Integrated Circuit Applications*; IEEE Translations on Magnetics vol. MAG 15, No. 6; Nov. 1979; pp. 1803–1805.

*Purport of Micro Magnetism*; Papers of National Convention of Institute of Electric Engineering; 1986; [5] S. 7–1; Apr. 1986; pp. S.7–1 to S.7–4.

* cited by examiner

EXTERNAL TERMINAL OF 1 TURN PLANAR COIL

PLANAR MAGNETIC ELEMENT

This is a Division, of application Ser. No. 08/248,679 filed on May 25, 1994, now U.S. Pat. No. 5,583,474 allowed; which is a continuation of application Ser. No. 07/708,881 filed on May 31, 1991, abandoned.

BACKGROUND OF THE INVENTION

1. Field of the Invention

The present invention relates to a planar magnetic element such as a planar inductor or a planar transformer.

2. Description of the Related Art

In recent years, electronic equipment of various types have been miniaturized. Magnetic elements such as inductors and transformers, which are indispensable to the power-supply section of each electronic component can neither be made smaller nor be integrated with the other circuit components, whereas the other circuit sections have successfully been made much smaller in the form of LSIs. Therefore the ratio of the volume of the power-supply section to that of the other sections, combined together, has increased inevitably.

To reduce the sizes of the magnetic elements, such as inductors and transformers, attempts at reduction have been made, and small planar inductors and planar transformers have been achieved. A conventional planar inductor comprises a spiral planar coil, two insulation layers sandwiching the coil, and two magnetic plates sandwiching the coil and insulation layers. A conventional planar transformer comprises two spiral planar coils, used as primary and secondary windings, respectively, two insulation layers sandwiching these coils, and two magnetic layers sandwiching the coils and insulation layers. The spiral planar coils incorporated in the inductor and the transformer can be of either of the two alternative types. The first type is formed of one spiral conductor. The second type comprised of an insulation layer and two spiral conductors mounted on the two major surfaces of the insulation layer, for generating magnetic fields which extend in the same direction.

These planar elements are disclosed in K. Yamasawa et al, *High-Frequency of a Planar-Type Microtransformer and Its Application to Multilayered Switching Regulators,* IEEE Trans. Mag., Vol. 26, No. 3, May 1990, pp. 1204–1209. As is described in this thesis, the planar elements have a large power loss. Similar planar magnetic elements are disclosed also in U.S. Pat. No. 4,803,609.

It has been proposed that the thin-film process, is employed in order to miniaturize these planar magnetic elements.

Planar inductors of the structure specified above need to have a sufficient quality coefficient Q in the frequency band for which they are used. Planar transformers of the structure described above must have a predetermined gain G which is greater than 1 for raising the input voltage or less than 1 for lowering the input voltage, and must also minimize voltage fluctuation.

The value Q of a planar inductor is:

$$Q=\omega L/R$$

where R is the resistance of the coil, and L is the inductance of the inductor.

The voltage gain G of a planar transformer without load is:

$$G=k(L_2/L_1)^{1/2}\{Q/(1+Q^2)^{1/2}\}$$

where k is the coupling factor between the primary and secondary windings, $L_1$ and $L_2$ are the inductances of the primary and secondary windings, respectively, the quality coefficient Q is $\omega L_1/R_1$, and $R_1$ is the resistance of the primary-winding coil. The gain G is virtually proportional to Q when Q<<1, and has a constant value $k(L_2/L_1)^{1/2}$ when Q>>1.

To increase the quality coefficient Q of the inductor, and to increase the gain G of the transformer is thereby to limit the voltage fluctuation, it is necessary to reduce the resistance of, and increase the inductance of, the coil, as much as possible. In the conventional planar magnetic elements made by means of the thin-film process, however, the coil conductors, which need to be formed in a plane, cannot have a large cross-sectional area. Therefore, these elements cannot help but have a very high resistance and an extremely small inductance. Consequently, the conventional planar inductor has an insufficient quality coefficient Q, and the conventional planar transformer has an insufficient gain G and a great voltage fluctuation. These drawbacks of the conventional planar magnetic elements have been a bar to the practical use of these elements.

Of planar coils which can be used in planar inductors, spiral coils are the most preferable due to their great inductance and their great quality coefficient Q. In fact, planar inductors, each having a spiral planar coil, have have been manufactured, one of which is schematically illustrated in FIG. 1. As FIG. 1 shows, the planar inductor comprises a spiral planar coil shaped like a square plate, two polyimide films sandwiching the coil, and two Co-base amorphous alloy ribbons sandwiching the coil and the polyimide films and prepared by cutting a Co-based amorphous alloy foil made by rapidly quenching cooling the melted alloy. This planar inductor is incorporated in an output choke coil for use in a 5 V-2 W DC-DC converter of step-down chopper-type, as is disclosed in N. Sahashi et al, Amorphous Planar Inductor for Small Power Supplies, the National Convention Record, the Institute of Electrical Engineers of Japan 1989, S. 18-5-3. As is evident from the graph of FIG. 2A, two currents flow through this choke coil. The first current is a DC current which corresponds to the load current. The second current is an AC current which has been generated by the operation of a semiconductor switch. As the DC current increases, the operating point of the soft magnetic core, shifts into the saturation region of the B-H curve. As a result, the magnetic permeability of the magnetic alloy lowers, whereby the inductance abruptly decreases as is illustrated in FIG. 2B. As is evident from FIG. 3, the AC current becomes too large at the time the inductance sharply decreases. This excessive AC current is a stress to the semiconductor switch, and may break down the switch in some cases.

It is desired that the choke coil have its electric characteristics, such as inductance, unchanged even if a superimposed DC current flows through it. FIG. 4 is a graph representing the typical superimposed DC current characteristic of the choke coil, which is the relationship between the inductance of an inductor and a superimposed DC current flowing through the inductor.

In the case of a planar inductor, the conductor coil is very close to the soft magnetic cores and, hence, generates an intense magnetic field even if the current flowing through it is rather small. Thus, the soft magnetic cores are likely to undergo magnetic saturation. It will be explained how such magnetic saturation occurs in, for example, a planar inductor which comprises an Al—Cu alloy spiral planar coil, two insulation layers sandwiching the coil, and two magnetic layers clamping the coil and the insulation layers together.

The planar coil of this planar inductor is made of an conductor having a width of 50 $\mu$m and a thickness of 10 $\mu$m. The coil has 20 turns, and the gap between any two adjacent turns is 10 $\mu$m. Each insulation layer has a thickness of 1 $\mu$m, and either magnetic layer has a thickness of 5 $\mu$m. The planar coil has a saturated magnetic flux density $B_S$ of 15 kG and a magnetic permeability $\mu_s$ of 5000.

Assuming that the Al—Cu alloy conductor has a permissible current density of $5\times10^8$ A/m$^2$, the permissible current Imax is 250 mA. The present inventors tested the planar inductor in order to determine the relationship between the current flowing through the coil and the intensity of the magnetic field generated in the surface of either magnetic layer from the current. The results of the test revealed that both magnetic layers were magnetically saturated when a current of 48 mA or more flowed through the Al—Cu alloy coil. It follows that, if this planar inductor is used as a choke coil, the maximum DC superimposed current is limited to 48 mA. This value is no more than about one fifth of the permissible coil current Imax. Inevitably, the magnetic layers will be readily saturated magnetically.

The limited DC superimposed current is a drawback which is serious, not only in the planar inductor used as a choke coil, but also in a planar transformer. In a planar transformer incorporated in, for example, a DC-DC converter of forward type or fly-back type, a pulse voltage of one polarity is applied to the primary coil. The magnetic layers are thereby saturated magnetically, abruptly decreasing the inductance of the transformer.

Hence, attempts have been made to provide a planar inductor and a planar transformer, which are designed such that the influence of the saturation of the magnetic layers is reduced, thereby to increase the maximum DC superimposed current of the device comprising the planar or transformer and to make an effective use of the magnetic anisotropy of the magnetic layers.

Planar coils can be into various types such as zig-zag type, spiral type, zig-zag/spiral type, and so on, in accordance with their patterns. Of these types, the spiral type can be provided with the greatest inductance. Hence, a spiral planar coil can be smaller than any other type having the same inductance. To form the terminals of a spiral planar coil, however, it is necessary to connect two spiral coils positioned in different planes by means of a through-hole conductor, or to use conductors for leading the terminals outwards. Hence, the process of manufacturing a spiral planar coil is more complex than those of manufacturing the other types of planar coils.

For electronic circuit designers it is desirable that planar magnetic elements to be incorporated in an electronic circuit have so-called "trimming function" so that their characteristics may be adjusted to values suitable for the electronic circuit. A magnetic element having a trimming function has indeed been developed, which has a screw and in which, as the screw is rotated, its position with respect of the core of the coil, thereby to vary the inductance of the magnetic element continuously. However, most conventional planar magnetic elements have no trimming function, for the following reason.

As is known in the art, the characteristics of planar magnetic elements greatly depend on their structural parameters and the characteristics of the planar coils and magnetic layers. These factors determining the characteristics of the magnetic elements depend on the steps of manufacturing the elements. Since these steps can hardly be performed under the same conditions, the resultant elements differ very much in their characteristics. Naturally it is desired that the elements be provided with trimming function. However, they cannot have trimming function because of their specific structural restriction.

Transformer with large output power is disclosed in A. F. Goldberg et al., *Issues Related to* 1–10-*MHz Transformer Design,* IEEE Trans. Power Electronics, Vol. 4, No. 1, January 1989, pp. 113–123.

As has been pointed out, planar magnetic elements small enough to be integrated with other circuit elements have not been produced, making it practically impossible to manufacture sufficiently small integrated LC-circuit sections, a typical example of which is a power-supply section.

Since the Multilayered planar inductors essentially have a open magnetic circuit, it is difficult to achieve the following two requirements:

(1) They have no leakage fluxes, and only slightly influence the other components of the IC in which they are in corporated.

(2) They have a large inductance.

Therefore, the multilayered planar inductors cannot serve to provide sufficiently small integrated LC-circuit sections, such as a power-supply section.

Hence, there is still great demand for planar magnetic elements for use in a circuit section, which only slightly influence the other components of the circuit, influence other components. Further, the conventional planar magnetic elements can hardly have trimming function, due to the structural restriction imposed on them.

SUMMARY OF THE INVENTION

It is a first object of the present invention to provide a planar magnetic element which is small enough to be integrated with electric elements of other types;

It is a second object of the invention to provide a planar magnetic element which has a sufficiently great inductance;

It is a third object of this invention to provide a planar magnetic element which has but only a few leakage fluxes;

It is a fourth object of the invention to provide a planar magnetic element which excels in high-frequency characteristic and superimposed DC current characteristic;

It is a fifth object of the present invention to provide a planar magnetic element which has large current capacity and, hence, great inductance;

It is a sixth object of the invention to provide a planar magnetic element wherein it is easy to lead terminals outwards;

It is a seventh object of this invention to provide a planar magnetic element which has a trimming function, so that its electric characteristics can be adjusted externally.

The invention will accomplish the above objects by the following six aspects of the invention. According to the invention, the elements of different aspects, each having better characteristics than the conventional ones, can be used in any possible combination, thereby to provide new types of planar elements which have still better characteristics and which have better operability.

According to a first aspect of this invention, there is provided a planar magnetic element which comprises: a spiral planar coil having a gap aspect ratio (i.e., the ratio of the width of the conductor to the gap among the conductors) of at least 1; insulation members laminated with the spiral planar coil; and magnetic members laminated with the insulation members. The coil of this planar magnetic element has a relatively low resistance. Therefore, it will have a large quality coefficient Q when used as an inductor, and will have a great gain when used as a transformer. In other words, the element has a sufficient operability.

According to a second aspect of the present invention, there is provided a planar magnetic element which comprises a planar coil formed of a conductor which has a conductor aspect ratio (i.e., the ratio of the width of the conductor to the thickness thereof) of at least 1. In this regard, it should be noted that when this element is used as an inductor, its ability is determined by its permissible current and inductance. The permissible current is, in turn, determined by the cross-sectional area of the conductor. Hence, the permissible current can be increased by making the conductor broader. If the conductor is made broader, however, it will inevitably occupy a greater area in a plane, which runs counter to the demand for miniaturization of the planar magnetic element. On the other hand, the inductance of the planar magnetic element can indeed be increased by bending the conductor more times, thus forming a coil having more turns. The more turns, the larger the area the coil occupies. This also runs counter to the demand for miniaturization. The planar magnetic element according to the invention can have a sufficiently large permissible current since the conductor has an aspect ratio of at least 1.

According to a third aspect of the invention, there is provided a multilayered planar inductor comprising a spiral planar coil and magnetic members sandwiching the planar coil. The magnetic members have a width w greater than the width $a_0$ of the spiral planar coil by a value more than $2\alpha$. It should be noted that the value a is $[\mu_s gt/2]^{1/2}$ where $\mu_s$ is the relative permeability of the magnetic members, t is the thickness of the magnetic members, and g is the distance between the magnetic members. Since $w>a_0+2\alpha$, this planar inductor has a great inductance. When $w=a_0+2\alpha$, for example, the inductance is at least 1.8 times greater than in the case where $w=a_0$. The planar inductor not only has a great inductance, but also has small leakage flux. In view of this, this planar inductor is suitable for use in an integrated circuit, and serves to make electronic devices thinner.

According to a fourth aspect of the present invention, there is provided a planar magnetic element comprising a planar coil and magnetic layers sandwiching the coil. The magnetic layers are magnetically anisotropic in a single axis which extends at right angles to the direction of the magnetic field generated by the coil. Owning to the uniaxial magnetic anisotropy of the magnetic layers, the planar magnetic element excels in superimposed DC current characteristic and high-frequency characteristic. It is suitable for use in high-frequency circuits such as DC-DC converters. In addition, it can be made small and integrated with electric elements of other types, thereby to form an integrated circuit.

According to a fifth aspect of this invention, there is provided a planar magnetic element comprising a planar coil and magnetic layers sandwiching the coil. The planar coil consists of a plurality of one-turn planar coils located in the same plane, having different sizes, and each having an outer terminal. This planar magnetic element can be electrically connected to an external circuit with ease, and can be trimmed by an external means to have its electric characteristics adjusted. Hence, this is a very useful magnetic element, finding use in step-up chopper-type DC-DC converters, resonant DC-DC converters, and very thin RF circuits for use in pagers.

According to a sixth aspect of the present invention, there is provided a planar magnetic element comprising a conductive layer and a magnetic layer. The magnetic layer surrounds the conductive layer, thus forming a closed magnetic circuit. The current flowing in the conductor layer magnetizes the magnetic layer in the direction of the closed magnetic circuit. This planar magnetic element has small leakage flux and a great current capacity. It can, therefore, serve to render electronic devices thinner when incorporated into these devices.

The planar magnetic elements of the invention, described above, can not only be small but also have improved characteristics generally required of magnetic elements such as inductors.

The planar inductors and transformers according to the invention, which comprise planar micro-coils, are small and can be formed on a semiconductor substrate. Therefore, they can be integrated with active elements (e.g., transistors) and passive elements (e.g., resistors and capacitors), thereby constituting a one-chip semiconductor device. In other words, they help to provide small-sized electronic devices containing inductors and transformers. In addition, the planar inductors and transformers of the invention can be fabricated by means of the existing micro-technique commonly applied to the manufacture of semiconductor devices.

As can be understood from the above, the present invention serve to provide small and thin LC-circuit sections for use in various electronic devices, and ultimately contributes to the miniaturization of the electronic devices.

BRIEF DESCRIPTION OF THE DRAWINGS

FIG. 5 is an exploded view illustrating a planar inductor according to the first aspect of the present invention;

FIG. 6 is a sectional view schematically showing the planer inductor shown in FIG. 5;

FIG. 7 is a plan view showing a planar transformer according to the first aspect of the invention;

FIG. 8 is a sectional view schematically showing the planar transformer shown in FIG. 7;

FIG. 9 is a graph representing the relationship between the gap aspect ratio of the inductor of FIG. 5 to the coil resistance thereof, and also to the inductance thereof;

FIG. 10 is a graph showing the relationship between the gap aspect ratio of the inductor of FIG. 5 to the L/R value thereof;

FIG. 11 is a graph explaining the relationship between the gap aspect ratio of the transformer of FIG. 7 to the gain thereof;

FIGS. 12A to 22 are diagrams and graphs showing and explaining the second aspect of the invention;

FIG. 12A is an exploded view showing a magnetic element according to both the first aspect and the second aspect of the invention, having not only a high conductor aspect ratio but also a high gap aspect ratio;

FIGS. 13A to 13D, and FIG. 14 are diagrams explaining how cavities are formed among the turns of the coil conductor incorporated in the magnetic element shown in FIGS. 12A and 12B;

FIG. 15 is a perspective view illustrating a planar capacitor according to the second aspect of the invention, which comprises capacitor with parallel electrodes;

FIG. 16 is a graph representing the k-dependency of the value C/Co of the planar capacitor illustrated in FIG. 15;

FIG. 17 is a sectional view showing a magnetic element according to the second aspect of the present invention, which comprises a single planer coil;

FIG. 18 is a sectional view showing a magnetic element according to the second aspect of the invention, which comprises a plurality of planar coils laminated together;

FIG. 20 is a sectional view illustrating a magnetic element according to the second aspect of the invention, which comprises a planer coil, a substrate, and a bonding layer interposed between the coil and the substrate;

FIG. 21 is a sectional view showing a micro-transformer according to the second aspect of the present invention;

FIG. 22 is a diagram illustrating two types of planar coils according to the second aspect of the present invention;

FIGS. 23 to 28 are diagrams and graphs showing and explaining the third aspect of the invention;

FIGS. 23 and 24 are exploded views showing two types of inductors according to the third aspect of the invention;

FIG. 26 is a diagram explaining the distribution of magnetic field at the ends of the planer spiral coil incorporated in the inductor shown in FIG. 23;

FIG. 27 is a graph representing the relationship between the width w of the magnetic members used in the inductor of FIG. 23 and the leakage of magnetic fluxes;

FIG. 28 is a graph showing the relationship between the width w of the magnetic members used in the inductor of FIG. 23 and the inductance of the inductor;

FIGS. 29 to 48 are diagrams and graphs showing and explaining the fourth aspect of the invention;

FIG. 29 is an exploded view showing a first planar inductor exhibiting a uniaxial magnetic anisotropy, according to the fourth aspect of the invention;

FIG. 30 is a diagram explaining the relationship between the direction of the magnetic field generated by the coil used in the inductor (FIG. 29) and the easy axis of the magnetization of the the magnetic cores;

FIG. 31 is a graph showing a curve of magnetization in the axis of easy magnetization of the inductor (FIG. 29) and a curve of magnetization in the hard axis of magnetization of the magnetic cores;

FIG. 33 is an exploded view illustrating a second planar inductor according to the fourth aspect of the present invention;

FIG. 34 is a graph representing the superimposed DC current characteristic of the planar inductor illustrated in FIG. 33;

FIG. 35 is an exploded view showing a modification of the planar inductor illustrated in FIG. 33;

FIG. 36 is an exploded view illustrating a third planar inductor according to the fourth aspect of the invention;

FIG. 37 is a graph representing the superimposed DC current characteristic of the planar inductor shown in FIG. 36;

FIG. 38 is an exploded view showing a fourth planar inductor according to the fourth aspect of the present invention;

FIG. 39 is a perspective view showing the surface structure of either magnetic layer incorporated in the inductor shown in FIG. 38;

FIG. 40 is a graph representing the relationship between the parameters of the surface structure of either magnetic layer of the inductor (FIG. 38) and the second term of the formula defining Uk;

FIG. 41 is a graph representing the superimposed DC current characteristic of the planar inductor shown in FIG. 38;

FIG. 44 is a plan view showing a modification of the planar inductor illustrated in FIGS. 34A and 43B;

FIG. 45 is a plan view illustrating a sixth planar inductor according to the fourth aspect of the present invention;

FIG. 49 is a plan view showing a first magnetic element according to the fifth aspect of the invention;

FIG. 50 is a plan view illustrating a second magnetic element according to the fifth aspect of the present invention;

FIG. 51 is a plan view showing a third magnetic element according to the fifth aspect of the invention, which is a modification of the element shown in FIG. 49 by connecting outer terminals in a specific manner;

FIG. 52 is a plan view showing a third magnetic element according to the fifth aspect of the invention, which is a modification of the element shown in FIG. 49 by connecting outer terminals in another manner;

FIG. 53 is a plan view showing a third magnetic element according to the fifth aspect of the invention, which is a modification of the element shown in FIG. 49 by connecting outer terminals in still another manner;

FIG. 54 is a diagram representing the relationship between the inductance of the magnetic element shown in FIG. 49 and the manner of connecting the outer terminals;

FIG. 55 is a plan view showing a planer transformer made by connecting the outer terminals of the magnetic element of FIG. 49 in a specific manner;

FIG. 56 is a plan view illustrating a planer transformer made by connecting the outer terminals of the magnetic element of FIG. 49 in another way;

FIG. 57 is a plan view showing another planer transformer made by connecting the outer terminals of the element of FIG. 49 in still another manner;

FIG. 58 is a graph representing the relationship between the voltage and current ratios of the magnetic element shown in FIG. 49, on the one hand, and the manner of connecting the outer terminals, on the other;

FIG. 59 is a sectional view showing a device comprising a semiconductor substrate, an active element formed on the substrate, and a magnetic element according to the fifth aspect of the invention, formed on the semiconductor substrate;

FIG. 60 is a sectional view showing another device comprising a semiconductor substrate, an active element formed in the substrate, and magnetic elements according to the fifth aspect of the invention, located above the active element;

FIG. 61 is a sectional view illustrating a device comprising a semiconductor substrate, magnetic elements according to the fifth aspect of the invention, formed on the substrate, and a magnetic element located above the magnetic elements;

FIGS. 62A to 64 are diagrams and graphs showing and explaining the sixth aspect of the invention;

FIG. 62A is a sectional view showing a one-turn coil according to the sixth aspect of the invention;

FIG. 64 is a sectional view illustrating a magnetic element according to the sixth aspect of the invention, which comprises a one-turn coil of the type shown in FIG. 62A, magnetic layers, and insulation layers;

FIG. 66 is a diagram schematically showing a pager comprising a magnetic element according to the present invention;

FIG. 67 is a plan view showing a 20-pin IC chip of single in-line package (SIP) type, comprising magnetic elements according to the invention;

FIG. 68 is a perspective view of a 40-pin IC chip of dual in-line package type (DIP);

FIG. 69 is a circuit diagram showing a DC-DC converter of step-up chopper type;

FIG. 70 is a circuit diagram illustrating a DC-DC converter of step-down chopper type;

FIG. 71 is a diagram showing an RF circuit for used in an very small portable telephone;

FIG. 72 is a circuit diagram showing a resonant DC-DC converter; and

DETAILED DESCRIPTION OF THE PREFERRED EMBODIMENTS

Various aspects of the present invention will now be described in detail. Although these aspects will be explained, one by one, they can be combined, thereby to provide a variety of magnetic elements which fall within the scope of the invention. Since the materials of the magnetic elements are substantially common to the aspects of the invention, they will be described at the very end of this description.

The first aspect of the invention will be described, with reference to FIGS. 5 to 11.

Figure 1:
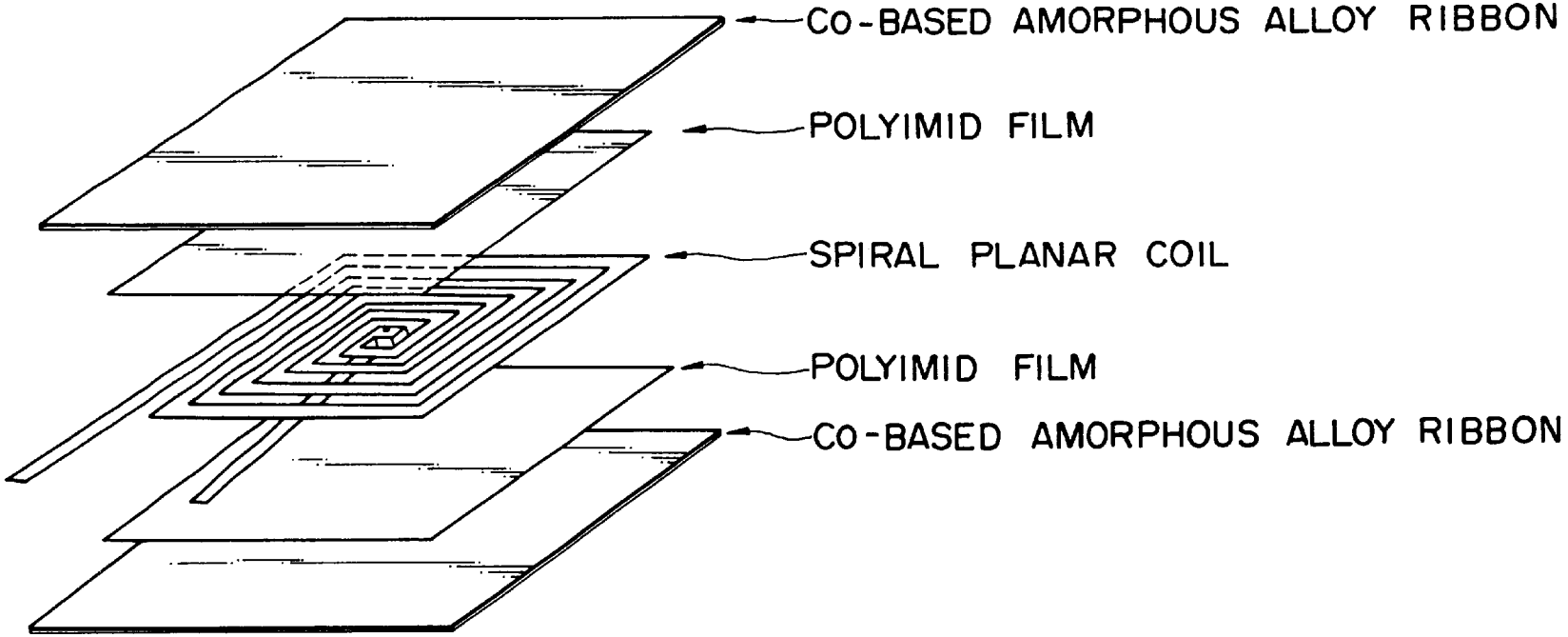
(PRIOR ART) FIG. 1
FIG. 1 is an exploded view of a conventional planar inductor comprising amorphous magnetic ribbons and square spiral planar coil.
Figure 2A:
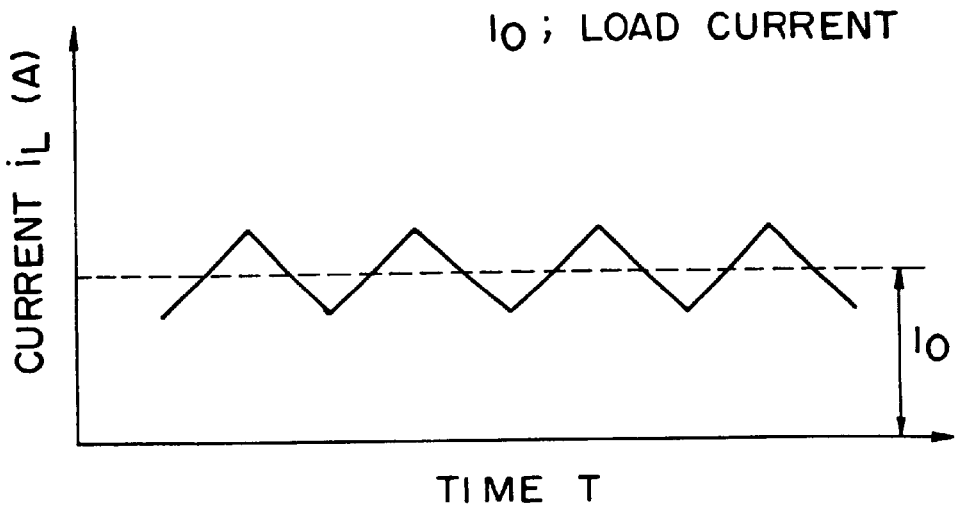
(PRIOR ART) FIG. 2A
FIGS. 2A and 2B illustrate the waveforms of the currents flowing through the output choke coils of conventional DC-DC converters.
Figure 2B:
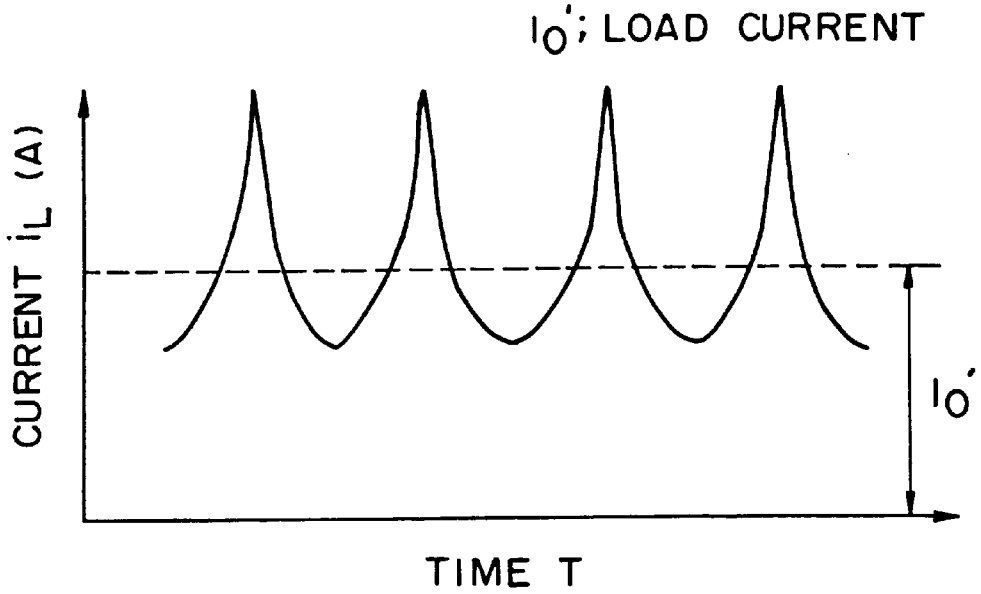
(PRIOR ART) FIG. 2B
Figure 3:
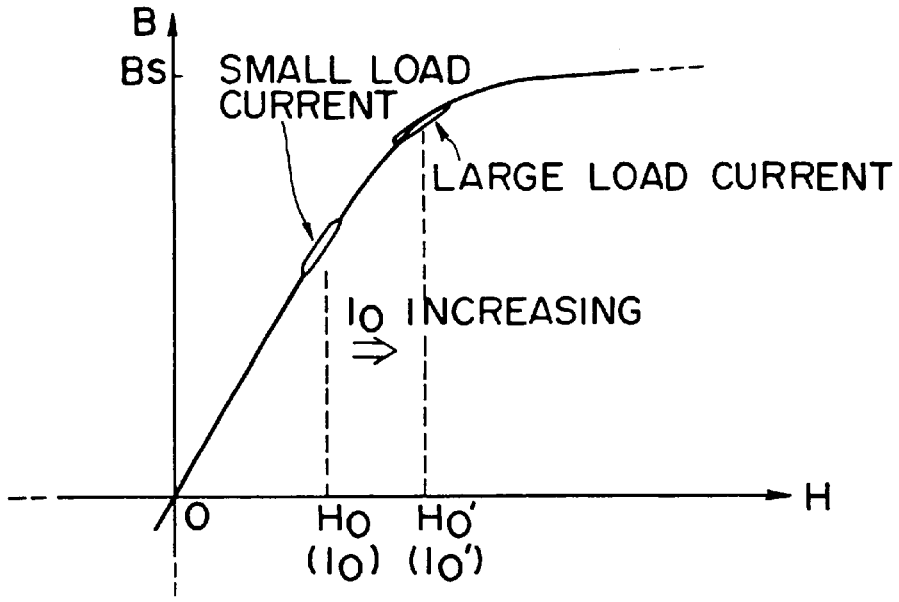
(PRIOR ART) FIG. 3
FIG. 3 is a graph representing the B-H curve of the soft magnetic core shown in FIG. 1.
Figure 4:
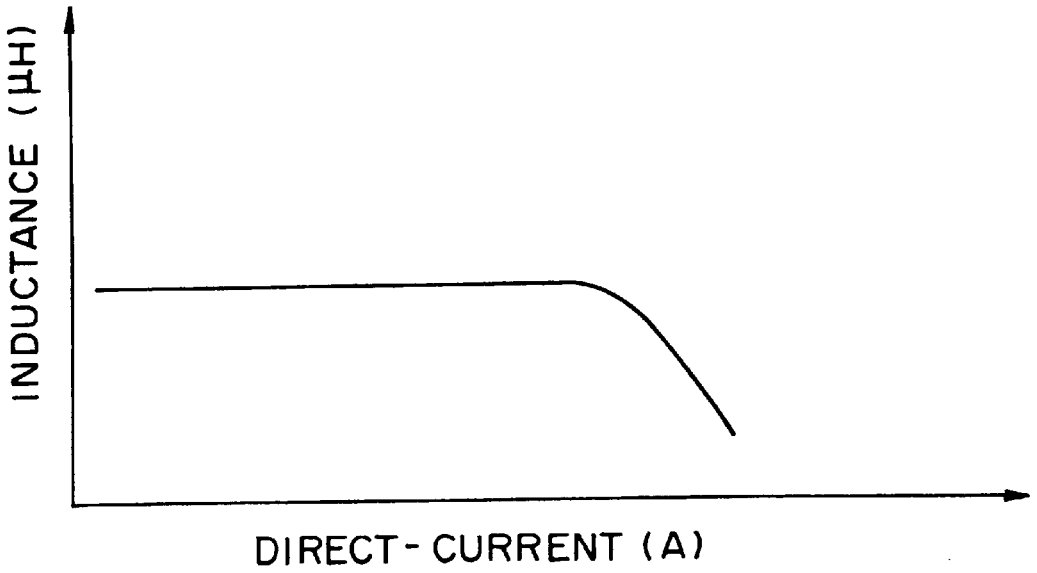
(PRIOR ART) FIG. 4
FIG. 4 is a graph showing the superimposed DC current characteristic of the planar inductor shown in FIG. 1.
Figure 5:
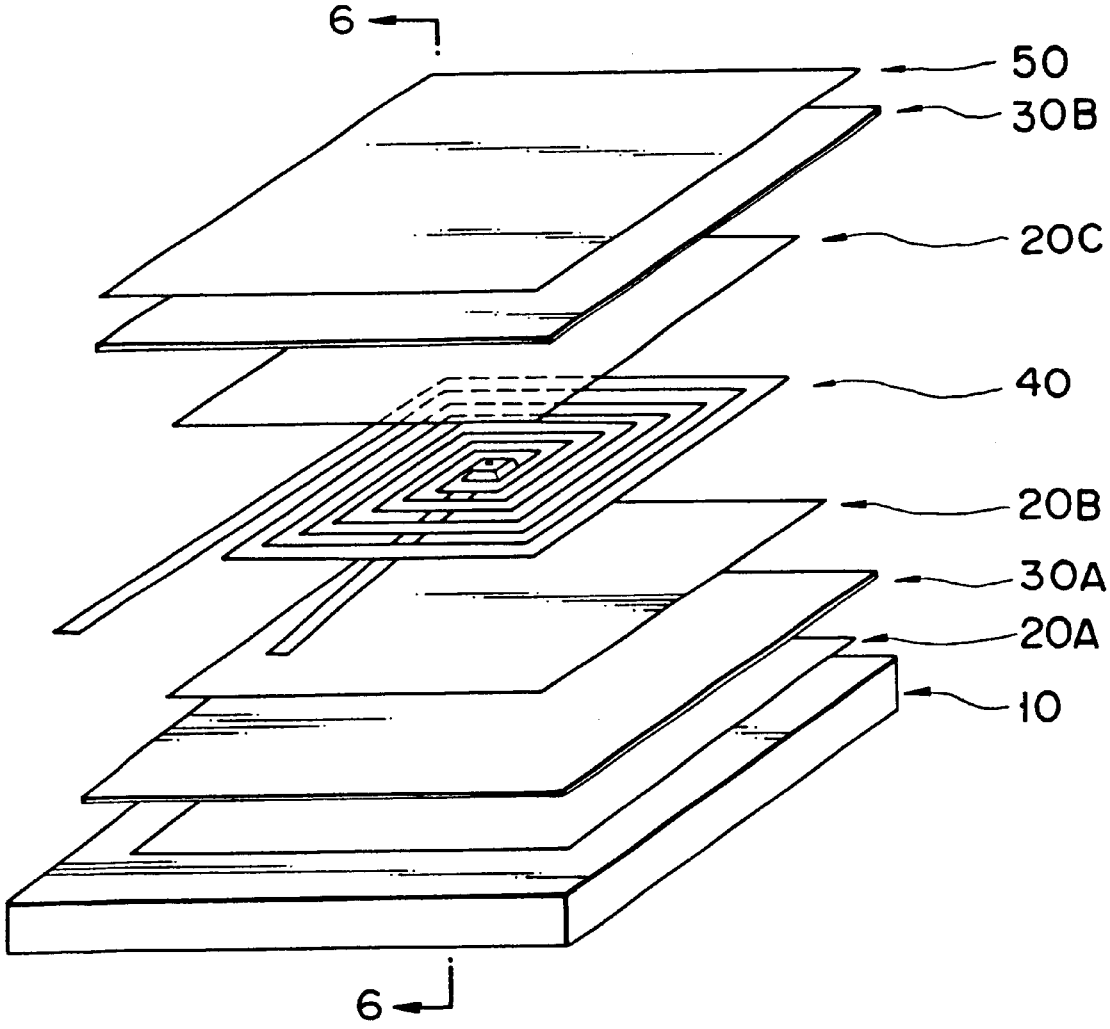
FIGS. 5 to 11 are diagrams and graphs showing and explaining the first aspect of the invention.
Figure 6:
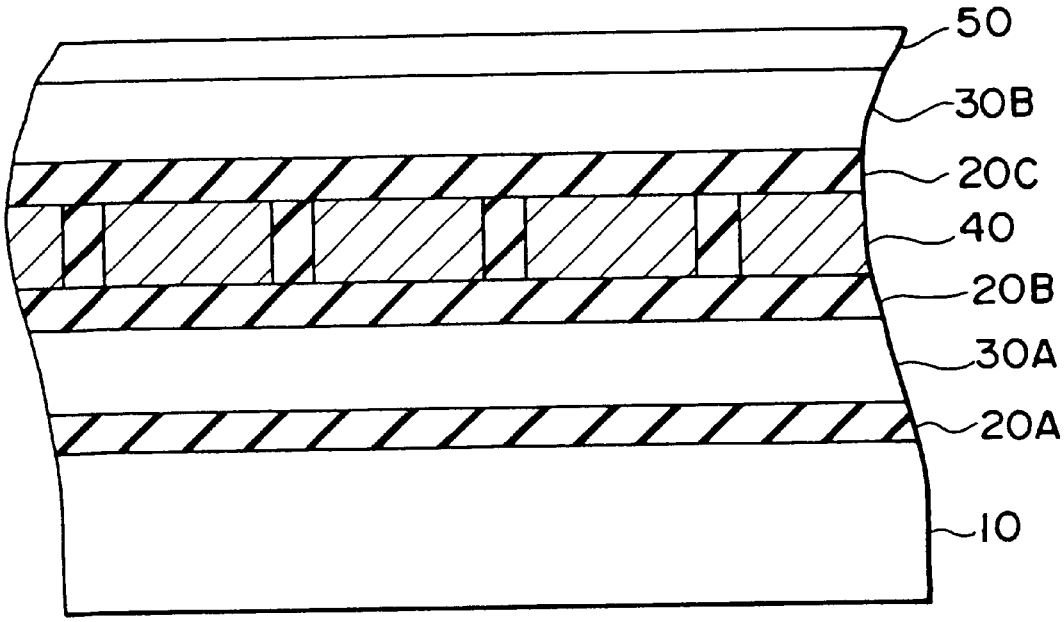

FIG. 5 is an exploded view showing a planar inductor according to the first aspect of the invention. As is shown in the FIG. 5, the planar inductor comprises a semiconductor substrate 10, three insulating layers 20A, 20B and 20C, two magnetic layers 30A and 30B, a spiral planar coil 40, and a protection layer 50. The insulation layer 20A is formed on the substrate 10. The magnetic layer 30A is formed on the layer 20A. The insulation layer 20B is formed on the magnetic layer 30A. The coil 40 is mounted on the layer 20B. The insulation layer 20C covers the coil 40. The magnetic is layer 30B is formed on the layer 20C. The protection layer 50 is formed on the magnetic layer 30B. FIG. 6 is a sectional view, taken along line 6—6 in FIG. 5, illustrating a portion of the planar inductor. In FIG. 6, the components identical to those shown in FIG. 5 are designated by the same numerals.

Figure 7:
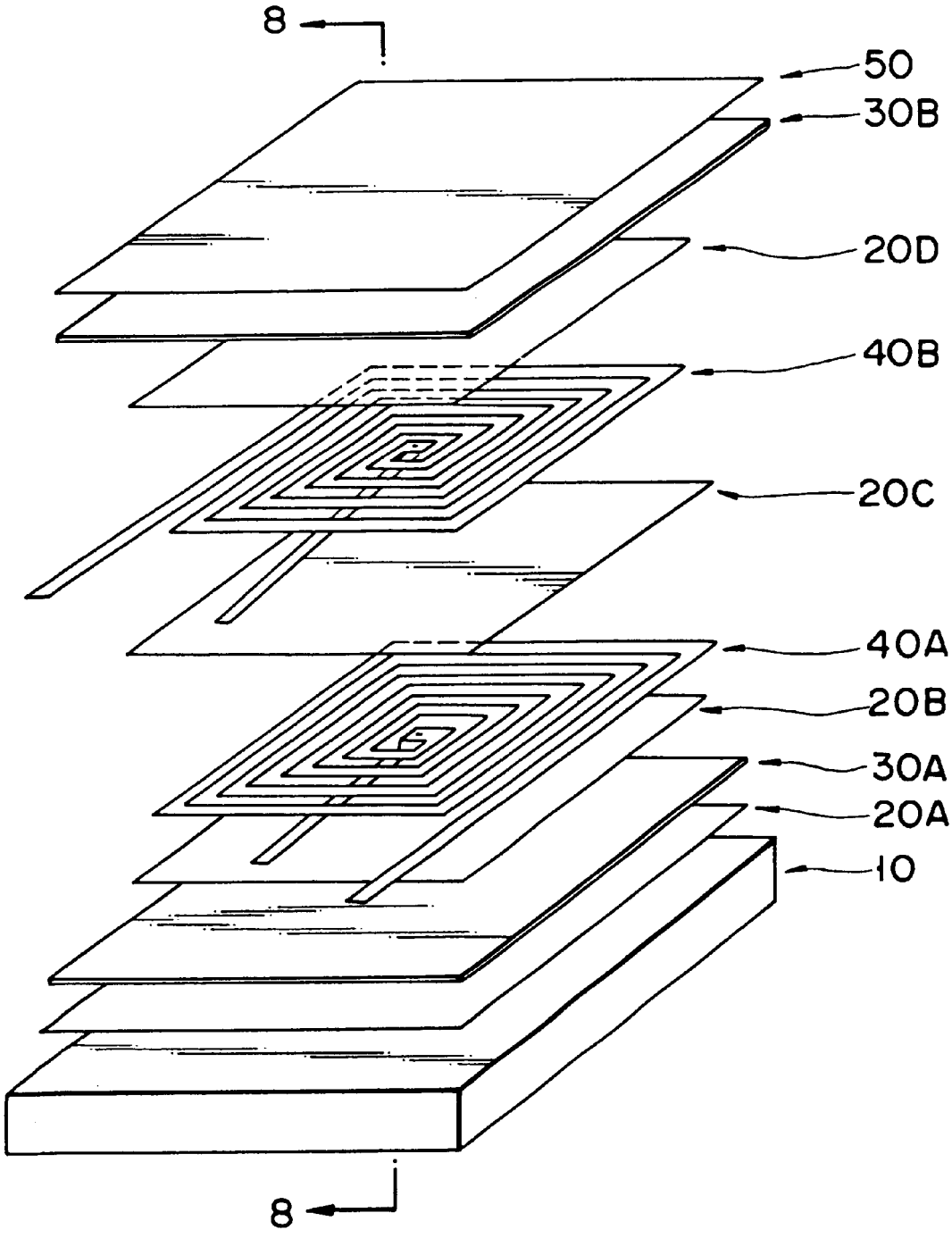
Figure 8:
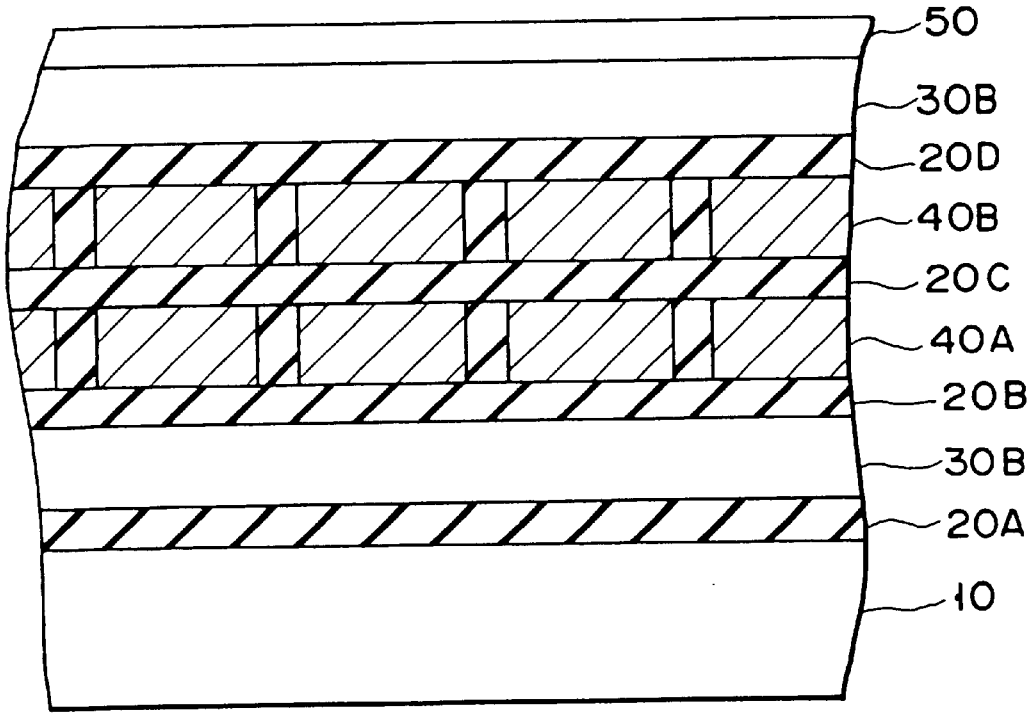

FIG. 7 is an exploded view showing a planer transformer according to the first aspect of the invention. This transformer is characterized in that the primary and secondary coils have the same number of turns. As is illustrated in FIG. 7, the transformer comprises a semiconductor substrate 10, four insulation layers 20A to 20D, two magnetic layers 30A and 30B, two spiral planar coils 40A and 40B, and a protection layer 50. The layers 20A, 30A, and 20B are formed, one upon another, on the substrate 10. The primary coil 40A is mounted on the insulation layer 20B. The insulation layer 20C is laid upon the primary coil 40A. The secondary coil 40B is mounted on the insulation layer 20C. The insulation layer 20D is laid on the secondary coil 40B. The magnetic layer 30B is formed on the layer 20D. The protection layer 50 is formed on the magnetic layer 30B. FIG. 8 is a sectional view, taken along line 8—8 in FIG. 7, illustrating a portion of the planar transformer. In FIG. 8, the components identical to those shown in FIG. 7 are denoted by the same numerals.

In both the planar inductor of FIGS. 5 and 6 and the planar transformer of FIGS. 7 and 8, the substrate 10 is made of silicon. The silicon substrate 10 can be replaced by a glass substrate. When a glass substrate is used in place the silicon substrate 10, the insulation layer 20A, which is beneath the magnetic layer 30A, can be dispensed with.

The spiral planar coil 40 used in the inductor of FIG. 5 and the spiral planar coils 40A and 40B used in the transformer of FIG. 7 have a gap aspect ratio h/b of at least 1, where h is the thickness of the coil conductor and b is the gap between any adjacent two turns. Two alternative methods can be employed to form a spiral planar coil having this high gap aspect ratio h/b. The first method is to perform deep etching on a conductor layer, thus forming a spiral slit in the plate, and then fill the spiral slit with insulative material. The second method is to layer dry etching on an insulative layer, thus forming a spiral slit in the layer, and then fill this slit with conductive material.

There are two variations of the first method. In the first variation, the spiral slit is filled up with the insulative material. In the second variation, the slit is partly filled, such that a cavity is formed in the resultant coil conductor. The first variation falls within the first aspect of the invention, whereas the second variation falls within the second aspect of the present invention.

More specifically, according to the first aspect of the invention, the spiral planar coil is formed in the following way. First, a conductor layer is formed on an insulation layer. Then a mask layer is formed on the conductor layer. The mask layer is processed, thereby forming a spiral slit in the mask layer. Using this mask layer, high-directivity dry etching, such as ion beam etching, ECR plasma etching, reactive ion etching, is performed on the conductor layer, thus forming a spiral slit in the conductor layer and, simultaneously, a coil conductor having a gap aspect ratio h/b of 1 or more. It is required that the etching speed of the mask layer be much different from that of the conductor layer, so that vertical anisotropic etching may be accomplished.

To form an insulation layer on the coil conductor having a high gap aspect ratio h/b, it is desirable that the gap between the turns with insulative material having small dielectric coefficient and that the mass of the insulative material be processed to have a flat top surface. When the insulative material is an inorganic one, such as $SiO_2$ or $Si_3N_4$, CVD method or sputtering (e.g., reactive sputtering or bias sputtering) is employed to form the insulation layer. When the insulative material is an organic one, it is preferably polyimide (including a photosensitive one). Instead, resist can be utilized. The insulative material, either organic or inorganic, is mixed with a solvent, thus forming a solution. The solution is spin-coated on a substrate. The resultant coating is cured by an appropriate method, whereby an insulation layer is formed. The insulation layer, thus formed in the gap between the turns of the coil conductor, is subjected to etch-back process and is caused to have a flat top surface.

The second method of forming a spiral planar coil, which falls within the second aspect of the invention will be described. In this method, an insulation layer is first formed. A patterned resist is formed on the insulation layer. Using the resist as a mask, selective dry etching is performed on the insulation layer, thus forming a spiral slit in the insulation layer. Then, a conductor layer is formed on the patterned resist and in the spiral slit, by means of sputtering, CVD method, vacuum vapor-deposition, or the like. Next, the resist is removed from the insulation layer and the conductor layer by means of a lift-off method. Simultaneously, those portions of the conductor layer, which are on the resist, are also removed. As a result, a spiral planar coil is formed.

Whether the first method or the second method should be used to form the spiral planar coil depends upon the pattern of the planar coil.

The advantages of the magnetic elements according to the first aspect of the invention will be explained.

Figure 9:
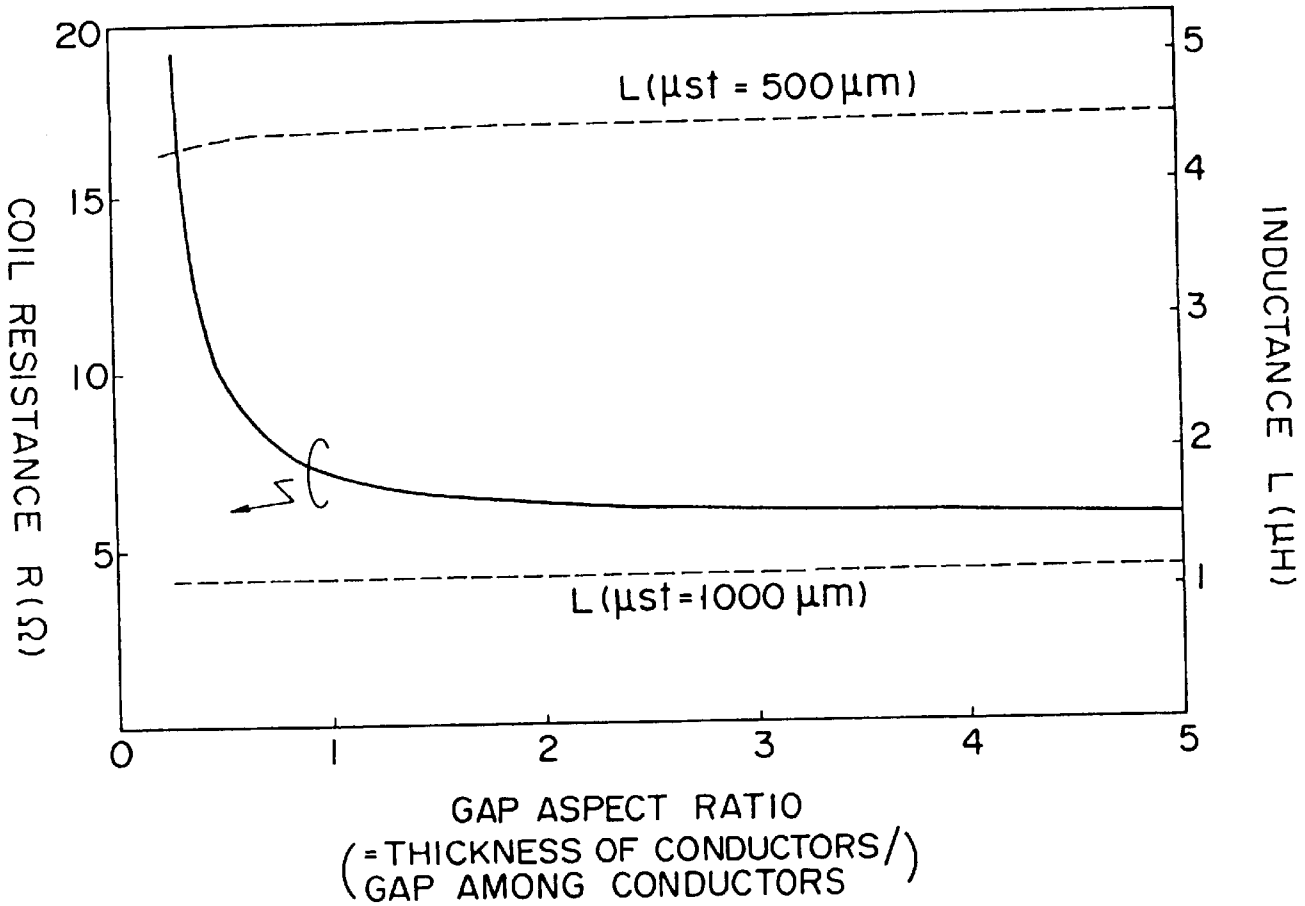

FIG. 9 represents the relationship between the gap aspect ratio of the planar inductor of FIG. 5 to the coil resistance thereof, and also to the inductance thereof. The parameter of the inductance L is $\mu_s t$, where $\mu_s$ is the relative permeability of the magnetic layers 30A and 30B, and t is the thickness thereof. In this instance, $\mu_s t$=5000 $\mu$m or 1000 $\mu$m. As is evident from FIG. 9, the inductance L of the planar inductor is almost constant, not depending on the gap aspect ratio h/b. The resistance of the spiral planar coil 40 is inversely proportional to the gap aspect ratio h/b, and remains virtually constant if the gap aspect ratio h/b exceeds 5.

Figure 10:
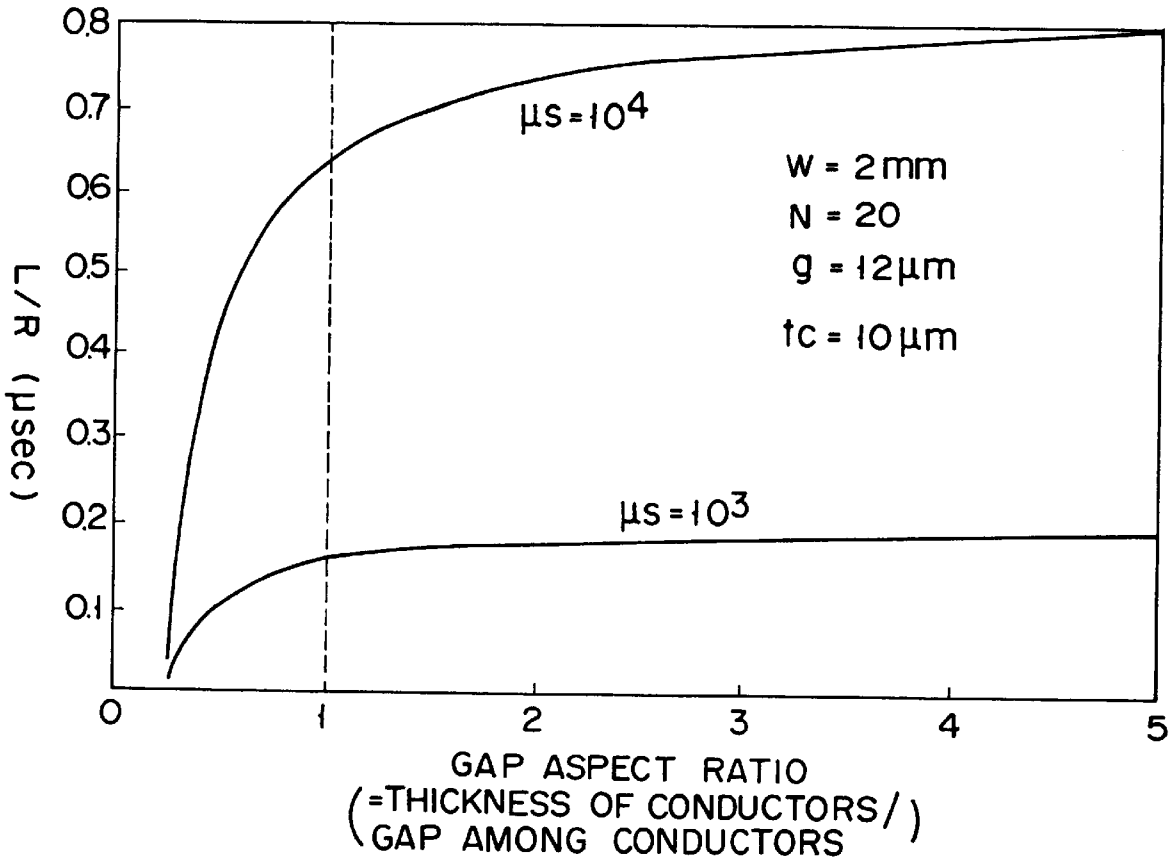

FIG. 10 shows the relationship between the gap aspect ratio of the inductor of FIG. 5 to the L/R value thereof. L/R is a physical quantity proportional to the quality coefficient Q of the inductor, which is given as: $Q=2\pi fL/R$ where f is frequency (Hz). In FIG. 10, the relationship is shown for two parameters, i.e., relative permeabilities $\mu_s$ of $10^4$ and $10^3$ of either magnetic layer. As is evident from FIG. 10, L/R increases with the gap aspect ratio h/b, but not over 5 even if the ratio h/b further increases.

The inventors hereof made planar inductors of the type shown in FIG. 5, which had different gap aspect ratios of 0.3, 0.5, 1.0, 2.0, and 5.0. Some of these inductors had a parameter $\mu_s t$ of 5000 $\mu$m, and the the rest of them had a parameter $\mu_s t$ of 1000 $\mu$m, where s is the the relative permeability of either magnetic layer, and t is the thickness thereof. The inventors tested these planar inductors to see how their quality coefficients Q depended on their gap aspect ratios. The results of the test were as is shown in the following table:

| Ratio | Q (f = 5 MHz) $\mu_s$ ($\mu$m) | |
|---|---|---|
| h/b | $5 \times 10^3$ | $1 \times 10^3$ |
| 0.3 | 5.5 | 1.4 |
| 0.5 | 13.5 | 3.3 |
| 1.0 | 19.8 | 4.9 |
| 2.0 | 22.9 | 5.7 |
| 5.0 | 25.0 | 6.3 |

As can be understood from the table, the coefficient Q of the planar inductor having a gap aspect ratio of 1 is about 3.5 times greater than that of the inductor having a gap aspect ratio of 0.3, and about 1.5 times greater than that of the inductor having a gap aspect ratio of 0.5. Obviously, any planar inductor of the type shown in FIG. 5 can have a sufficiently great quality coefficient Q if its gap aspect ratio is 1 or more.

Figure 11:
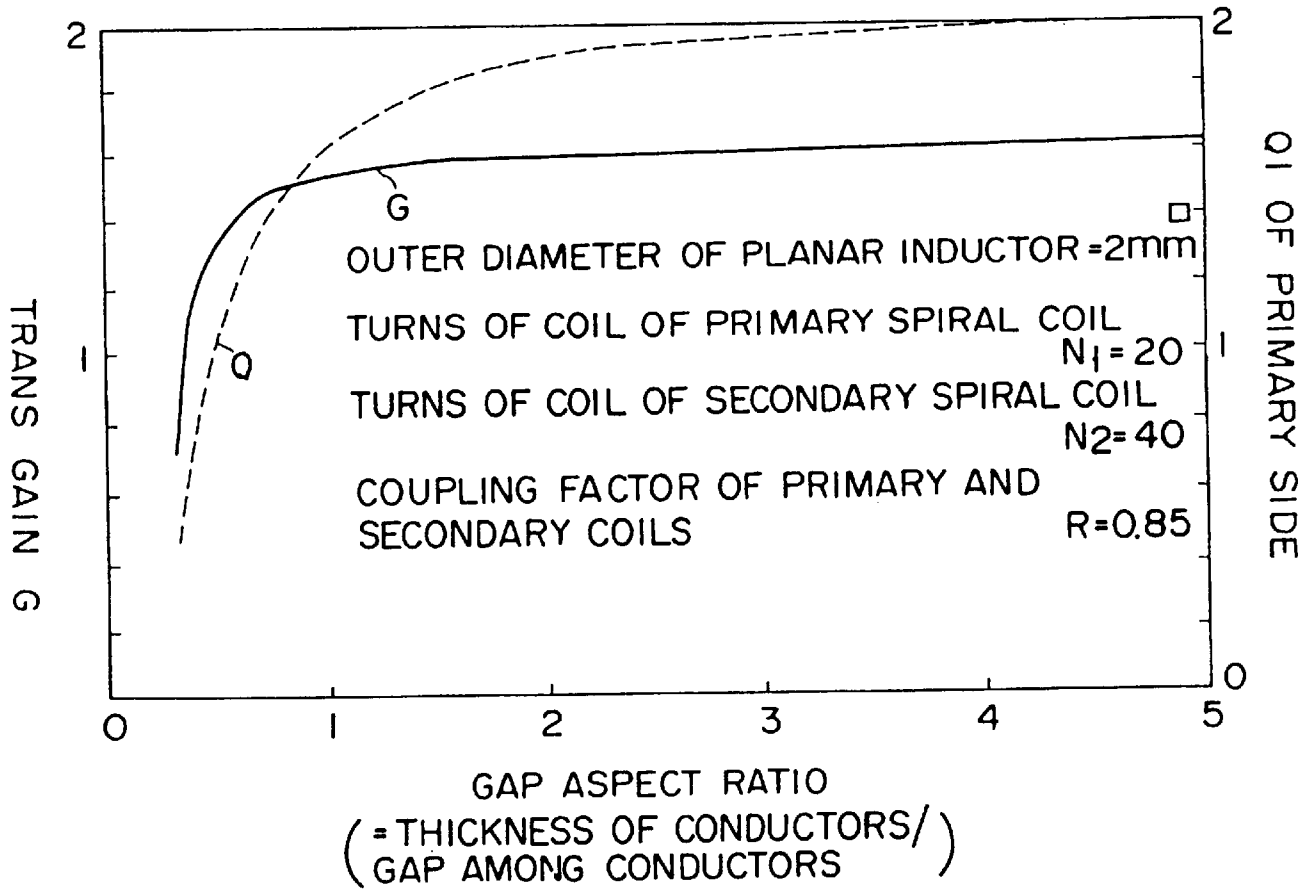

FIG. 11 explains the relationship between the gap aspect ratio of the planar transformer of FIG. 7 to the gain thereof. As this figure reveals, the transformer can have a sufficient large coefficient Q and, hence, a sufficiently great gain, if its gap aspect ratio is 1 or more.

One of the determinants of the ability of a magnetic element is the material of the element. Hence, the type of material used is important for forming the magnetic element. This point will be described at the end of the present description.

Various planar, magnetic elements according to the second aspect of the invention, which are characterized by their specific conductor aspect ratio h/d (h is the height of the coil conductor, and d is the width thereof), will now be described with reference to FIG. 12A through FIG. 22.

Figure 12A:
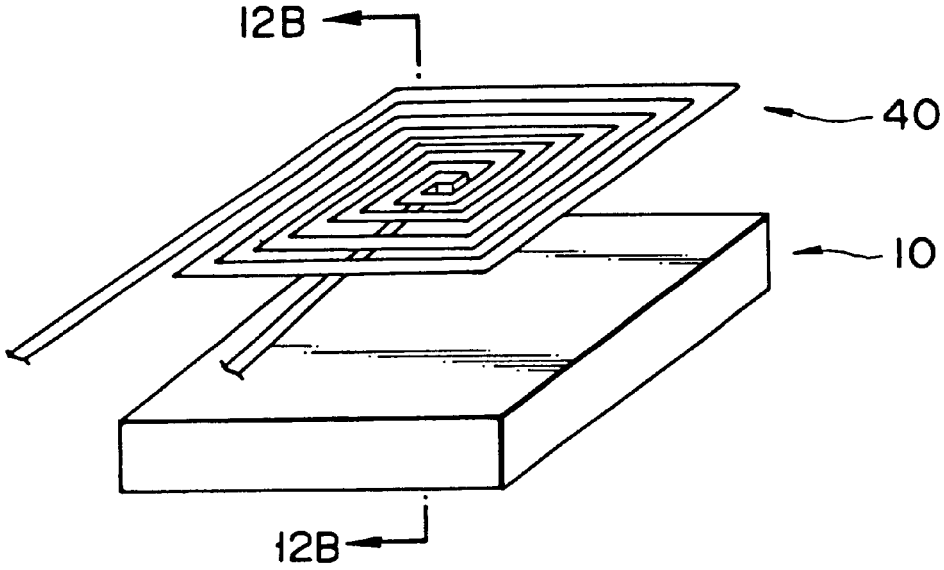
Figure 12B:
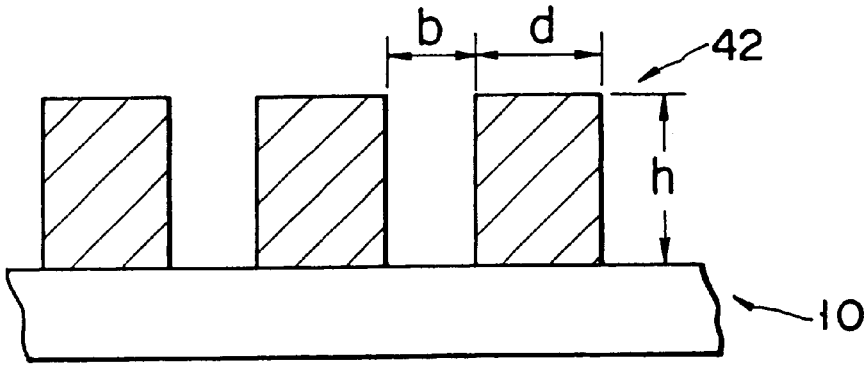
FIG. 12B is a sectional view, taken along line 12B—12B in FIG. 12A.

FIG. 12A is an exploded view showing a planar magnetic element. FIG. 12B is a sectional view, taken along line 12B—12B in FIG. 12B. The planar magnetic element has not only a high conductor aspect ratio but also a high gap aspect ratio. In view of this, it falls within both the first aspect and the second aspect of the present invention.

As is shown in FIGS. 12A and 12B, the planar magnetic element comprises a substrate 10 and a spiral planar coil 40 directly mounted on the substrate 10. The coil conductor 42 (FIG. 12B) can be formed by the known process commonly employed in forming the wiring of semiconductor devices. The smaller the gap between the turns of the coil conductor 24, the smaller the planar magnetic element. However, the smaller the gap, the more difficult for the element to have a sufficiently high conductor aspect ratio. Hence, it is required that a gap be first set at the value most suitable for the use of the element, and then the conductor aspect ratio h/d be then determined. According to the second aspect of the invention, the conductor aspect ratio h /d is at least 1. In other words, the coil conductor 42 has a height equal to or greater than the width d. In order to miniaturize the planar magnetic element, it is of course desirable that the gap aspect ratio h/b be as large as possible. In practice, however, it would be most recommendable that both the width d of the conductor 42 and the gap b between the turns thereof be both about 10 $\mu$m or less.

In order to produce a coil conductor having a high aspect ratio h/d, it is necessary to etch a narrow spiral portion of a thick conductive layer. Hence, preferred as such a conductive layer is a crystal film having a plane of easy etching which is parallel to the layer itself. Needless to say, a single crystal film is the most preferable.

Despite its structure, the planar magnetic element shown in FIGS. 12A and 12B may have an insufficient inductance if it is made small. Nonetheless, its reactance $\omega L$ ($\omega$ is drive angular frequency) can be increased by driving the element at high switching frequency. Recently, magnetic elements are driven at higher and higher switching frequencies. The reactance of the planar magnetic element shown in FIGS. 12A and 12B, if insufficient due to the miniaturization of the element, does not suffer from any drawbacks. The inductance can perform its function in a high-frequency region (e.g., several MHz) even if its inductance is as low as nH.

When the turns of a coil conductor having high aspect ratio h/d are close to one another, the inter-turn capacitance is large, due to the narrow gap between any two adjacent turns and the large opposing faces thereof. Because of this great inter-turn capacitance, the planar magnetic element can be incorporated in an LC circuit. In most cases, however, the use of the element decreases the LC resonant frequency (generally known as "cutoff frequency"), and the element can no longer work as an inductor. It is therefore necessary to decrease the inter-turn capacitance to a minimum. This capacitance can be reduced by forming an insulation layer (e.g., a $SiO_2$ layer) which has a cavity extending between the turns of the coil conductor and which decreases the inter-turn dielectric coefficient. The cavity may be vacuum or filled with the material gas used for forming the the insulation layer. In either case, the inter-turn dielectric coefficient is far smaller than in the case where the gap between the turns is filled with the insulative material.

To form an insulation layer having such a cavity, it suffices to employ the CVD method used in manufacturing semiconductor devices. The gap between the turns of the coil conductor is not completely filled with the insulative material (e.g., $SiO_2$) as in manufacturing semiconductor devices. Rather, an insulation layer grows thicker, first on the top surface of the coil conductor and then on the sides of the upper portion of each turn. The layer on the sides of each turn is made to grow thicker until it closes up the opening of the gap between the turns. To grow the insulation layer in this specific way, it suffices to set the gas-feeding speed at an appropriate value.

Figure 13A:
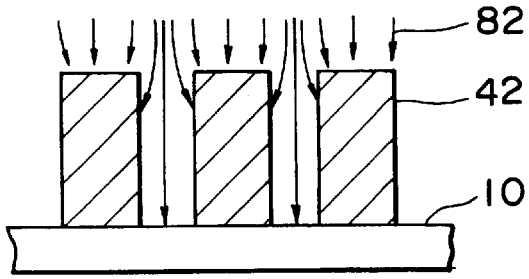
Figure 13B:
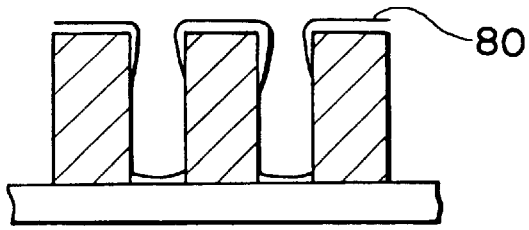
Figure 13C:
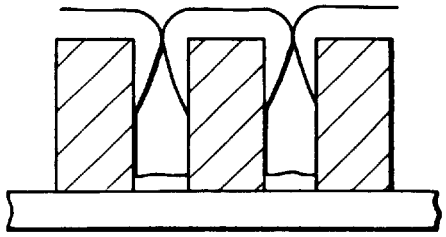
Figure 13D:
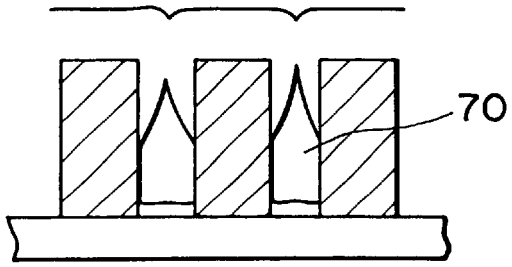

More specifically, as is illustrated in FIG. 13A, the material gas 82 is applied onto the coil conductor 42 formed on the substrate 10. It is difficult for the gas 82 to flow to the bottom of the gap between the coil turns. Hence, an insulation layer 80 grows fast on the top of each turn 42, and grows less on the sides of the is upper portion of thereof, as is illustrated in FIG. 13B. The layer 80 fast grows thicker on the top of each turn 42 and slowly grows on the sides of the upper portion thereof. As is shown in FIG. 13C, the layer 80 contacts the layer formed on the next turn. The layer 80 keeps on growing thicker, closing up the openings among the turns 42. As a result, as is shown in FIG. 13D, a cavity 70 is formed which extends between the turns of the coil conductor 42.

Figure 14:
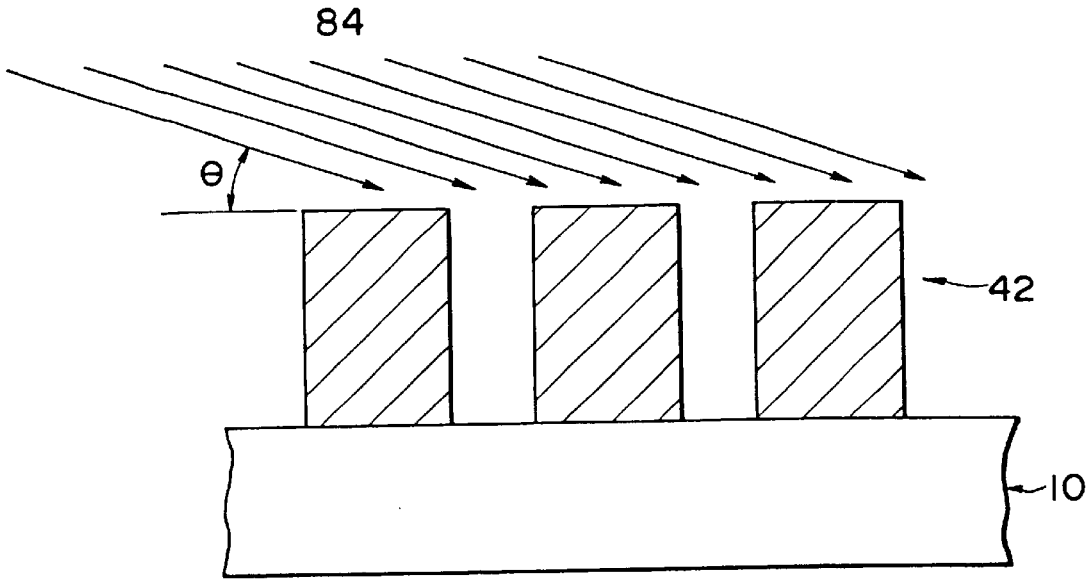

An insulation layer having a cavity can be formed by means of sputtering, as is illustrated in FIG. 14. More specifically, particles of insulative material are applied slantwise to a coil conductor 42, at an angle $\theta$ to the top surface of the conductor 42. The insulation layer formed by the sputtering is less smooth than the insulation layer formed by the CVD method. In view of this, the sputtering method is not desirable.

Figure 15:
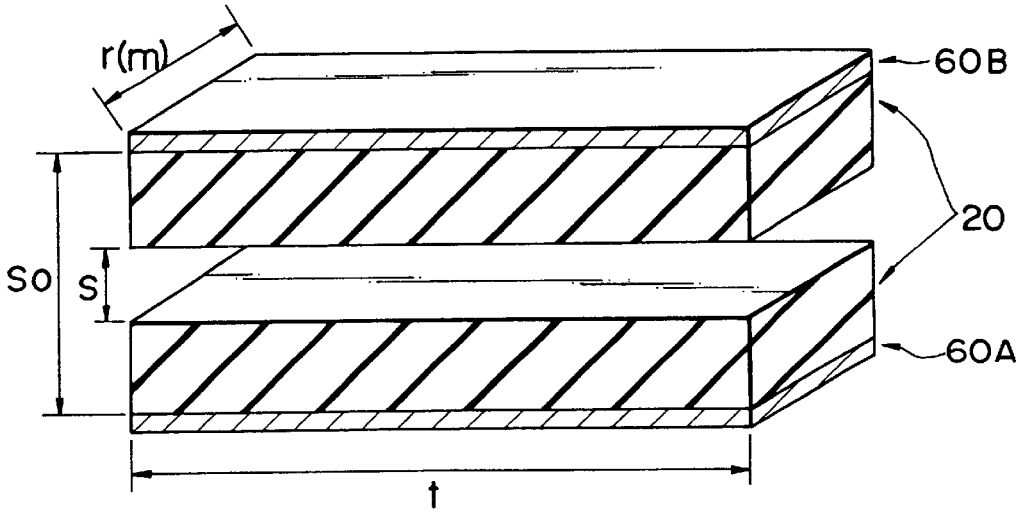

The reduction of the inter-turn capacitance, which has resulted from the cavity 70 extending between the turns of the coil conductor 42, will be explained, with reference to FIG. 15 illustrating a planar capacitor according to the second aspect of the invention, which comprises two parallel capacitor units.

The upper unit comprises an insulation member 20 and an electrode 60B formed on the upper surface of the member 20. The lower unit comprises an insulation member 20 and an electrode 60B formed on the lower is surface of the member 20. The capacitor units have the same size of r(m)×t(m). The insulation members 20 have a dielectric coefficient $\in$. They are spaced apart by distance s. Were the gap so between the electrodes 60A and 60B filled with the same insulative material as the members 20, this capacitor should have capacitance $C_0$ given as:

$$C_0=\in_0\in t/s_0$$

where $\in_0$ is vacuum dielectric coefficient.

The ratio of the capacitor C of this capacitor to the capacitance $C_0$ is given as follows:

$$C/C_0=1/[k(\in-1)+1]$$

where k is $s/s_0$, i.e., the ratio of the volume of a cavity to the space $s_0$).

Figure 16:
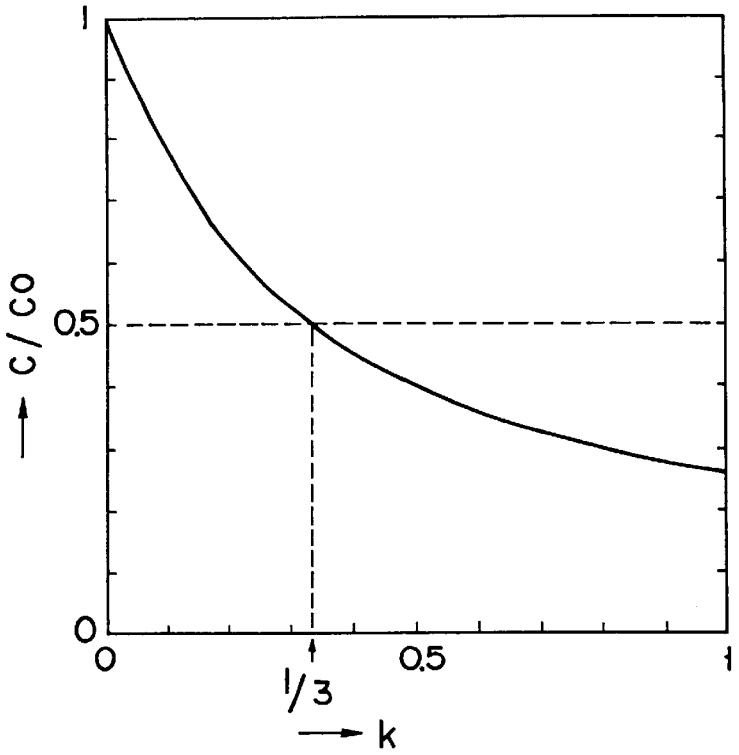

FIG. 16 represents how the ratio $C/C_0$ depends on the ratio K when the insulating members 20 are made of $SiO_2$ whose specific dielectric coefficient is about 4. Assuming k is 1/3 or less, the capacitance C will be about 1/2 $C_0$ or less. No matter whether the gap 70 between the insulation members 20 is filled with gas or maintained virtually vacuum, this gap will be desirable about 1 or more of the gap so.

The planar coil 40 (FIG. 12A) is incorporated in a planar inductor. This coil 40 has but an insufficient inductance. Hence, it is desirable that a magnetic layer be arranged as close as possible to the planar coil 40 so that the magnetic layer may serve as magnetic core. In order to reduce leakage flux to a minimum, the coil 40 should better be interposed between two magnetic layers, as is shown in FIG. 17.

Figure 17:
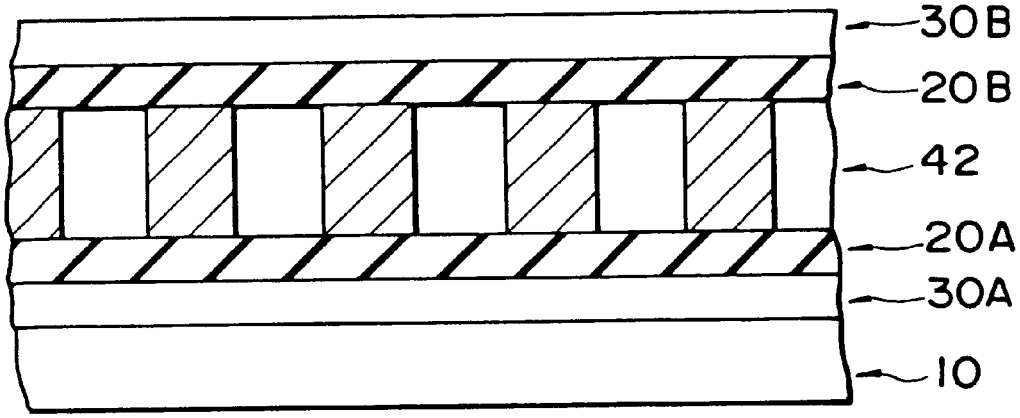

As is shown in FIG. 17, this planar inductor comprises an insulative substrate 10 made of, for example, silicon, a magnetic layer 30A formed on the substrate 10, an insulation layer 20A formed on the magnetic layer 30A, a planar coil 40 mounted on the insulation layer 20A, an insulation layer 20B covering the top of the coil 40, and a magnetic layer 30B. The magnetic layers 30A and 30B function as magnetic shields as well, reducing leakage flux to almost nil. Since virtually no magnetic fluxes leak from the planar inductor, other electronic elements can be arranged very close to the planer inductor. The planer inductor of the type shown in FIG. 17 therefore contributes to the miniaturization of electronic devices.

For some specific use, the planer inductor shown in FIG. 17 can be modified by removing one or both of the magnetic layers 20A and 20B which serve as cores.

Figure 18:
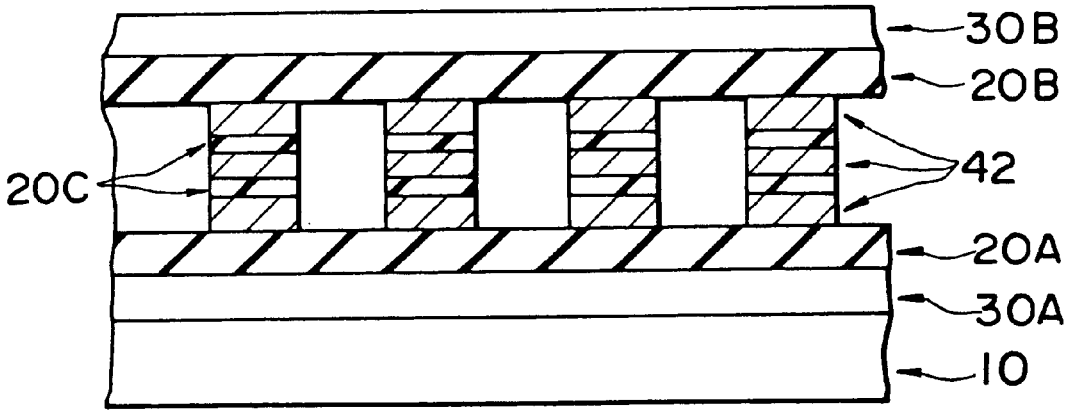
Figure 19A:
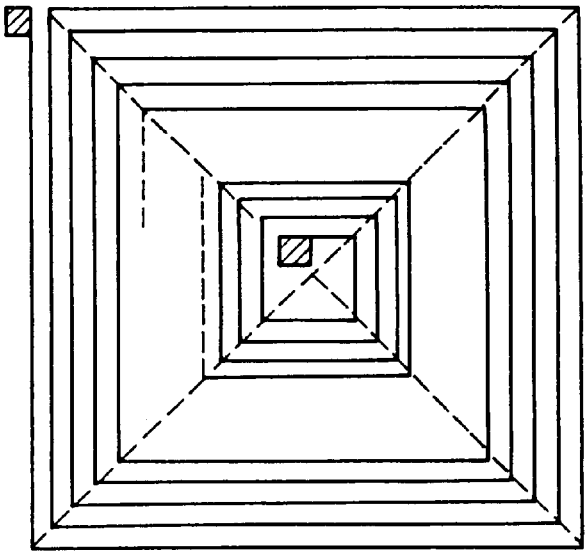
FIGS. 19A and 19B are plan views showing two modifications of the planar coil used in the magnetic elements shown in FIGS. 17 and 18.
Figure 19B:
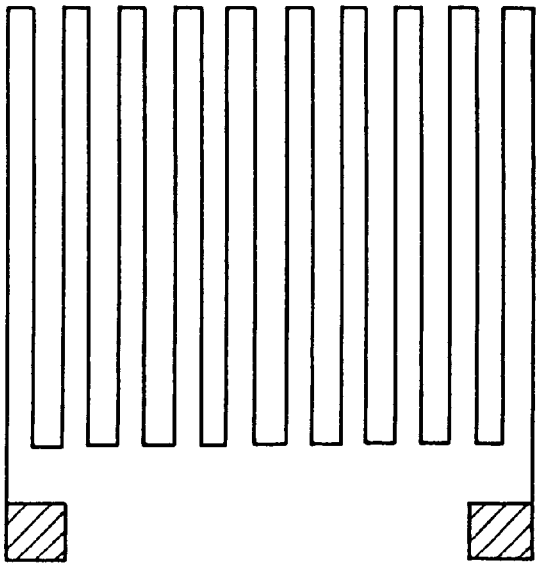

FIG. 18 shows a modification of the planar inductor illustrated in FIG. 17. This inductor is characterized in two respects. First, the coil 40 consists of three units 42 placed one upon another. Second, two additional insulation layers 20C are used, each interposed between the adjacent two coil units 42. Obviously, the planer coil 40 has more turns than the coil 40 used incorporated in the planer inductor of FIG. 17. Hence, the inductor of FIG. 18 can have a higher inductance than the planar inductor shown in FIG. 17.

Planer coils of various shapes can be incorporated into the planer magnetic elements according to the present invention. One of them is the spiral planar coil illustrated in FIG. 19A. Another of them is the meandering planar coil shown in FIG. 19B. The spiral coil is more recommendable for use in planar magnetic elements which need to have high inductance.

Figure 20:
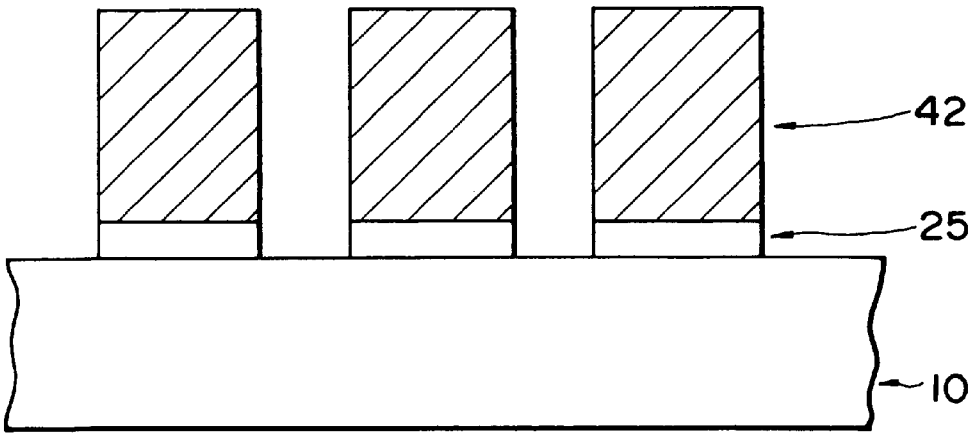

Generally, coil conductors 42 for use in planer magnetic elements have a height far greater than the conductors used in semiconductor devices. Thus, some measures must be taken to secure a coil conductor 42 firmly to a substrate. A bonding layer can be used to secure the conductor 42 to the substrate, as is shown in FIG. 20. As is shown in FIG. 20, a bonding layer 25, such as a Cr layer, of the same pattern as a oil conductor 42 is formed on a substrate 10, and the conductor 42 is formed on the bonding layer 25. This method can be applied also to the planar elements according to the first, third, fourth and fifth aspects of the invention.

Needless to say, the coil conductor 42 must be designed in accordance with the use of the planar magnetic element in which it is to be incorporated. Hence, the turn pitch, the aspect ratio h/d, and other features of the conductor 42 must be determined in accordance with the purpose for which the planer magnetic element will be used. To help reduce the size of the element, it is required that the gap b between any adjacent two turns be less than the width d of the conductor 42. There is no particular limitation to the gap b, but a gap b of 10 $\mu$m or less is recommendable, for the elements according to not only the second aspect but also other aspects of the present invention.

The description of the second aspect of this invention has been limited to planar inductors each having one planar coil. Nevertheless, the second aspect of the invention is not limited to planer inductors having one coil only. Microtransformers, each having two planar coils, also fall within the second aspect of the present invention.

Figure 21:
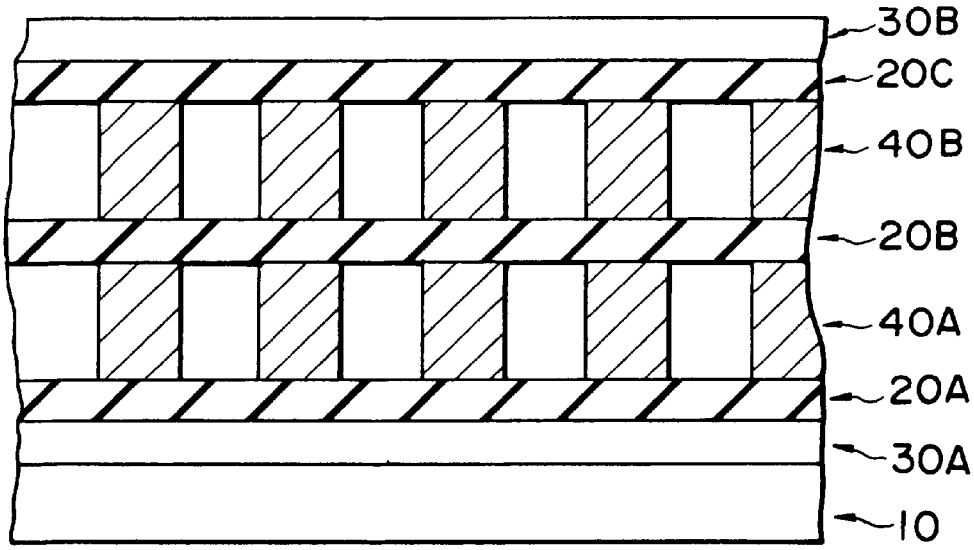

Such a microtransformer is illustrated in FIG. 21. This microtransformer comprises a substrate 10, three insulation layers 20A, 20B and 20C, two magnetic layers 30A and 30B, and two planar coils 40A and 40B. The substrate 10 is made of silicon or the like. The magnetic layer 30A is formed on the substrate 10, and the insulation layer 20A is formed on the layer 30A, The planar coil 40A, which function as primary coil, is mounted on the layer 20A. The insulation layer 20B covers the coil 40A. The planar coil 40B, which functions as secondary coil, is mounted on the insulation layer 20B. The insulation layer 20C covers the coil 40B. The magnetic layer 30B is formed on the insulation layer 20C. The magnetic layers 30A and 30B sandwich the unit comprising of the primary and secondary coils.

Figure 22A:
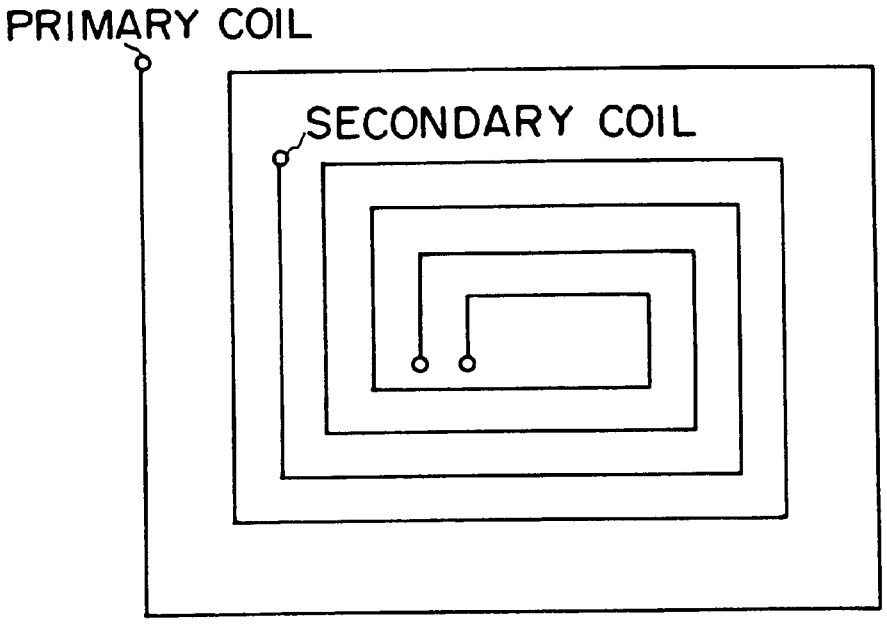
Figure 22B:
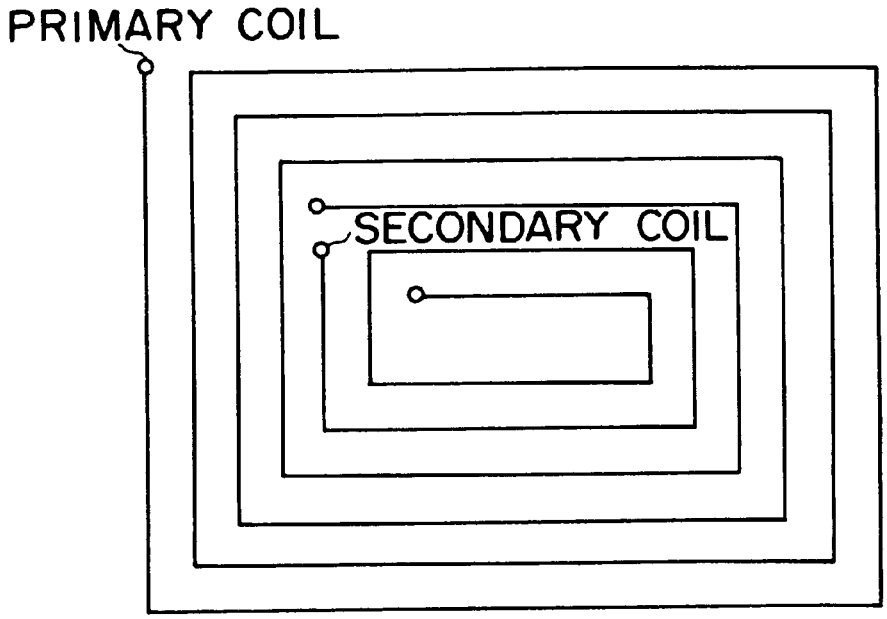

The primary coil 40A and the secondary coil 40B can be located in the same plane, as is illustrated in FIG. 22A. The secondary coil 40B extends between the turns of the primary coil 40B. Alternatively, the secondary coil 40B can be placed in the area surrounded by the primary coil 40A, as is illustrated in FIG. 22A.

The third aspect of the present invention will now be described, with reference to FIGS. 23 to 28.

Figure 23:
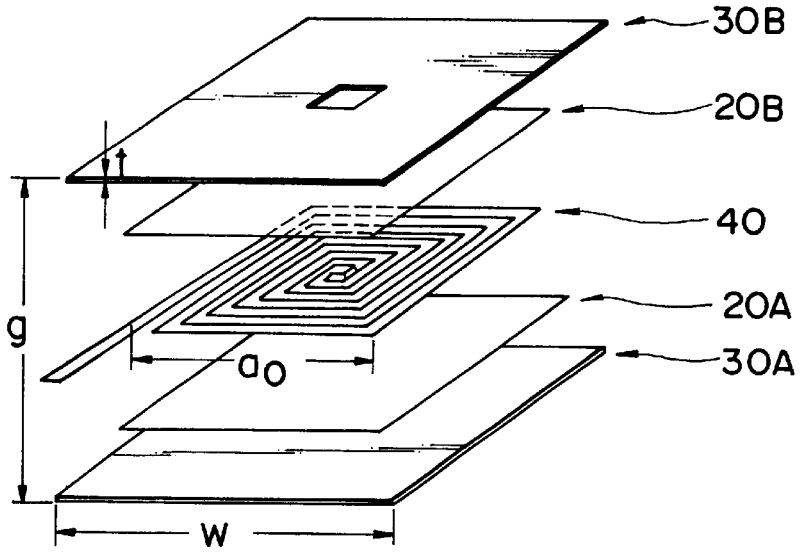

FIG. 23 is an exploded view showing a planar inductor according to the third aspect. As is shown in FIG. 23, this inductor comprises two insulation layers 20A and 20B, two magnetic layers 30A and 30B, and a spiral planar coil 40. The coil 40 is sandwiched between the insulation layers 20A and 20B. The unit consisting of the layers 20A and 20B and the coil 40 is sandwiched between the magnetic layers 30A and 30B. The spiral planar coil 40 is square, each side having a length $a_0$. The magnetic layers 30A and 30B are also square, each side having a length w. They have the same thickness t. They are spaced apart from each other by a distance g.

Figure 24:
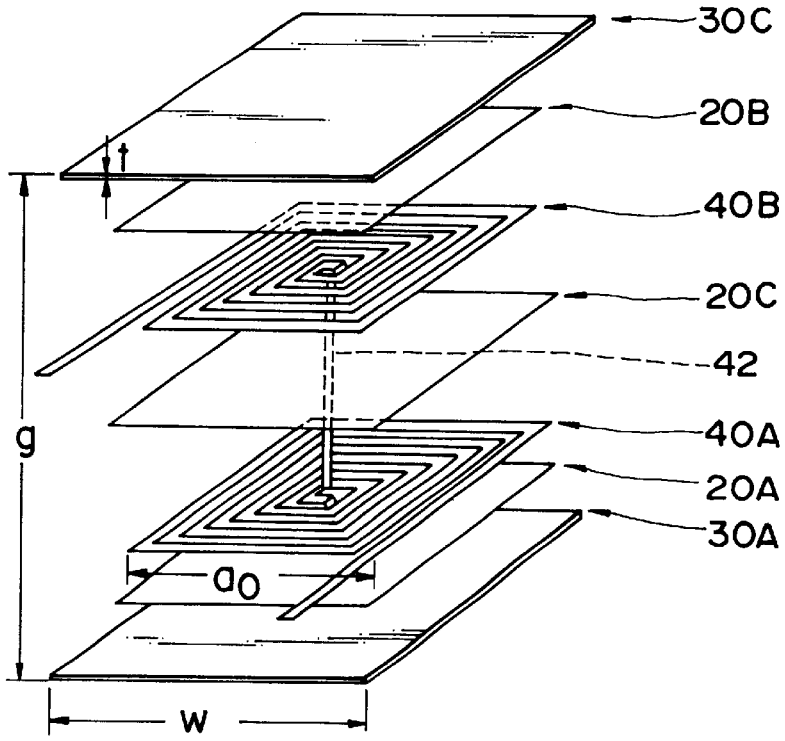

FIG. 24 is also an exploded view illustrating another type of a planar inductor according to the third aspect of the invention. This planar inductor comprises three insulation layers 20A, 20B and 20C, two magnetic layers 30A and 30B, two spiral planar coils 40A and 40B, and a through-hole conductor 42. The insulation layer 20C is interposed between the coils 40A and 40B. The unit consisting of the layer 20C and the coils 40A and 40B is sandwiched between the insulation layers 20A and 20B. The unit consisting of the layers 20A, 20B and 20C and the coils 40A and 40B is sandwiched between the magnetic layers 30A and 30B. The through-hole conductor 42 extends through the insulation layer 20C and electrically connects the spiral planar coils 40A and 40B. The spiral planar coils 40A and 40B are square, each side having a length $a_0$. The magnetic layers 30A and 30B are also square, each side having a length w, and have the same thickness t. The layers 30A and 30B are spaced apart from each other by a distance g.

Both planar inductors shown in FIGS. 23 and 24, respectively, can be advantageous in the following two respects when appropriate values are selected for $a_0$, w, t, and g:

(1) They have an effective magnetic shield, and the leakage flux is therefore very small.

(2) They have a sufficiently high inductance.

Either planar inductor according to the third aspect can be formed on a glass substrate, by means of thin-film process described above. Alternatively, it can be formed on any other insulative substrate (e.g., a substrate made of a high-molecular material such as polyimide).

The magnetic fluxes generated by the spiral planar coil or coils must be prevented from leaking from the planar inductors shown in FIGS. 23 and 24. Otherwise, the leakage fluxes of either inductor adversely influence the other electronic components arranged very close to the inductor and formed on the same chip, thus forming a hybrid integrated circuit. According to the third aspect of the invention, the ratio between the width w of either magnetic layer and the width $a_0$ of the square planar coil or coils should is set at an optimum value so that the magnetic fluxes generated by the coil or coils are prevented from leaking.

Figure 25A:
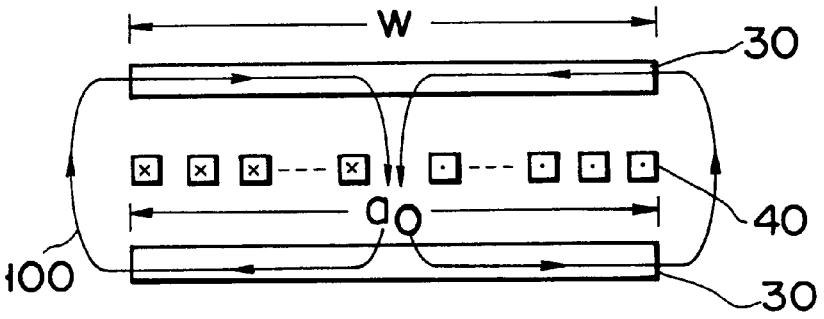
FIGS. 25A to 25C are sectional views of the inductor shown in FIG. 23, explaining how magnetic fluxes leak from the inductor.
Figure 25B:
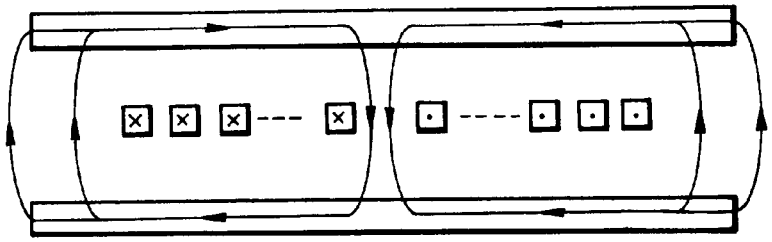
Figure 25C:
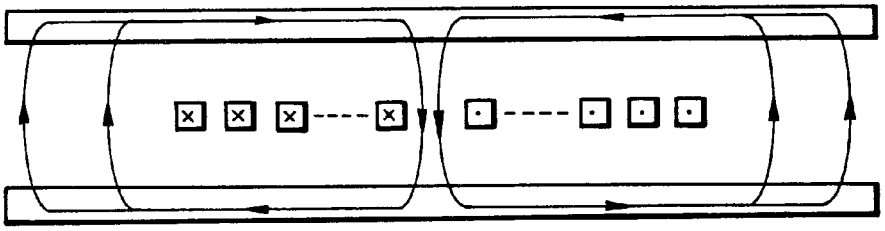

FIGS. 25A to 25C are sectional views of three planar inductors of the type shown in FIG. 23 which have different values w for the magnetic layers, and explain how magnetic fluxes 100 leak from these planar inductors. In the inductor shown in FIG. 25A, the width w of either magnetic layer is substantially equal to the width $a_0$ of the spiral coil 40. In the inductor shown in FIG. 25B, the width w is slightly greater than the width $a_0$ of the coil 40. In the inductor of FIG. 25C, the width w is much greater than the width $a_0$ of the spiral coil 40. As is evident from FIGS. 25A, 25B, and 25C, the broader either magnetic layer, the less the leakage fluxes.

Figure 26:
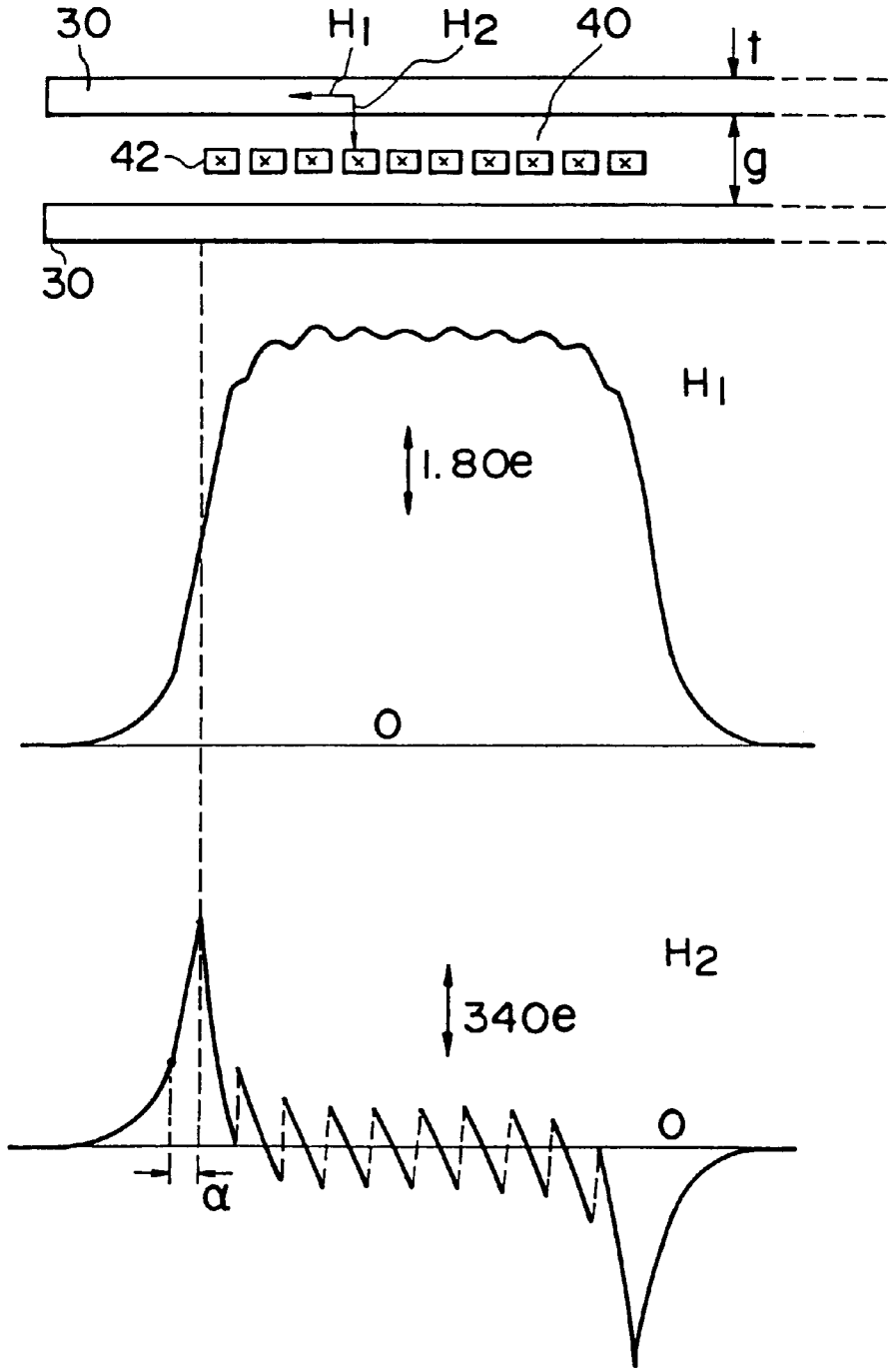

FIG. 26 is a diagram explaining the distribution of magnetic fluxes at the edges of the spiral planar coil 40 used in the inductor shown in FIG. 23. As can be understood from FIG. 26, the magnetic field is about 0.37 time less at a point at distance $\alpha$ from any edge of the coil 40, than at the edge of the coil 40. The distance a is: $\alpha=[\mu_s gt/2]^{1/2}$, where $\mu_s$ is the relative permeability of the magnetic layers 30, t is the thickness of thereof, and g is the distance therebetween. Thus, in the planar inductor shown in FIG. 23, the width w of either magnetic layer is $2\alpha$ or more, thereby reducing the leakage fluxes drastically. The coil conductor 42 forming the coil 40 has a width d of 70 $\mu$m and a inter-turn gap b of 10 $\mu$m, the distance g between the magnetic layers is 5 $\mu$m, and the coil current is 0.1 A.

Figure 27:
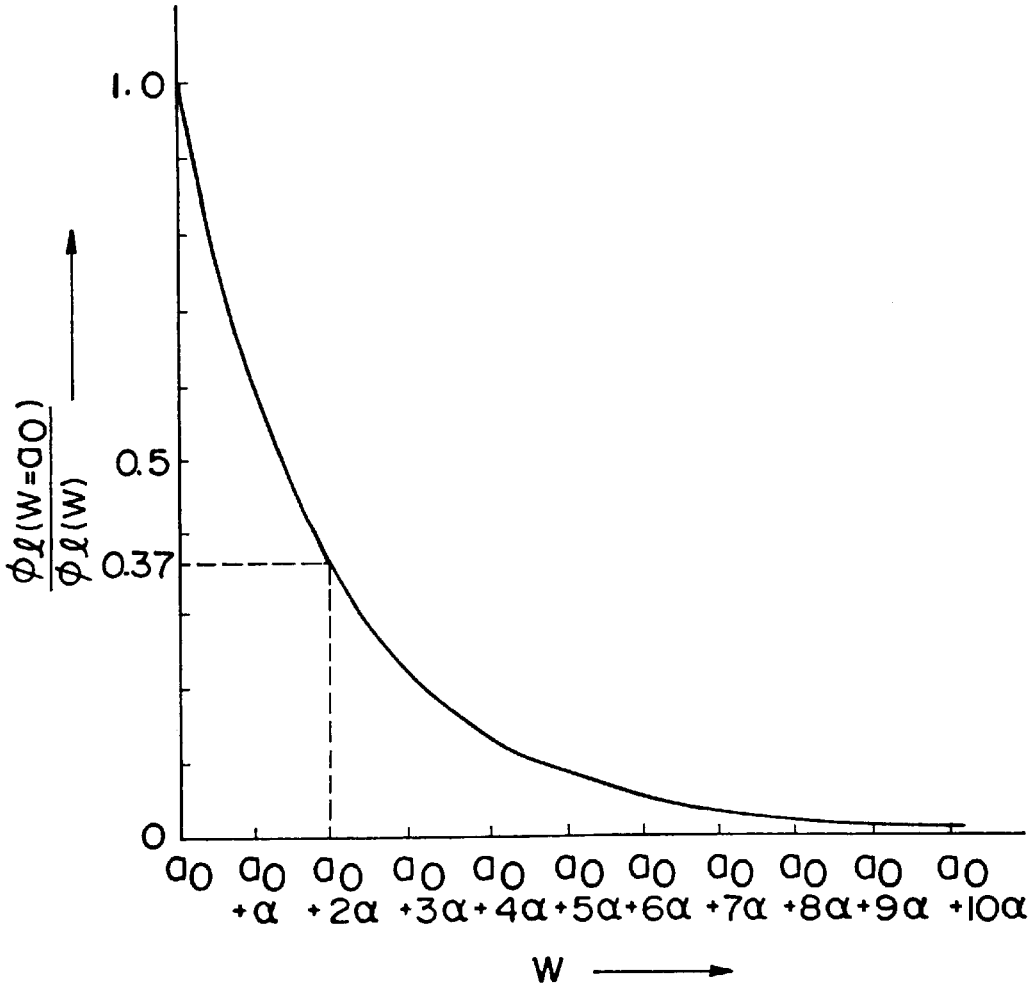

FIG. 27 represents the relationship between the width w of the magnetic members used in the inductor of FIG. 23 and the leakage of magnetic fluxes from the edge of either magnetic layer. As is evident from FIG. 27, the greater the width w, the less the flux leakage. It is desirable that the width w be $a_0+10\alpha$ or more. When the width w is $a_0+10\alpha$, almost no magnetic fluxes leak from the planar inductor.

Figure 28:
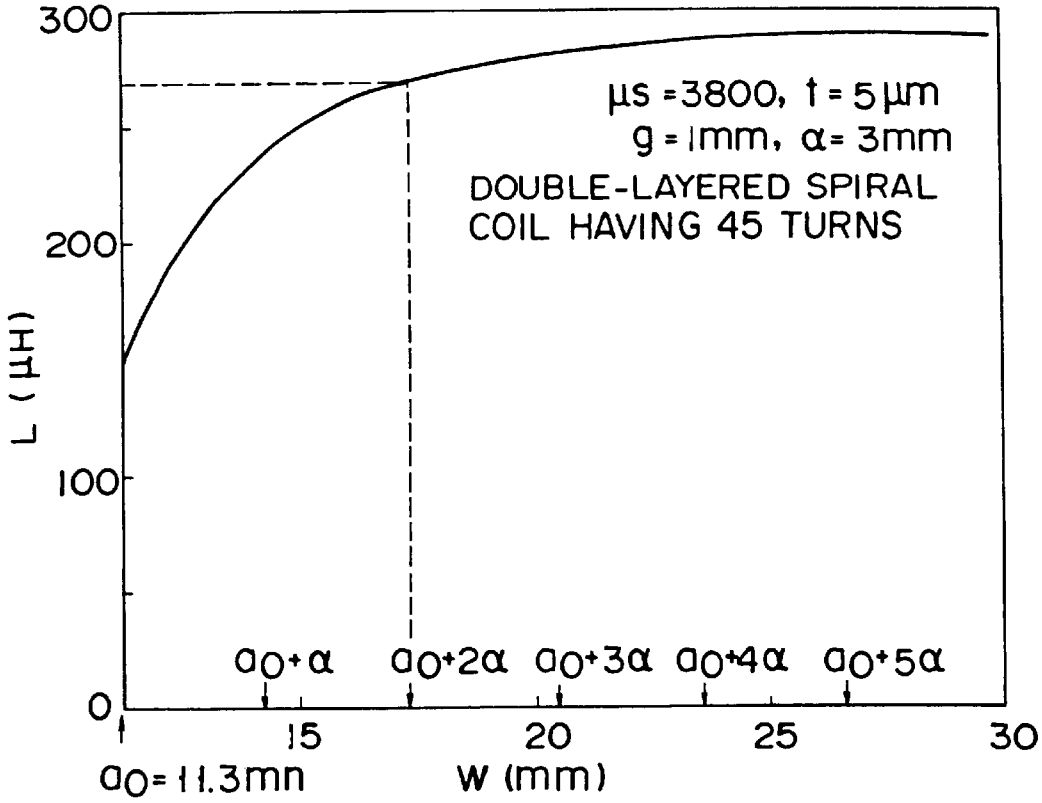

It is demanded that the planar inductor have as high an inductance as possible. The planar inductor according to the third aspect of the invention can have a high inductance only if the magnetic layers have a width w which is greater than the width $a_0$ of the spiral planar coil by $2\alpha$ or more. FIG. 28 represents the relationship between the width w and the inductance of the inductor shown in FIG. 23. As can be understood from FIG. 28, the inductance increases 1.8 times or more if the width w is increased from $a_0$ to $a_0+2\alpha$ or more.

Planar magnetic elements according to the fourth aspect of the invention will now be described, with reference to FIGS. 29 to 48. Although the elements which will be described are planar inductors only, the planar magnetic elements according to the fourth aspect include planar transformers, too. Any planar transformer that belongs to the fourth aspect is essentially identical in structure to the planar inductor, except that the primary planar coil and the secondary planar coil are arranged one above the other.

Figure 29:
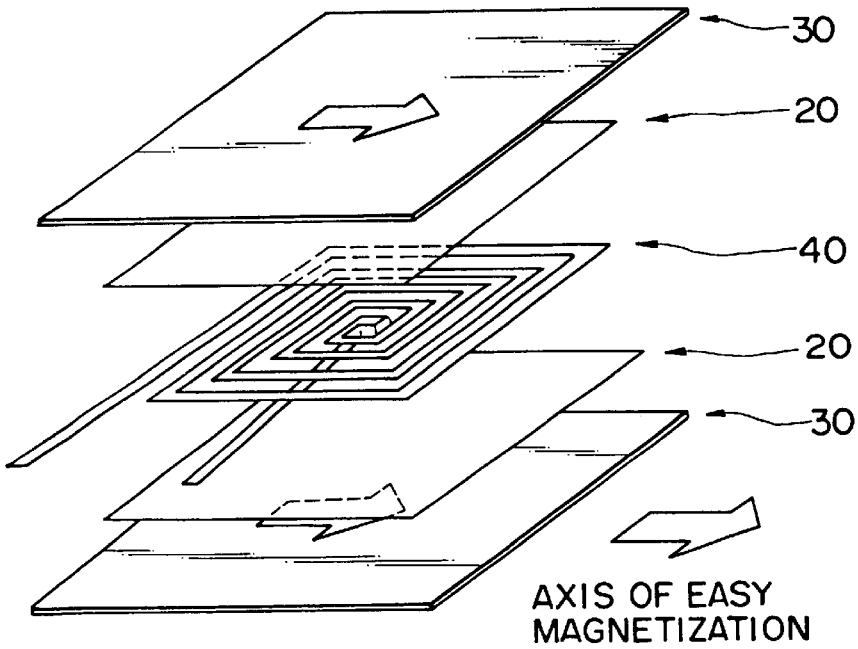

FIG. 29 is an exploded view showing a first planar inductor according to the fourth aspect of the invention. As is shown in FIG. 29, this inductor comprises two magnetic layers 30, two insulation layers 20, and a spiral planar coil 40. The coil 40 is sandwiched between the insulation layers 20. The unit formed of the layers 20 and the coil 40 is sandwiched between the magnetic layers 30. The magnetic layers 30 exhibit a uniaxial magnetic anisotropy. They have an axis of easy magnetization, which is indicated by an arrow.

When a current flows through the spiral planar coil 40, the coil 40 generates a magnetic field. This magnetic field which extends through either magnetic layer 30 in four directions indicated by arrows in FIG. 30. In the regions A shown in FIG. 30, the magnetic field extends in lines parallel to the axis of easy magnetization of the magnetic layer 30. In the regions B, the magnetic field extends in lines which intersect the axis of easy magnetization, or which are parallel to the hard axis of magnetization of the magnetic layer.

Figure 30:
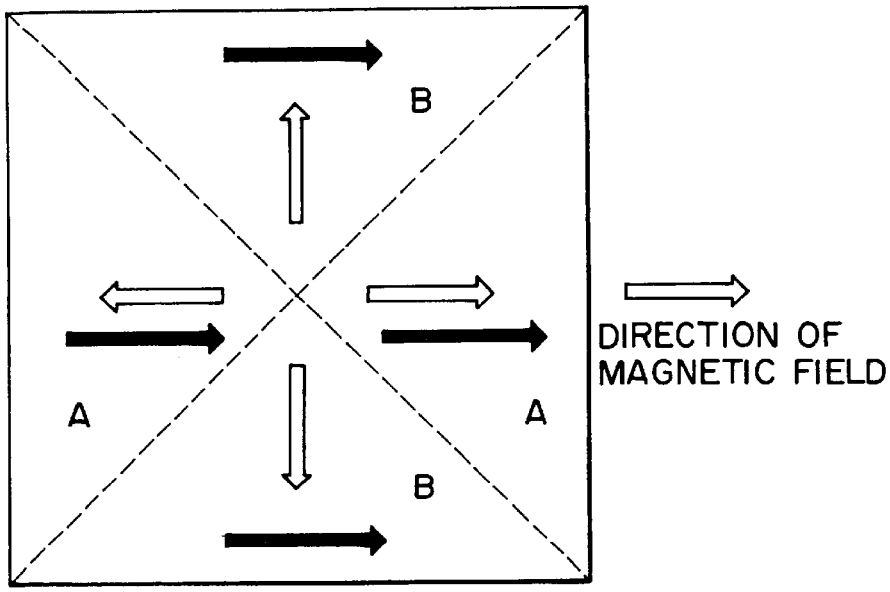
Figure 31:
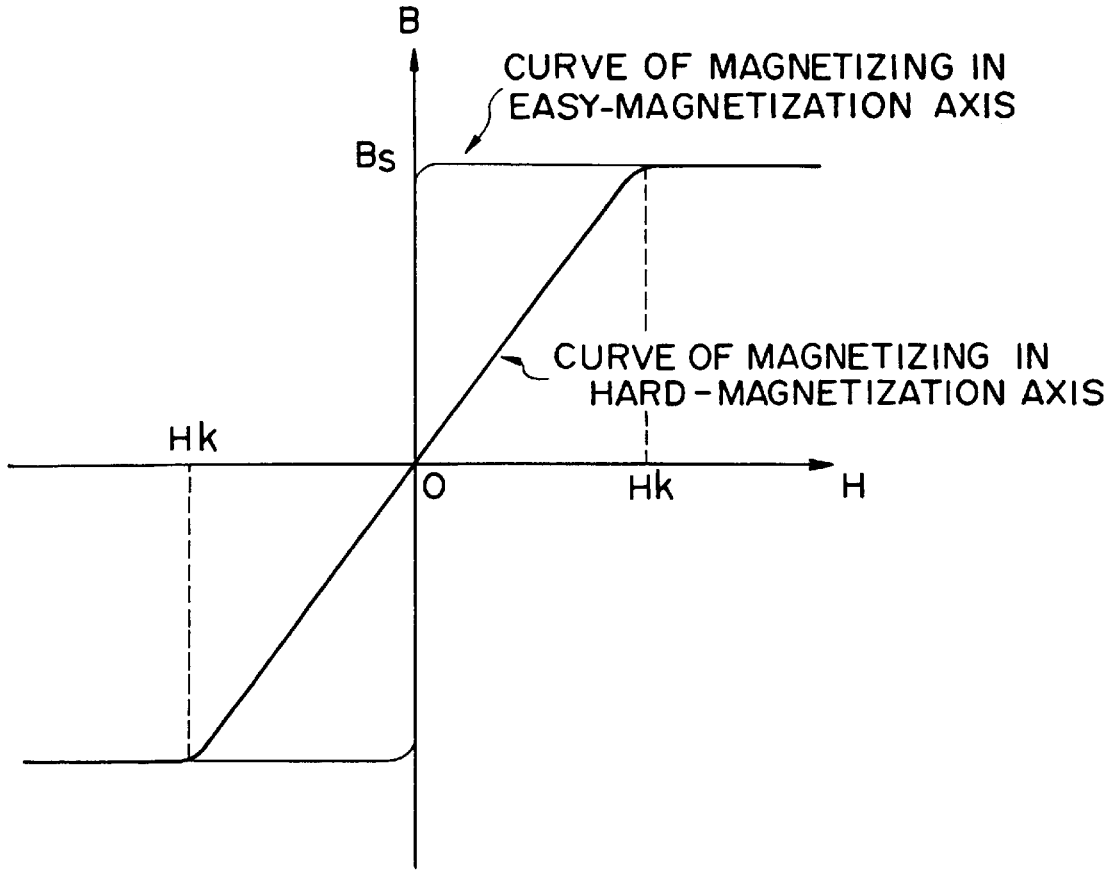
Figure 32A:
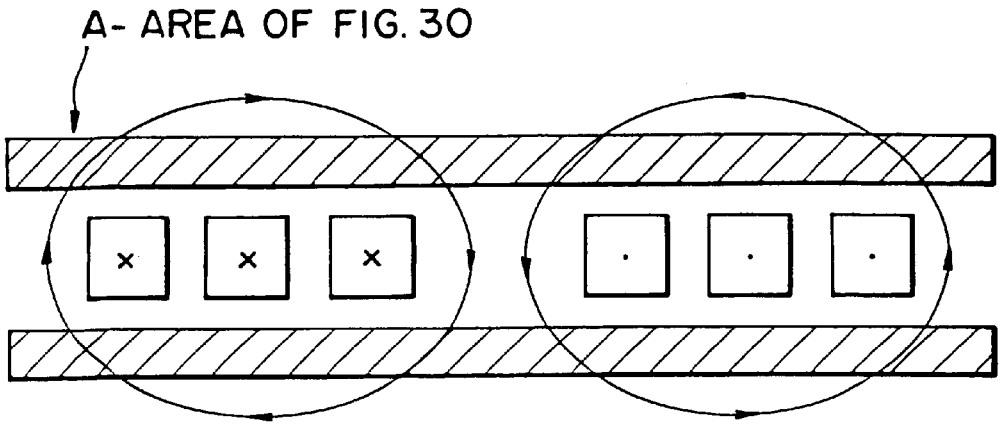
FIG. 32A is a diagram showing the distribution of the magnetic fluxes in those regions of the magnetic members used in the inductor (FIG. 29), where the magnetic field extends parallel to the axis of easy magnetization.
Figure 32B:
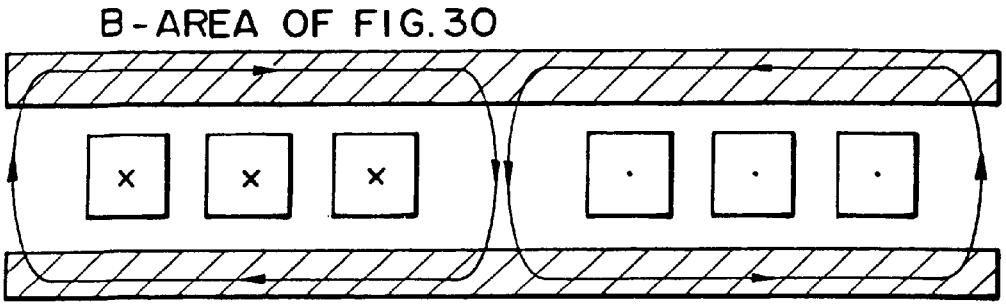
FIG. 32B is a diagram showing the distribution of the magnetic fluxes in those regions of the magnetic members used in the inductor (FIG. 29), where the magnetic field extends at right angles to the axis of easy magnetization.

FIG. 31 shows a B-H curve of magnetization in the axis of easy magnetization of either magnetic layer 30 incorporated in the inductor shown in FIG. 29, and also a B-H curve of magnetization in the hard axis of magnetization of the magnetic layer. As can be seen from FIG. 31, the magnetic layer exhibits a very high permeability in the axis of easy magnetization, and hence can easily be saturated in the axis of easy magnetization and can hardly be saturated in the hard axis of magnetization. It follows that the regions A (FIG. 30) can easily be saturated magnetically, whereas the regions B (FIG. 30) can hardly be saturated magnetically. When the magnetic field generated by the coil 40 is intense, the regions A of either magnetic layer 30 are saturated, and some magnetic fluxes leak from the layer 30, as is illustrated in FIG. 32A. The remaining magnetic fluxes extend through the regions B (FIG. 30), as is shown in FIG. 32B. Obviously, the inductance of this planar inductor depends on the density of magnetic fluxes which extend along the hard axis of magnetization of either magnetic layer 30.

To solve the problem of saturation of the magnetic layers, the planar inductors according to the fourth aspect of the invention have one of the following three structures:

First Structure

Two groups of magnetic layers are located below and above a spiral planar coil, respectively. The magnetic layers of either group are arranged, one above another, such that their axes of easy magnetization intersect.

Second Structure

Two square magnetic layers are located below and above a spiral planar coil, respectively. Each of the magnetic layers consists of four triangular pieces, each having an axis of easy magnetization which extends parallel to the base.

Third Structure

Two magnetic layers are located below and above a spiral planar coil, respectively. Either magnetic layer has a spiral groove which extends, exactly along the spiral conductor of the coil.

Figure 33:
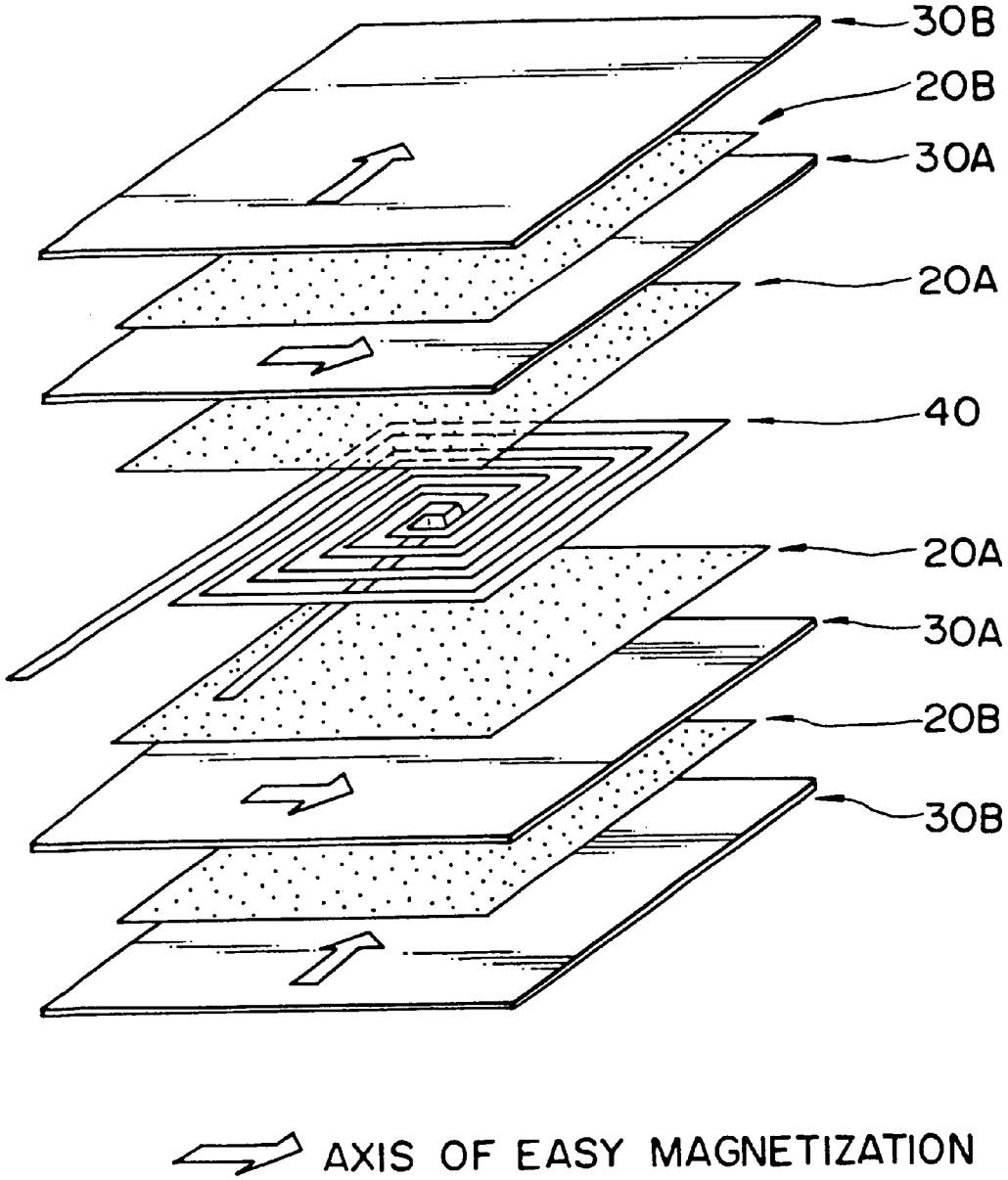

FIG. 33 is an exploded view illustrating a planar inductor having the first structure defined above. As is evident from FIG. 33, this inductor comprises two laminates and a spiral planar coil 40 sandwiched between the laminates. The laminates are identical in structure.

Each of the laminates comprises two insulation layers 20A and 20B and two magnetic layers 30A and 30B. The insulation layer 20A is mounted on the coil 40, the magnetic layer 30A is mounted on the layer 20A, the insulation layer 20B is formed on the magnetic layer 30A, and the magnetic layer 30B is formed on the insulation layer 20B. The magnetic layers 30A and 30B are arranged such that their axes (arrows) of easy magnetization intersect at right angles.

In either laminate, those regions of the magnetic layer 30A located close to the coil 40, which corresponds to the region A shown in FIG. 30, are easily saturated magnetically, and some magnetic fluxes leak from these saturated regions. These leakage fluxes extend through those regions of the magnetic layer 30B, which correspond to the regions B shown in FIG. 30. As a result, the magnetic fluxes extend along the hard axis of magnetization in both magnetic layers 30A and 30B, and magnetic saturation can hardly take place in either magnetic layer.

Figure 34:
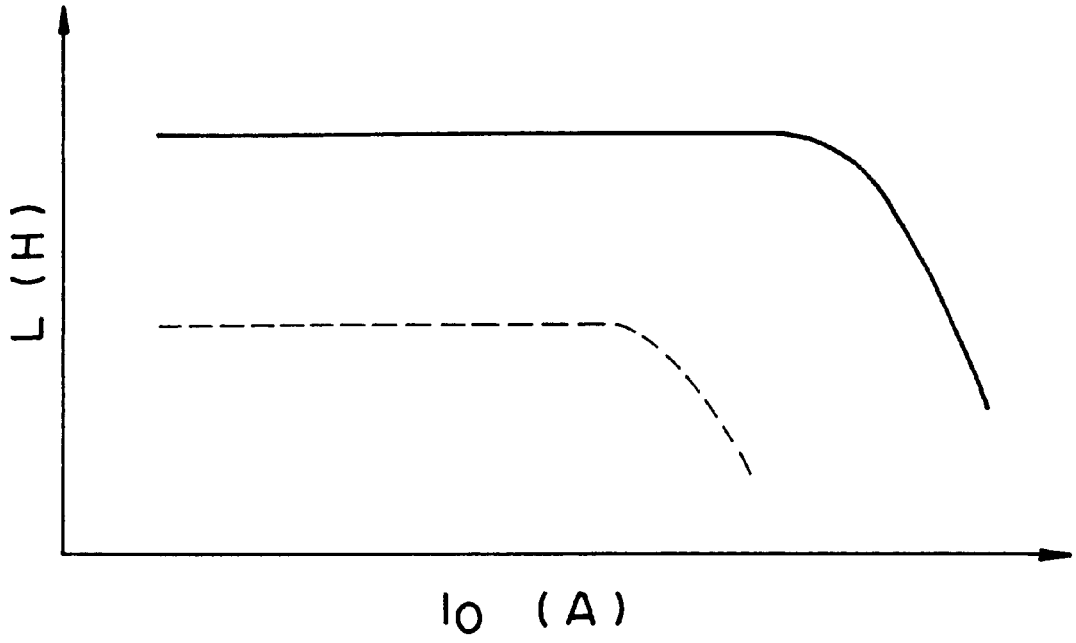

FIG. 34 represents the superimposed DC current characteristic of the planar inductor shown in FIG. 33. More precisely, the solid-line curve shows the superimposed DC current characteristic of the inductor, whereas the broken-line curve indicates the superimposed DC current characteristic of the planar inductor shown in FIG. 29. As is evident from FIG. 34, the inductance of the inductor shown in FIG. 34, which has two sets of magnetic layers, is twice has high as that of the inductor shown in FIG. 29 which has only one set of magnetic layers. In addition, as FIG. 34 clearly shows, the DC current, at which the inductance of the inductor shown in FIG. 33 starts decreasing, is greater than the DC current at which the inductance of the inductor shown in FIG. 29 begins to decrease.

Figure 35:
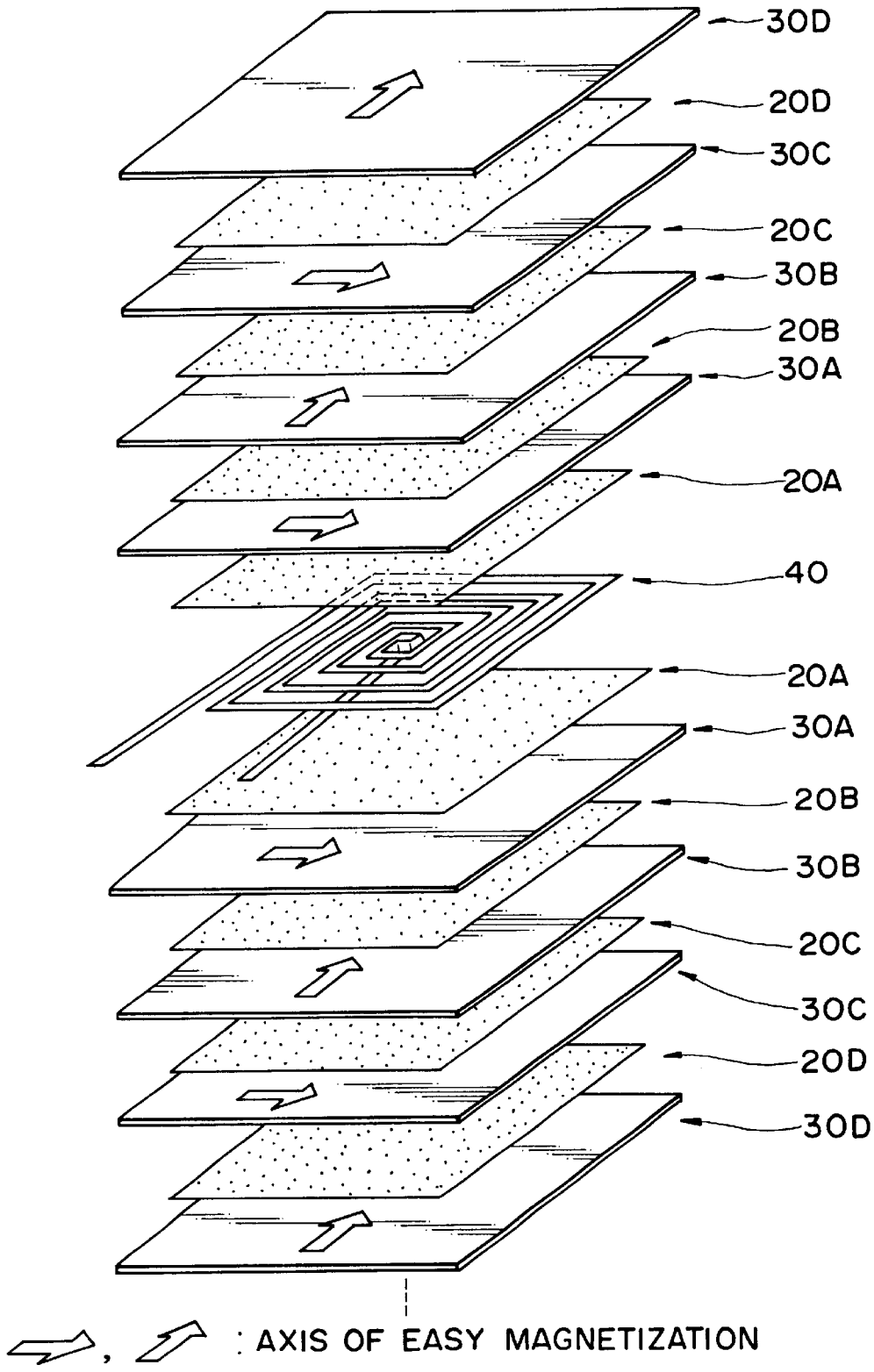

FIG. 35 is an exploded view showing an modification of the inductor shown in FIG. 33. This planar inductor is different from the inductor of FIG. 33, in that either laminate comprises four magnetic layers 30A, 30B, 30C and 30D. The four magnetic layers of either laminate are arranged such that the axes of easy magnetization of any adjacent two intersect at right angles.

It will be explained briefly how the planar inductors shown in FIGS. 33 and 35 are manufactured. First, soft magnetic layers made of amorphous alloy, crystalline alloy, or oxide and having a thickness of 3 $\mu$m or more are prepared. Then, these magnetic layers are processed, imparting a uniaxial magnetic anisotropy to them. The magnetic layers are orientated, such that the axes of easy magnetization of any adjacent two intersect with each other at right angles. Insulation layers are interposed among the magnetic layers thus orientated. A planar coil is interposed between the two innermost insulation layers. Finally, the coil, the magnetic layers, and the insulation layers, all located one upon another, are compressed together.

The magnetic layers can be formed by means of thin-film process such as vapor deposition or sputtering. When they are made by the thin-film process, they come to have uniaxial magnetic anisotropy while they are being formed in an electrostatic field or while they are undergoing heat treatment in a magnetic field. The less magnetostriction, the better. Nonetheless, a magnetic layer, if made of material having a relatively large magnetostriction, can have a uniaxial magnetic anisotropy by virtue of the inverse magnetostriction effect, only if the stress distribution of the layer is controlled appropriately.

Figure 36:
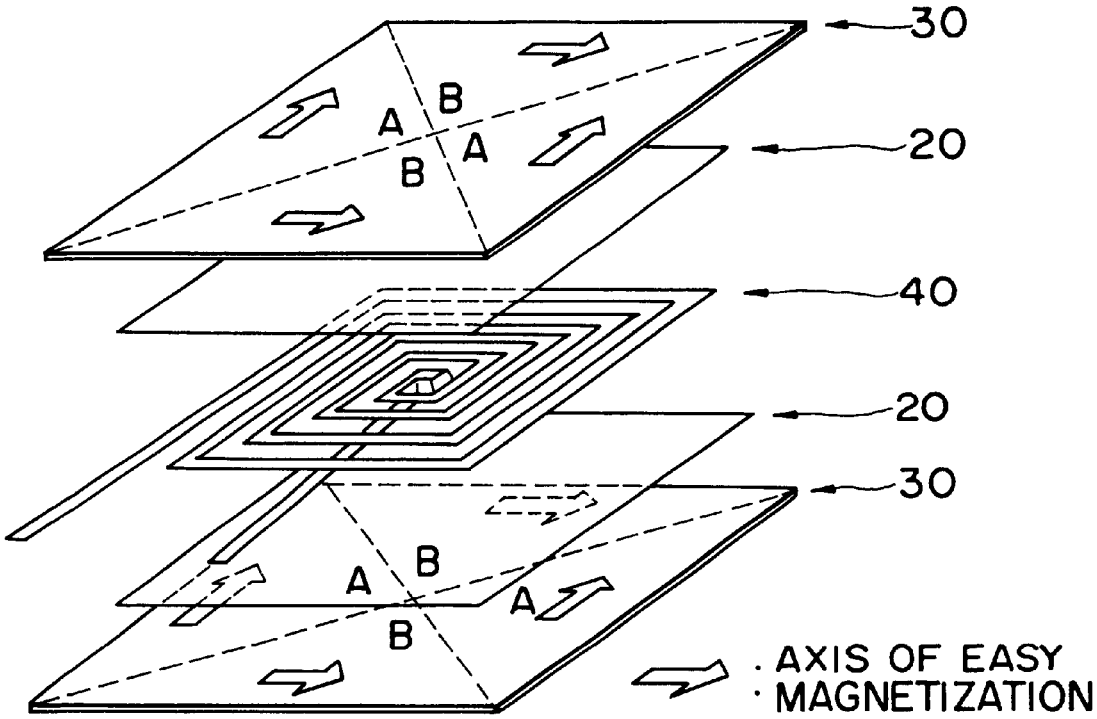

FIG. 36 is an exploded view illustrating a planar inductor having the second structure defined above. As is evident from FIG. 36, this inductor comprises two insulation layers 20, two square magnetic layers 30, a spiral planar coil 40. The coil 40 is sandwiched between the insulation layers 20. The unit formed of the layers 20 and the coil 40 is sandwiched between the magnetic layers 30. Either magnetic layer 30 consists of four triangular pieces, each having an axis of easy magnetization which extends parallel to the base. The axis of easy magnetization of the each triangular piece intersects at right angles with the magnetic fluxes generated by the coil 40. Therefore, the magnetic layers 30 have no regions which are readily saturated magnetically.

Figure 37:
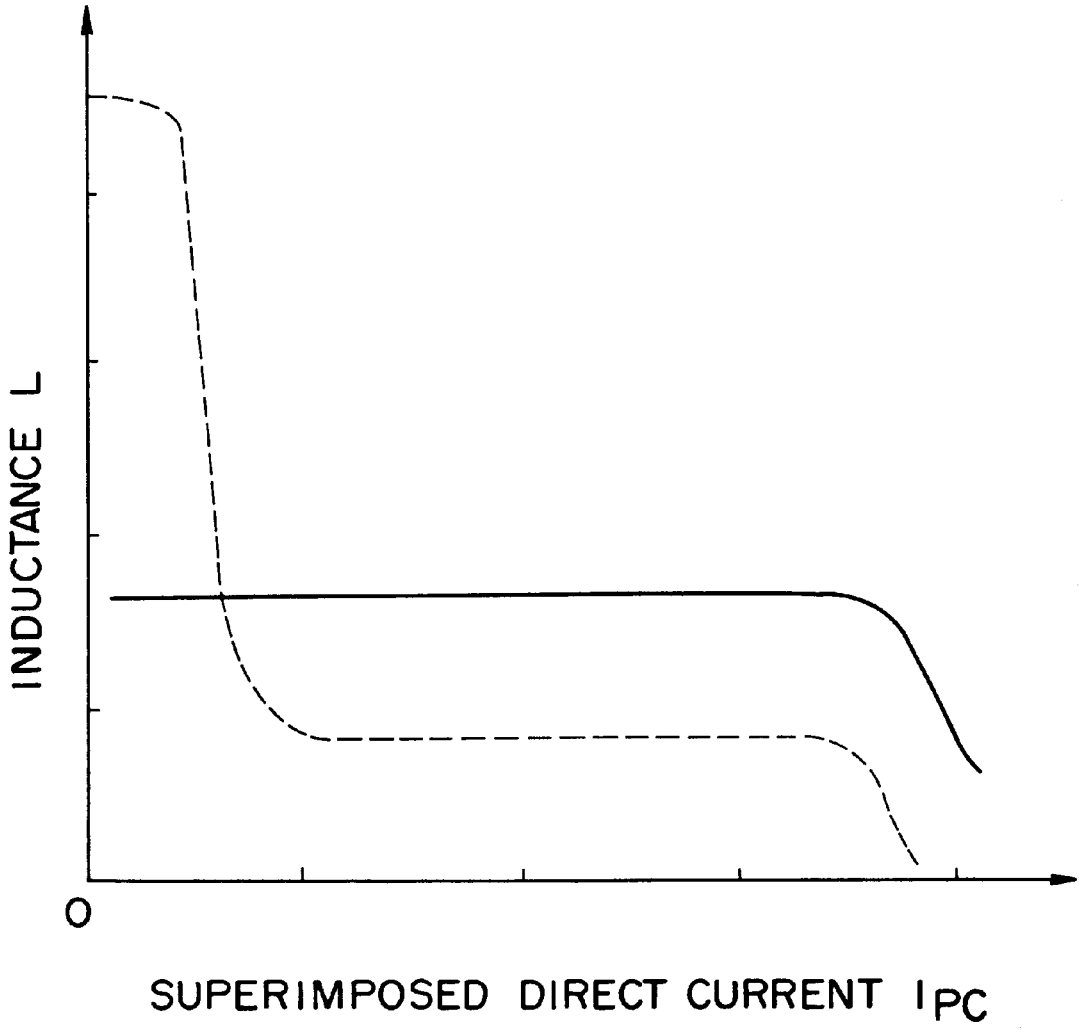

FIG. 37 represents the superimposed DC current characteristic of the inductor shown in FIG. 36. More precisely, the solid-line curve shows the superimposed DC current characteristic of the inductor, whereas the broken-line curve indicates the superimposed DC current characteristic of the planar inductor shown in FIG. 29. As is evident from FIG. 34, the inductance of the inductor of FIG. 29 is very high in the small-current region, but abruptly decreases with the superimposed DC current, and remains almost constant thereafter until the superimposed DC current increase to a specific value. By contrast, the inductance of the inductor shown in FIG. 36, wherein the magnetic layers have no regions that can readily be saturated, is about two times higher than that of the inductor shown in FIG. 29, and remains almost constant, irrespective of the superimposed DC current, until the superimposed DC current increases to a specific value.

It will be explained how the planar inductor shown in FIG. 36 is manufactured. First, soft magnetic layers made of amorphous alloy, crystalline alloy, or oxide and having a thickness of 3 $\mu$m or more are prepared. These layers are cut into triangular pieces, each having a base longer than the width of the spiral planer coil 40. The triangular pieces are heat-treated in a magnetic field which extends parallel to the bases of the triangular pieces. As a result, each piece will have an axis of easy magnetization which extends parallel to its base. Four of these triangular pieces, now exhibiting uniaxial magnetic anisotropy, are arranged and connected together, such that their axes of easy magnetization extend parallel to the spiral conductor of the planar coil 40.

Alternatively, the magnetic layers 30 can be formed by means of thin-film process such as vapor deposition or sputtering. When they are formed by the thin-film process, triangular masks are utilized for forming triangular pieces. More specifically, two triangular resist masks are formed on two triangular region B of a square substrate. Then a magnetic layer having a predetermined thickness is formed on the substrate and the resist masks, while a magnetic field extending parallel to the bases of the regions A is being applied. Next, the resist masks are removed from the substrate, and the magnetic layers on these masks are simultaneously lifted off. As a result, two triangular magnetic pieces are formed on the regions A of the substrate, and the triangular regions B of the substrate are exposed. Then, two triangular resist masks are formed on the triangular magnetic pieces (on the regions A). A magnetic layer having the predetermined thickness is formed on the exposed regions B and also on the resist masks, while a magnetic field extending parallel to the regions B is being applied. This done, the masks are removed from the triangular magnetic pieces formed on the regions A, and the resist masks are simultaneously lifted off. Thus, two triangular magnetic pieces are formed on the regions B of the substrate.

Figure 38:
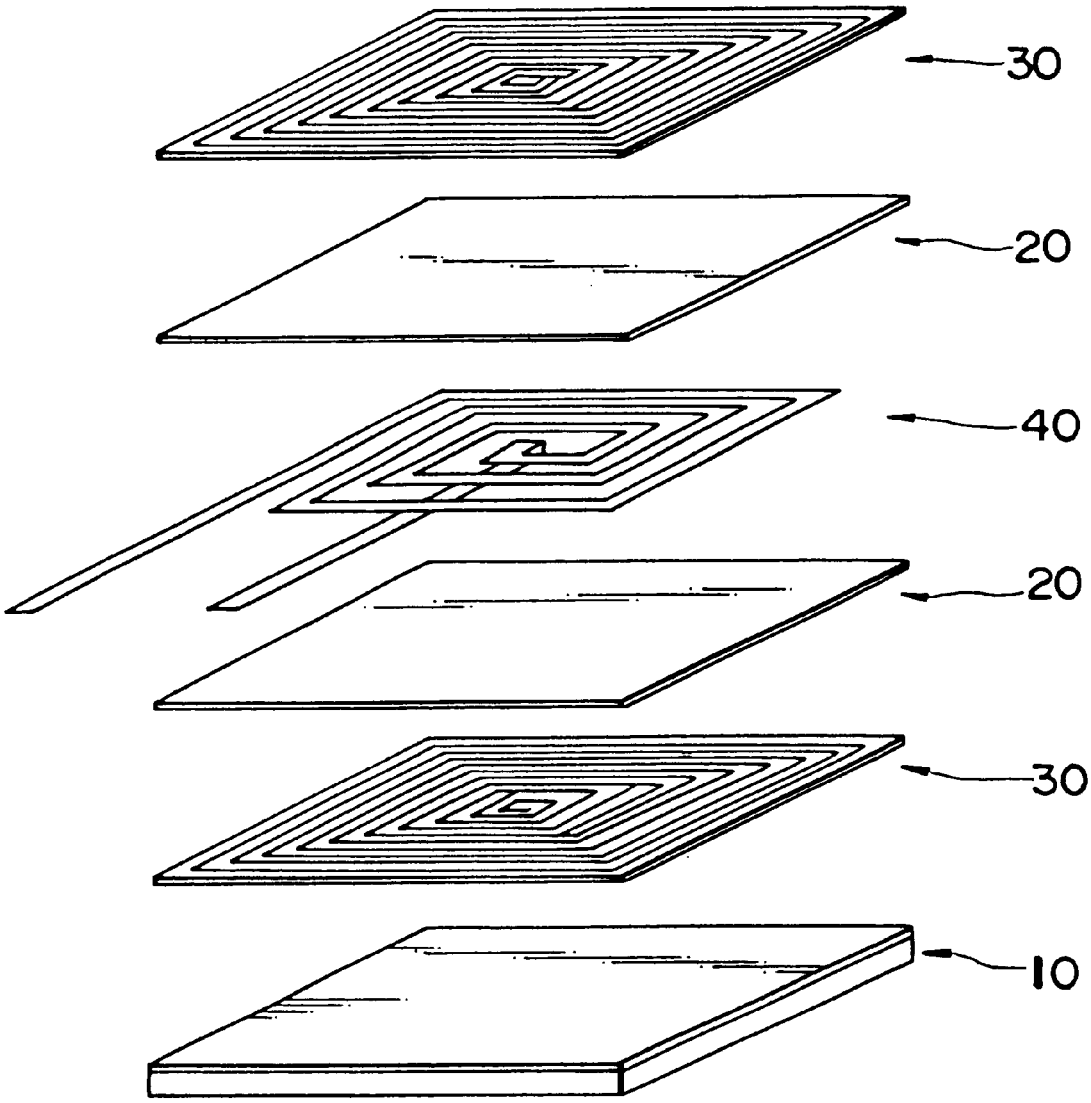

FIG. 38 is an exploded view illustrating a planar inductor having the third structure defined above. As is evident from FIG. 38, this inductor comprises a substrate 10, two insulation layers 20, two square magnetic layers 30, and a spiral planar coil 40. The coil 40 is sandwiched between the insulation layers 20. The unit formed of the layers 20 and the coil 40 is sandwiched between the magnetic layers 30, the lower of which is formed on the substrate 10. Either magnetic layer 30 has a spiral groove which extends, exactly along the spiral conductor of the coil 40. Because of this spiral groove, the four triangular regions of the magnetic layer 30 have axes of easy magnetization, which intersect at right angles to the magnetic fluxes generated by the spiral planar coil 40. Hence, either magnetic layer 30 has no regions which can readily be saturated magnetically.

The magnetic layers shown in FIG. 38, which have a spiral groove, can be formed in two methods. In the first method, a spiral groove is formed in the surface of a base plate, either by machining or by photolithography, and the a thin magnetic film is deposited on the grooved surface of the base plate. In the second method, a relatively thick magnetic layer is formed, and then a spiral groove is formed in the surface of the magnetic layer, either by machining or by photolithography.

It will be briefly explained why a magnetic layer comes to exhibit magnetic anisotropy when a spiral groove is cut in its surface. A ferromagnetic layer has a plurality of magnetic domain. A very thin ferromagnetic layer has no magnetic domain wall, but has magnetic domain arranged in the direction of thickness. As is known in the art, the magnetic moments of the magnetic domain are of the same magnitude and the same direction. When a groove is cut in the surface of the thin ferromagnetic layer, magnetic poles are established, whereby an demagnetizing field or a leakage magnetic field is generated. The magnetic field thus generated acts on the magnetic moments within the ferromagnetic layer, imparting magnetic anisotropy to the ferromagnetic layer. In the same way, thick magnetic layers come to have magnetic anisotropy when a groove is formed in their surfaces.

It is desirable that the spiral groove formed in the surface of either magnetic layer 30 satisfy specific conditions, as will be explained with reference to FIG. 39.

Figure 39:
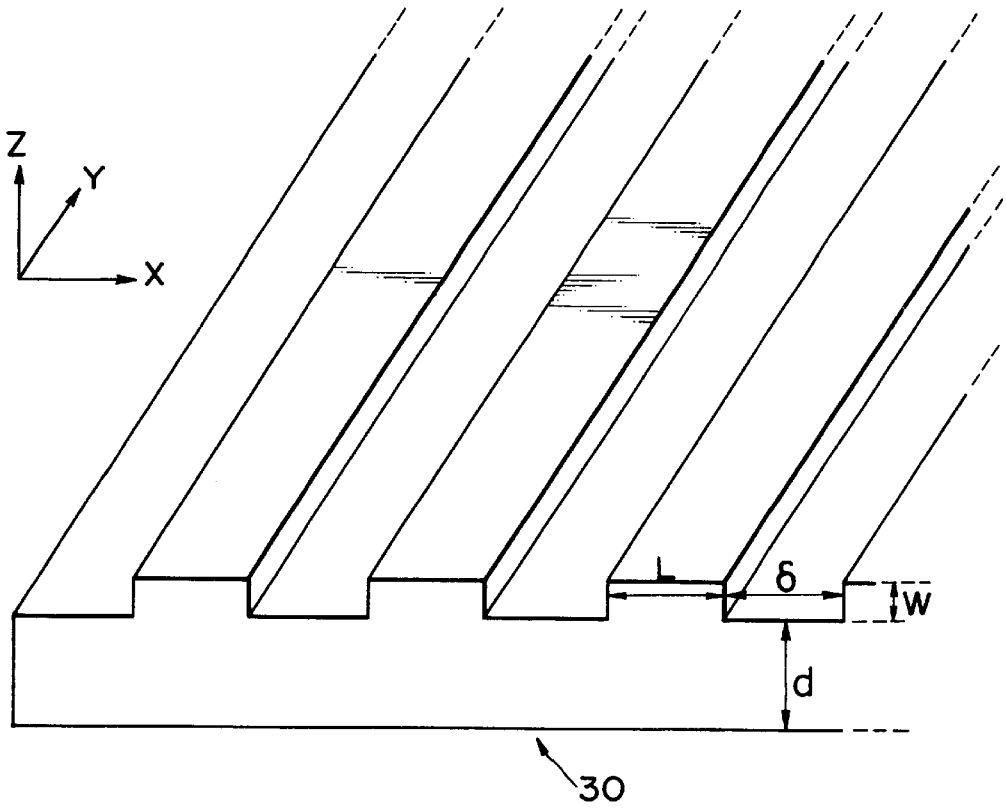

As shown in FIG. 39, the surface of either magnetic layer 30 has parallel grooves and parallel strips which are alternately arranged, side by side. Each strip has a width L and a height W. Each groove has a width δ. The magnetic layer has a thickness d, measured from the bottom of the groove. The three-dimensional coordinates showing the position of the i-th magnetic strip are:

$$x:\ (L+\delta)(i-1)-L/2 \leqq x \leqq (L+\delta)(i-1)+L/2$$
$$y:\ -\infty < y < +\infty$$
$$z:\ -w/2 \leqq z \leqq +w/2 \tag{1}$$

These relations represent a surface structure consisting of an definite number of parallel stripes and grooves which are arranged side by side in the X axis and which extend indefinitely in the Y axis. The relations also means that the magnetization vector I extends parallel to the magnetic layer if the layer has a low magnetic anisotropy. Unless the cost of the vector I with respect to the X axis is 0, magnetic poles will be established in the Y-Z plane of the magnetic layer. The surface density of these poles is the product of I and cost. The magnetic field which these poles generate can be analytically defined as a function of the coordinates (x, z). Let us take the magnetic strip (i=0) for example. The demagnetizing field Hd applied to this magnetic strip, and the effective magnetic field Hm applied to the strip from any other magnetic strip are represented as follows:

$$Hd = \frac{-I\cos\phi_0}{\mu_0}\begin{pmatrix}\theta_{0,1}-\theta_{0,2}-\theta_{0,3}+\theta_{0,4}\\ 0\\ \ln\left\{\dfrac{\cos\theta_{0,2}\times\cos\theta_{0,3}}{\cos\theta_{0,1}\times\cos\theta_{0,4}}\right\}\end{pmatrix}\times\frac{1}{2\pi} \tag{2}$$

$$Hm = \frac{-I}{\mu_0}\sum_{i\neq 0}^{\pm\infty}\cos\phi_i\begin{pmatrix}\theta_{0,1}-\theta_{0,2}-\theta_{0,3}+\theta_{0,4}\\ 0\\ \ln\left\{\dfrac{\cos\theta_{i,2}\times\cos\theta_{i,3}}{\cos\theta_{i,1}\times\cos\theta_{i,4}}\right\}\end{pmatrix}\times\frac{1}{2\pi}$$

$$\theta_{j,k} = \tan^{-1}\frac{z+(-1)^k\cdot\dfrac{w}{2}}{x-j(\delta+L)+\dfrac{L}{2}\times\sin\left(\dfrac{\pi}{2}k-\dfrac{\pi}{4}\right)}$$

where $\theta_{j,k}$ is:

Let us assume that the static energy of the fields Hd and Hm can be considered as a function of φ, and also that the magnetic strip (i=0) is in stable condition. Then, the average difference of energy density Uk per unit area defined by φ=0 (the vector I is parallel to the strip) and φ=π/2 (the vector I is perpendicular to the strip) is represented as follows:

$$Uk = v\times\frac{I^2}{\mu_0}\times\left\{\frac{1}{2}N_{eff}-2\sum_{i=1}^{\infty}P_{eff_i}\right\} \tag{3}$$

$$N_{eff} = \frac{2}{\pi LW}\int_0^w d\xi\int_0^L d\eta\left\{\tan^{-1}\left(\frac{\xi}{\eta}\right)\right\}$$

$$P_{eff_i} = \frac{-1}{\pi LW}\int_0^w d\xi\int_{-i(\delta+L)}^{-i(\delta+L)+L} d\eta\left\{\tan^{-1}\left(\frac{\xi}{\eta}\right)-\tan^{-1}\frac{\xi}{\eta-L}\right\}$$

As can be understood from the above, it is possible to render a magnetic layers magnetically anisotropic, merely by forming a spiral grooves in the surface of the magnetic layer. In order to make the Y axis function well as axis of easy magnetization, however, it is required that the axis (either X=0, or Y=0) of each magnetic strip be an axis of easy magnetization. Considering (X=0, Y=0) in conjunction with the equation representing Uk, we take i=±1 into account. Then, the equation of Uk changes to the following:

$$Uk = \frac{vI^2}{\pi\mu_0}\cdot\left\{\tan^{-1}\left(\frac{W}{L}\right)-2\tan^{-1}\left(\frac{W}{2\delta+L}\right)+2\tan^{-1}\left(\frac{W}{2\delta+3L}\right)\right\} \tag{4}$$

The first term of equation (4) is always positive. Thus, whether Uk has a positive value or a negative one depends upon whether the second term is positive or negative. Therefor, the magnetic layer can have an axis of easy magnetization which extends parallel to the magnetic strips and grooves, and can have an hard axis of magnetization which extends at right angles to the strips and grooves, provided that the surface structure of the magnetic layer satisfies the following inequality:

$$\tan^{-1}\left(\frac{W}{L}\right) \geqq 2\tan^{-1}\left(\frac{W}{2\delta+L}\right)-2\tan^{-1}\left(\frac{W}{2\delta+3L}\right) \tag{5}$$

Figure 40:
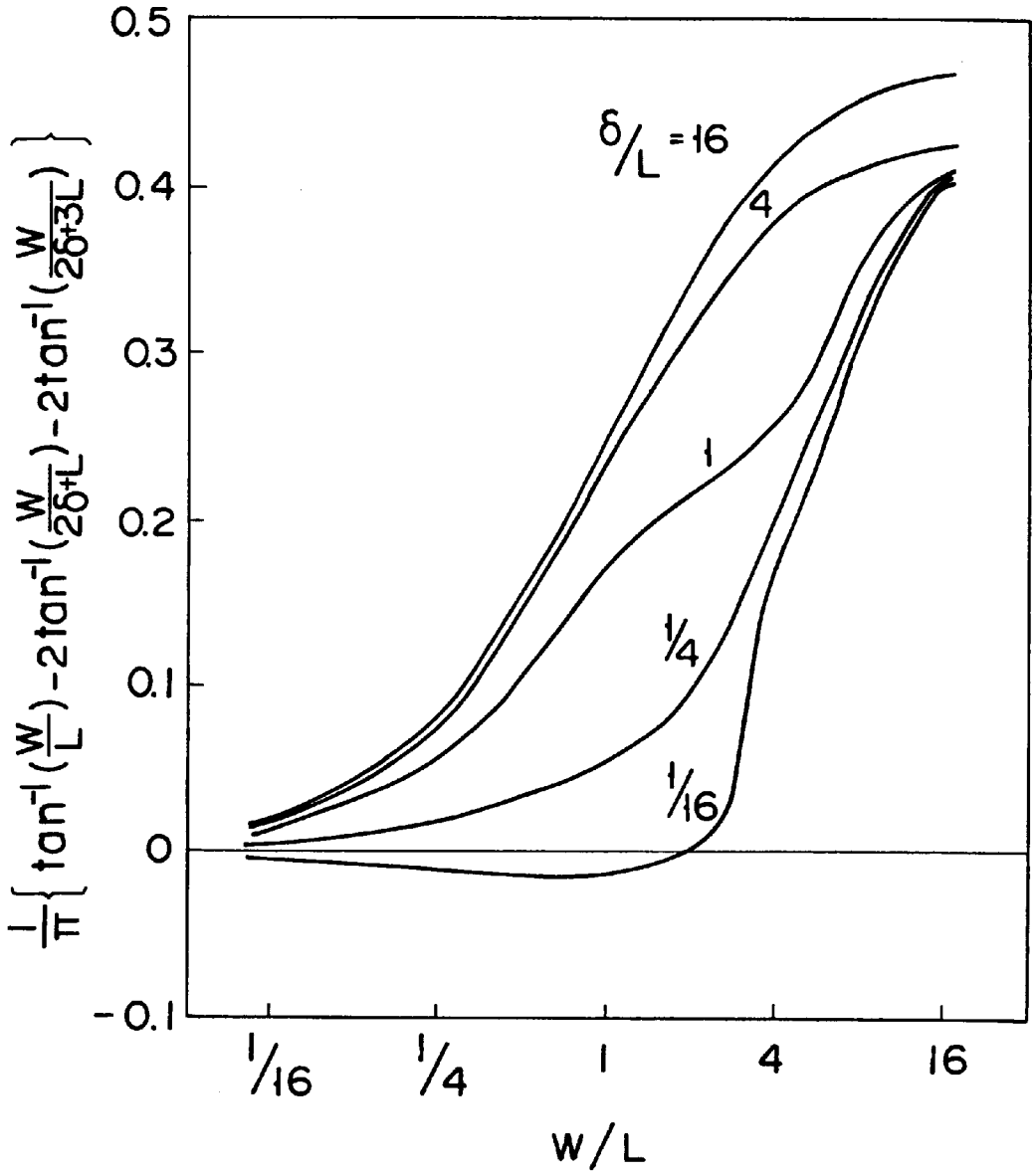

FIG. 40 represents the relationship between the parameters of the surface structure of either magnetic layer of the inductor (FIG. 38) and the second term of the equation defining Uk. As can be seen from FIG. 40, the magnetic anisotropy is inverted when the height W of the strips is as small as in the case where δ/L=1/16. Then, it is possible that the magnetic layer has an axis of easy magnetization which extends at right angles to the strips and grooves.

In the case where W=0.5 μm, L=4 μm, δ=2 μm, and d=2 μm, the average energy-difference density Uk for the closest strips (i=±1) is 80 Oe or more, in terms of the intensity of an anisotropic magnetic field, and on the assumption that the magnetization value is 1 T.

Figure 41:
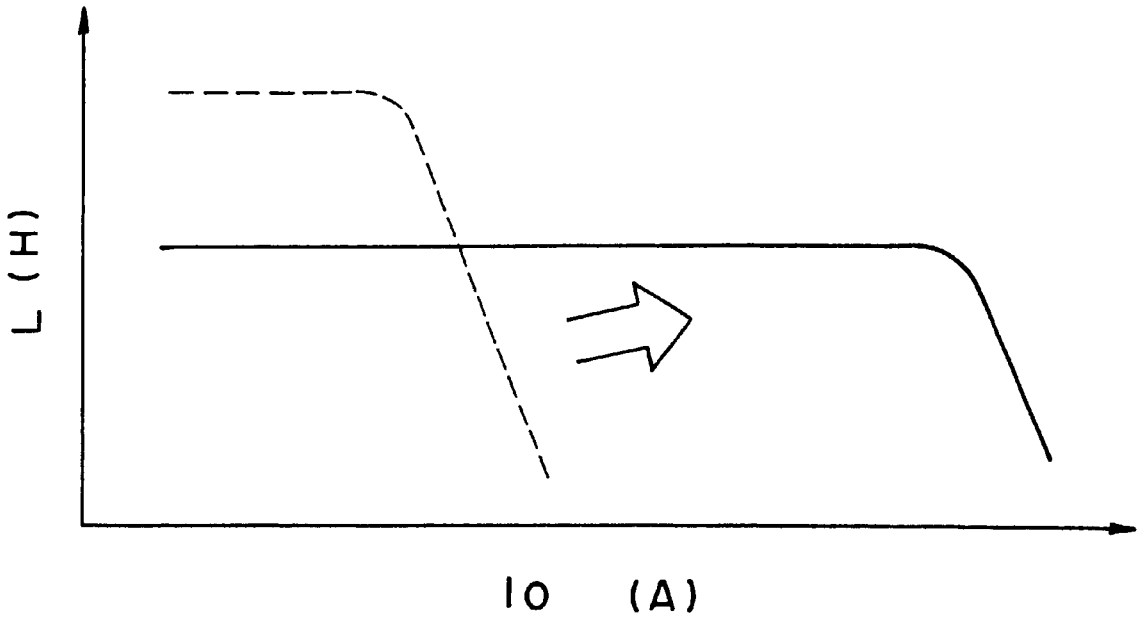

FIG. 41 represents the superimposed DC current characteristic of the inductor shown in FIG. 38. More precisely, the solid-line curve shows the superimposed DC current characteristic of the inductor, whereas the broken-line curve indicates the superimposed DC current characteristic of the planar inductor shown in FIG. 29. As is evident from FIG. 41, unlike the inductance of the inductor of FIG. 29, the inductance of the inductor shown in FIG. 38 remains almost constant, irrespective of the superimposed DC current, until the superimposed DC current increases to a specific value.

As has been described, the planar inductors according to the fourth aspect of the invention are free of the problem of saturation of the magnetic layers, since the magnetic layers have the first, second, or third structure described above, and, hence, the layers are magnetized in their respective hard axes of magnetization. In addition, since each magnetic layer is magnetized in its hard axis of magnetization, it undergoes rotational magnetization. Therefore, the loss of high-frequency eddy current can be reduced more than in the case where each magnetic layer undergoes magnetic domain wall motion. Obviously, this much helps to improve the frequency characteristic of the planer inductor.

It will now be explained various spiral planar coils which are rectangular, not square as those described thus far, which can be used in the planar magnetic elements according to the fourth aspect of the invention. As will be described, the terminals of any rectangular planer coil are more easy to lead outwards, than those of the square planar coils.

Here, several planer inductors, each having at least one rectangular spiral planer coil, will be described as planar magnetic elements. Not only such planar inductors, but also planar transformers are included in the planar magnetic elements according to the fourth aspect of the invention. These planar transformers are identical in structure to the planar inductors, except that each has a primary coil and a secondary coil, both being rectangular spiral planar coils located one above the other, and accomplish the same advantages as the planar inductors. Hence, they will not be described in detail.

Figure 42A:
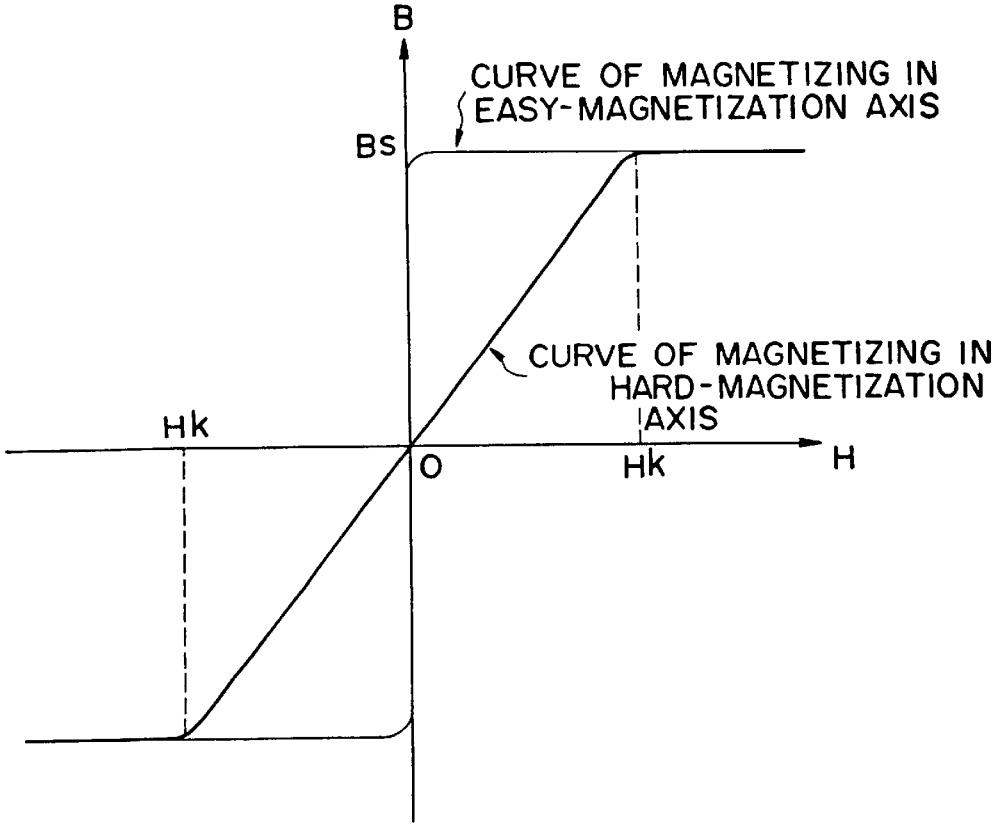
FIG. 42A is a graph showing a curve of magnetization in the easy axis of magnetization of the inductor (FIG. 38) and a curve of magnetization in the hard axis of magnetization of the magnetic material.
Figure 42B:
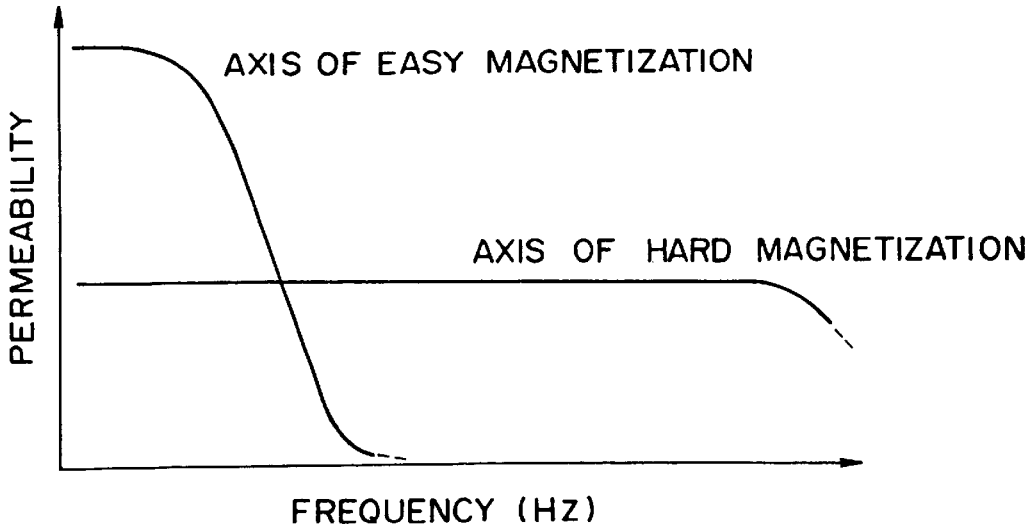
FIG. 42B is a graph illustrating the permeability-frequency relationship in the axis of easy magnetization, and also the permeability-frequency relationship in the hard axis of magnetization.

FIG. 42A represents the magnetization characteristic of a magnetic layer exhibiting uniaxial magnetic anisotropy. More precisely, this figure shows the B-H curve of magnetization along the axis of easy magnetization, and also the B-H curve of magnetization along the hard axis of magnetization. FIG. 42B shows the permeability-frequency relationship which the magnetic layer exhibits along the axis of easy magnetization, and also the permeability-frequency relationship which it exhibits along the hard axis of magnetization. As is evident from FIG. 42B, the magnetic layer is quite saturable along the axis of easy magnetization, but can hardly be saturated along the axis of magnetization. As can be clearly understood from FIG. 42B, the permeability which the magnetic layer exhibits along the axis of easy magnetization is very high in the low-frequency region, but very low in the high-frequency region. By contrast, the permeability which the layer exhibits along the hard axis of magnetization is lower in the low-frequency region than the permeability along the axis of easy magnetization, but is far higher in the high-frequency region. The graphs of FIGS. 42A and 42B suggest that a planar inductor having good electric characteristics can be manufactured if used is made of the constant permeability which the magnetic layer exhibits along the hard axis of magnetization.

There are three modes of utilizing the constant permeability of the magnetic layer. These modes will be explained, one by one.

First Mode

The first mode is to use a rectangular spiral planar coil, two insulation layers sandwiching the coil, and two magnetic layers placed above and below the coil, respectively, such that their hard axes of magnetization are aligned with the major axis of the coil.

Figure 43A:
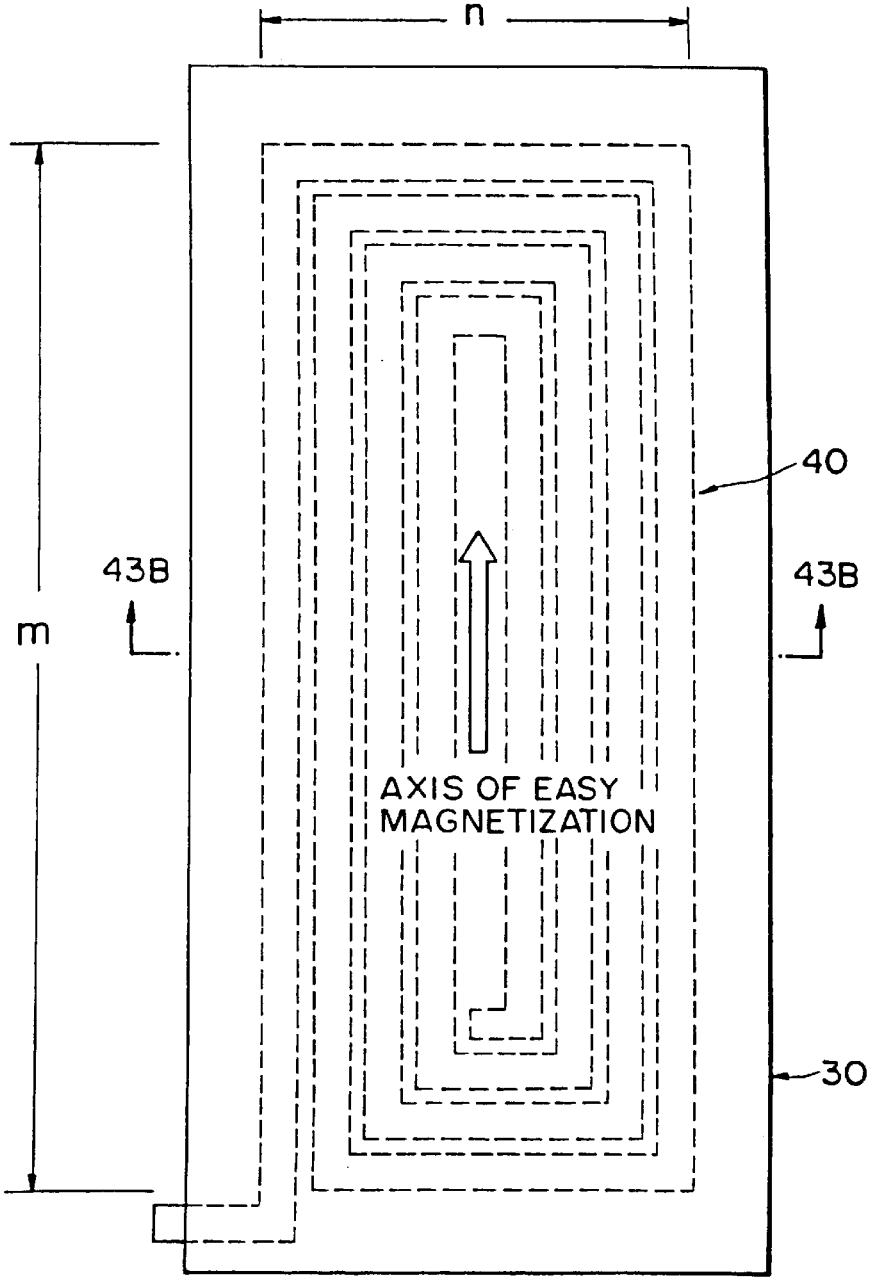
FIGS. 43A and 43B are a plan view and a sectional view, respectively, illustrating a fifth planar inductor according to the fourth aspect of the invention.
Figure 43B:
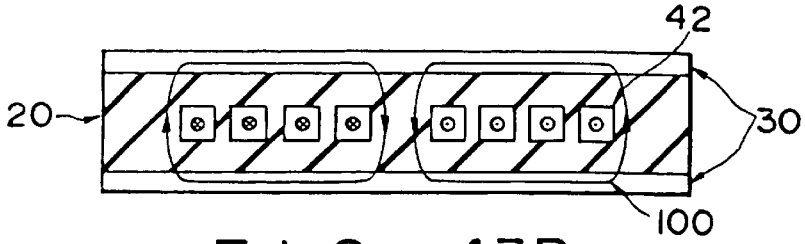
Figure 44:
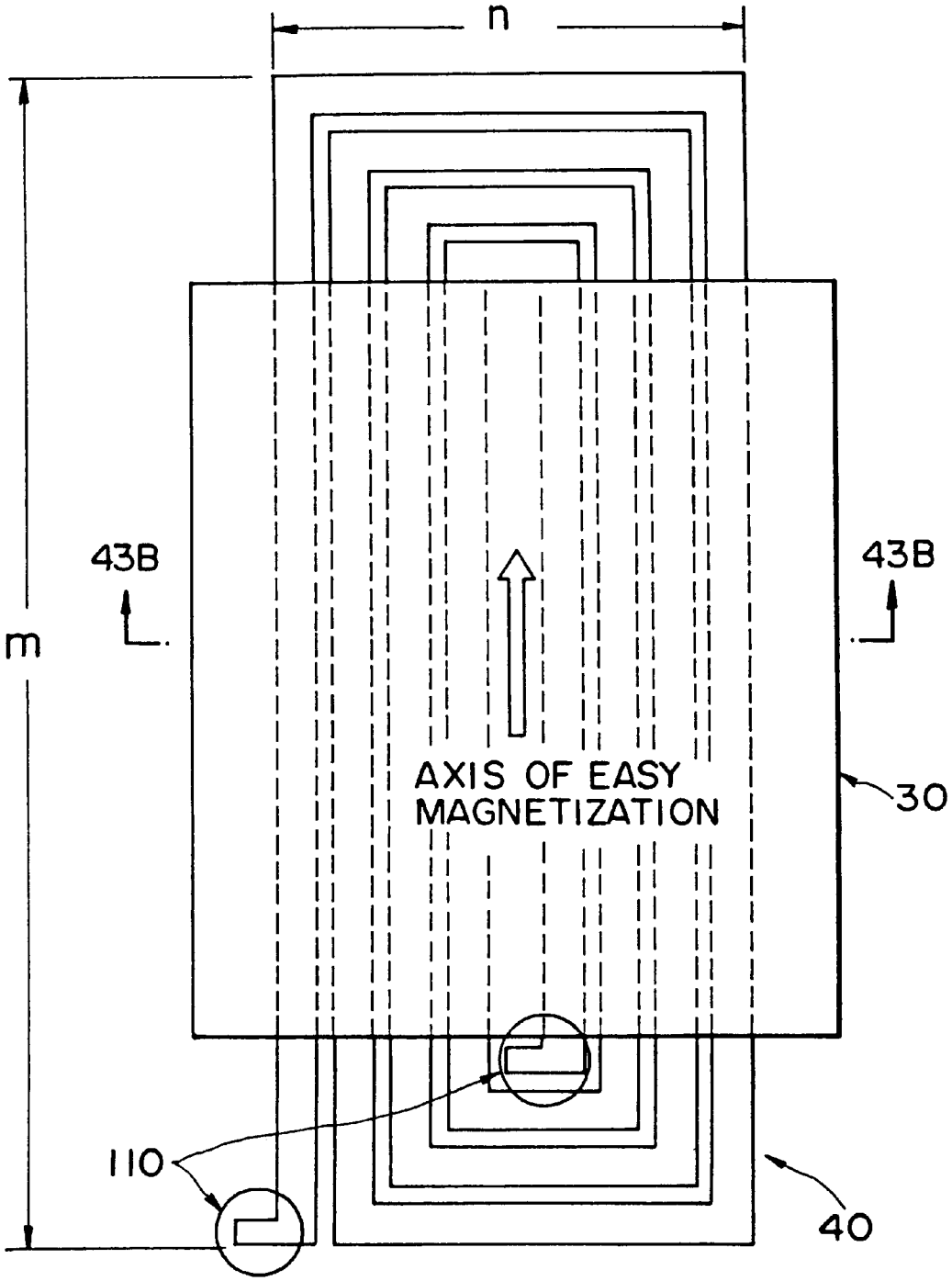

FIG. 43A is a plan view shown a planar inductor made by the first method, and FIG. 43B is a sectional view of this inductor, taken along line 43B—43B in FIG. 43A. As is evident from FIGS. 43A and 43B, a rectangular spiral planar coil 40 is sandwiched between two magnetic layers 30. The coil has a great aspect ratio (i.e., the ratio of the length m of the major axis to that n of the minor axis). The greater the aspect ratio m/n, the more magnetic fluxes generated by the coil 40 intersect at right angles with the axis of easy magnetization of the magnetic layer, thereby improving the electric characteristics of the planar inductor. In order to enhance the characteristics of the inductor further, the magnetic layers 30 can be made smaller so that they cover only the middle portion of the coil 40, as is illustrated in FIG. 44.

Second Mode

The second mode is to connect two rectangular spiral planer coils of the same type as used in the first mode and place them in the same plane, and to use two insulators sandwiching the coils and two sets of magnetic layers, each set consisting of two magnetic layers placed above and below the corresponding coil, respectively. The magnetic layers of each set are located such that their axes of magnetization are aligned with the major axis of the corresponding coil.

Figure 45:
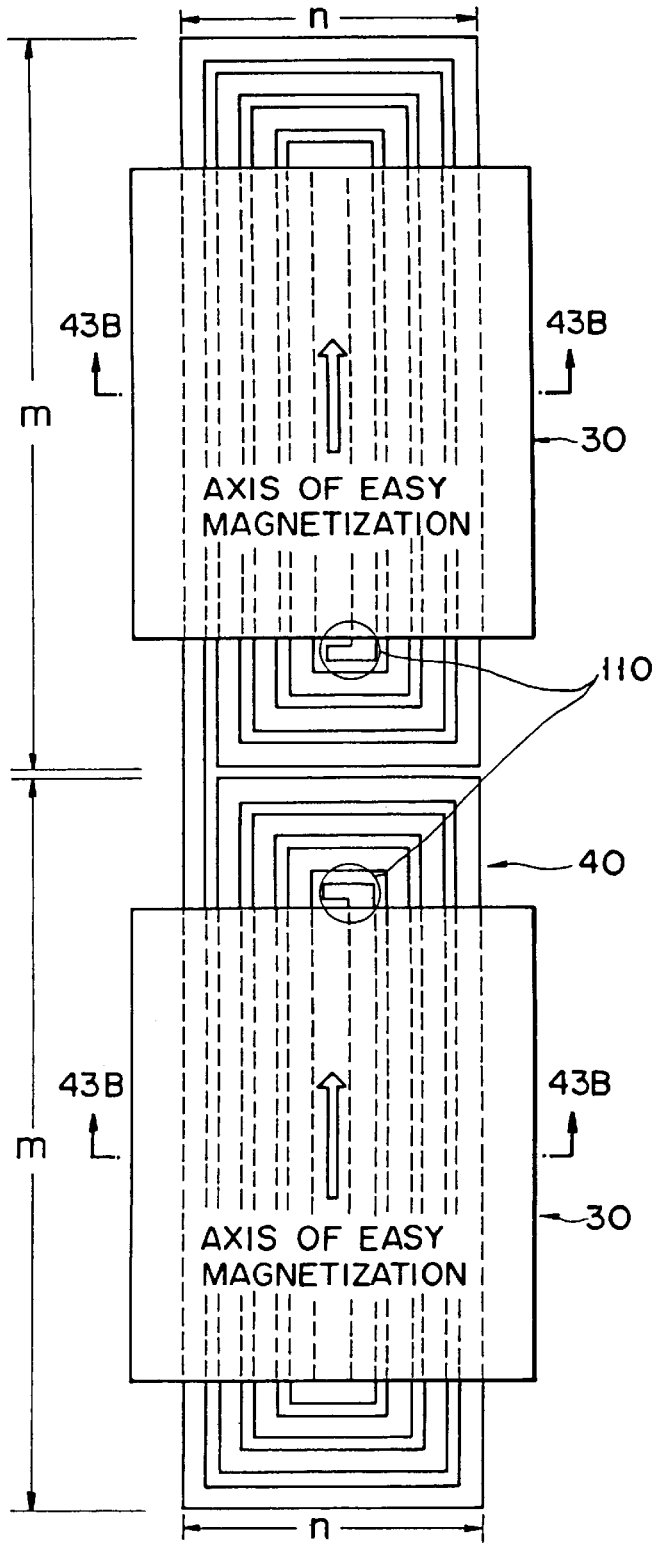

FIG. 45 is a plan view illustrating a planar inductor of the second mode, which comprises two rectangular spiral planar coils 40 connected, end to end, with their major axes aligned together. This planar inductor has the same sectional structure as the one illustrated in FIG. 43B.

Figure 46A:
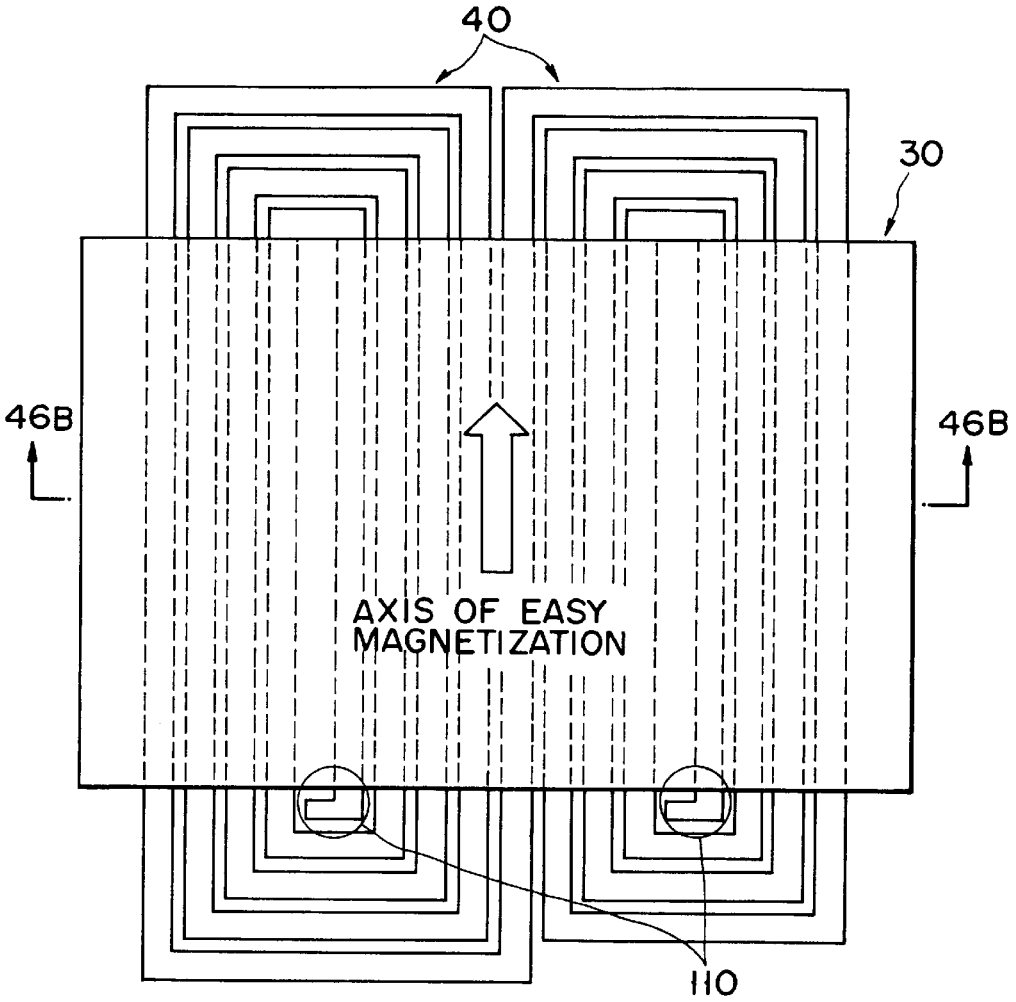
FIGS. 46A and 46B are a plan view and a sectional view, respectively, showing another type of a planar inductor according to the fourth aspect of the present invention.
Figure 46B:
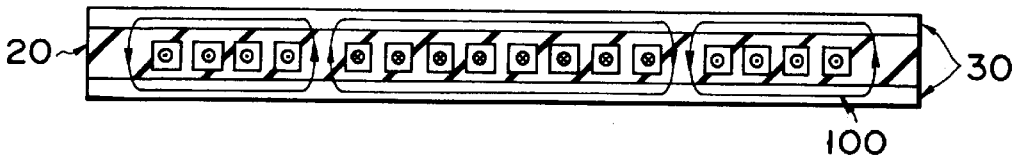

FIG. 46A is a plan view showing another planar inductor of the second mode, which comprises two rectangular spiral planar coils 40 connected, side to side, with their minor axes aligned together. FIG. 46B is a sectional view, taken along line 46B—46B in FIG. 46A, illustrating this planer inductor.

Figure 47A:
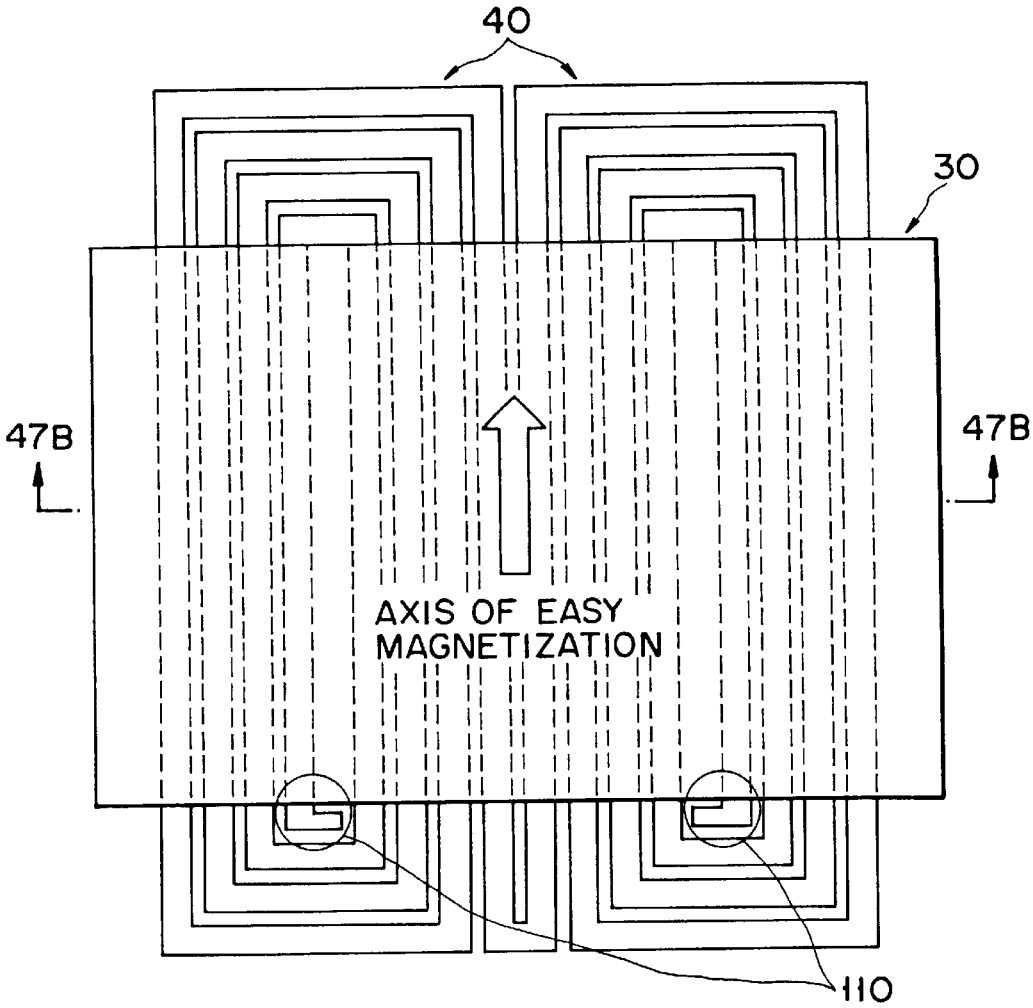
FIGS. 47A and 47B are a plan view and a sectional view, respectively, illustrating a seventh planer inductor according to the fourth aspect of the present invention.
Figure 47B:
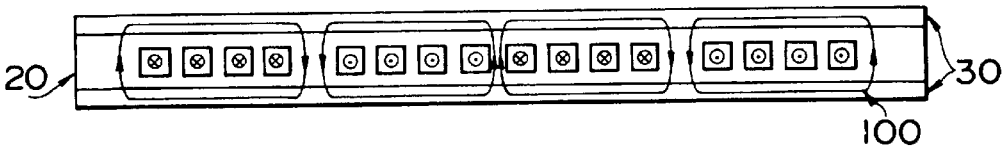

There are two alternative methods of connecting the coils 40, side by side. The first method is to arrange the coils 40 with their conductors wound in the same direction as is shown in FIG. 46A, and then connect them together, side by side. The second method is to arrange the coils 40 with their conductors wound in the opposite directions as is shown in FIG. 47A, and then connects them together, side by side. When the second method is used, more magnetic paths are formed as is evident from FIG. 47B than in the case the first method is employed. Which method is superior depends upon the various conditions required of the planar inductor.

With the planar inductors shown in FIG. 45, FIGS. 46A and 46B, and FIGS. 47A and 47B, it is possible to use larger magnetic layers which cover the entire spiral coils 40, not only the middle portions thereof as is illustrated in FIGS. 44, 45, 46A and 47A.

Third Mode

The third mode is to expose the terminals of the conductor of the rectangular planar coils connected together. This facilitates the leading of the terminals out of the planer inductor.

As has been described, in the planer inductors of the first mode, the second mode or the third mode, two rectangular spiral coils are connected. Therefore, they can have an inductance twice or more higher than the inductance of the inductor shown in FIGS. 43A and 43B and that of the inductor shown in FIG. 45. Further, since the two rectangular spiral coils are located in the same plane, no exposed wires are required to connect them together electrically.

As has been described, the planar magnetic elements according to the fourth aspect of the present invention make an effective use of the hard axis of magnetization of any magnetic layer incorporated in it. The magnetic layer undergoes rotational magnetization, and is hardly saturated magnetically, and hence improves the high-frequency characteristic of the planer magnetic element.

In the planar inductors shown in FIG. 44, FIG. 45, FIGS. 46A and 46B, and FIGS. 47A and 47B, only one magnetically anisotropic layer is located on the either side of each spiral planer coil. In practice, two more magnetically anisotropic layers are located on either side of the coil, thus imparting a higher inductance to the planar inductor.

It will be explained briefly how the planar elements according to the fourth aspect of the invention are are manufactured. First, soft magnetic layers made of amorphous alloy, crystal-line alloy, or oxide, and having a thickness of 3 $\mu$m or more, are prepared. These magnetic layers are heat-treated in a magnetic field, whereby they acquire a uniaxial magnetic anisotropy. Then, the magnetic layers, now magnetically anisotropic, a required number of rectangular spiral planar coils, and insulation layers are placed, one upon another, and are combined together. It is desirable that the magnetic layers be made of such material that these layers have as less strain as possible when they are bound together with the coils and the insulation layers.

The magnetic layers can be formed by means of thin-film process such as vapor deposition or sputtering. When they are made by the thin-film process, they will have uniaxial magnetic anisotropy while they are being formed in an electrostatic field or while they are undergoing heat treatment in a magnetic field. The less magnetostriction, the better. Nonetheless, a magnetic layer, if made of material having a relatively large magnetostriction, can have a uniaxial magnetic anisotropy by the inverse magnetostriction effect, only if the stress distribution of the layer is controlled appropriately.

The planar magnetic elements according to the fourth aspect of the invention are modified, so that they may be incorporated into integrated circuits, along with other types of elements such as transistors, resistors, and capacitors. More specifically, they are modified to reduce leakage magnetic fluxes, thereby to prevent the other elements from malfunctioning. The planar inductors shown in FIG. 44, FIG. 45, FIGS. 46A and 46B, and FIGS. 47A and 47B, in particular, need to have additional members, i.e., magnetic shields covering the exposed portions of the coil conductors. Such a modification will be described, with reference to FIGS. 48A and 48B which are a plan view and a sectional view, respectively.

Figure 48A:
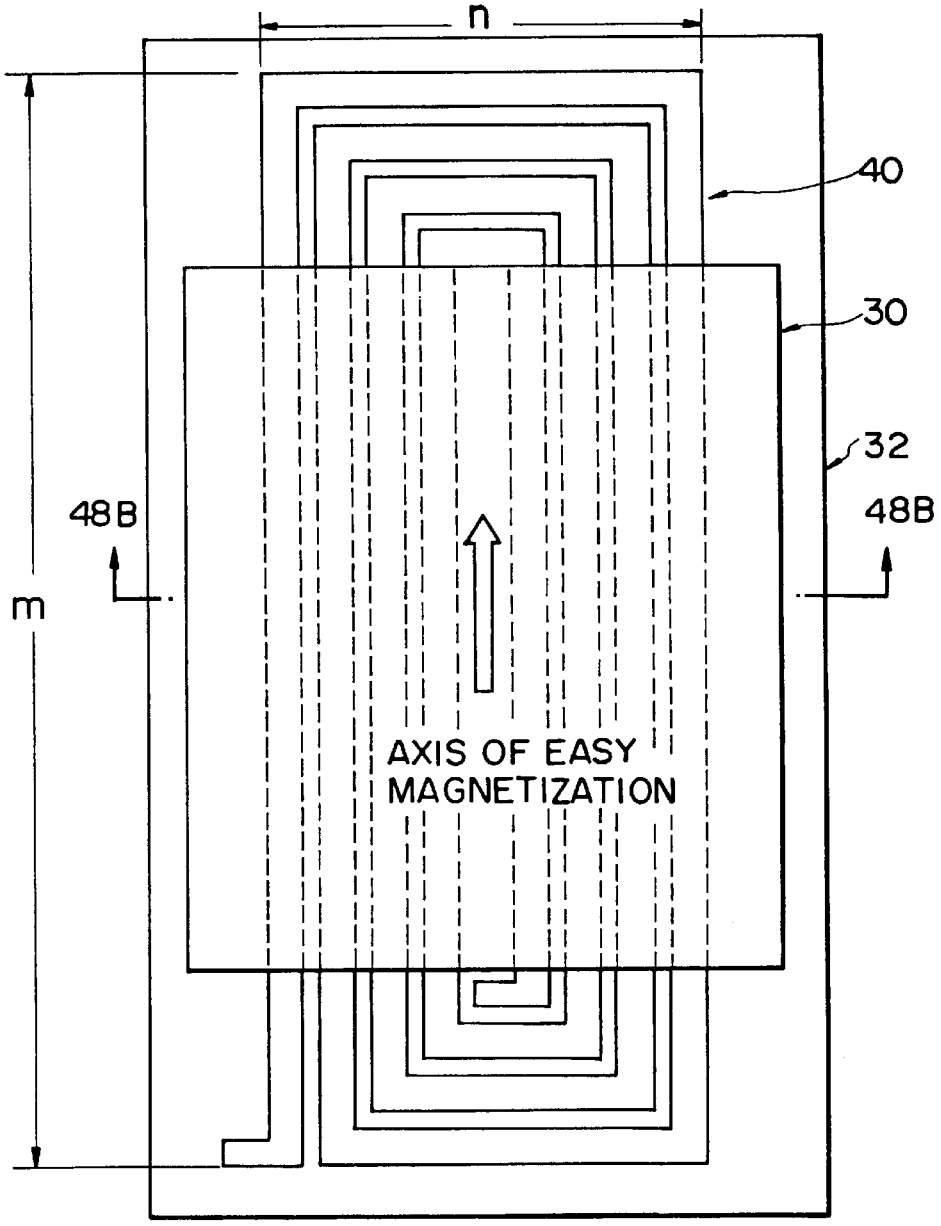
FIGS. 48A and 48B are a plan view and a sectional view, respectively, showing an eighth planer inductor according to the fourth aspect of the invention.
Figure 48B:
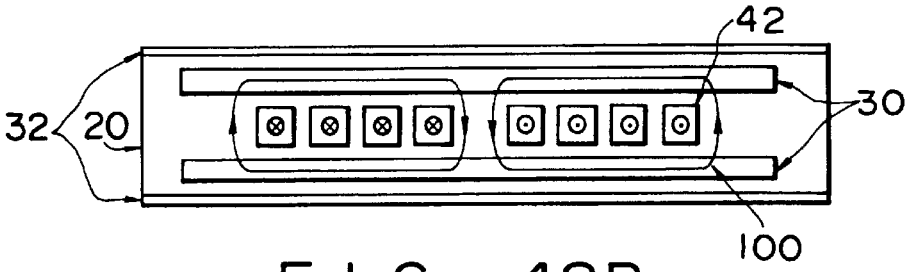

This modification is characterized by the use of two magnetic shields 32 which cover magnetic layers 30 and also a rectangular spiral planar coil 40 in its entirety. Hence, the shields 32 block magnetic fluxes, if any, emanating from the coil 40. In FIGS. 48A and 48B, the numerals identical to those shown in FIGS. 43A and 43B are used to designate the same components as those of the planer inductor shown in FIGS. 43A and 43B.

Planar magnetic elements according to the fifth aspect of the invention will now be described, with reference to FIGS. 49 to 61.

Figure 49:
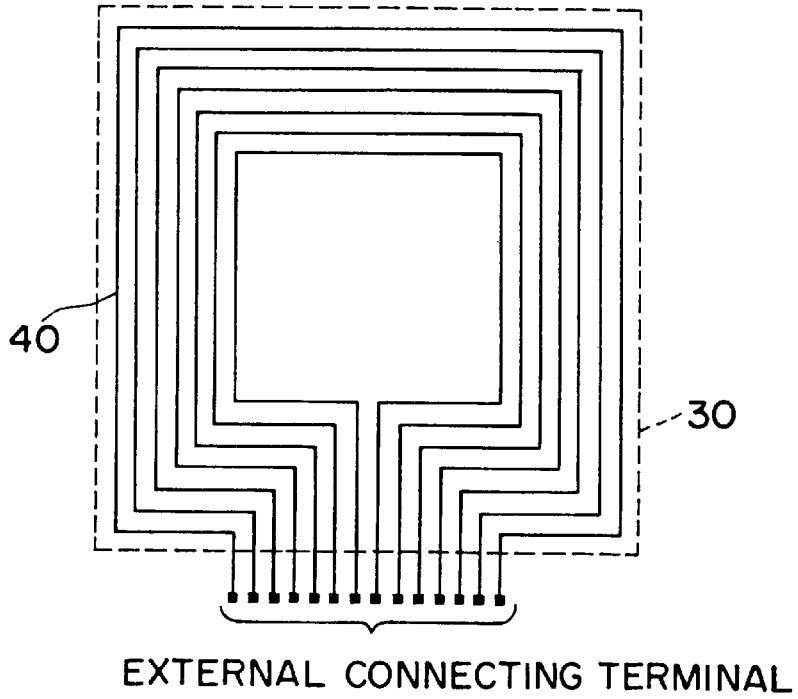
FIGS. 49 to 61 are diagrams and graphs showing and explaining the fifth aspect of the invention.
Figure 50:
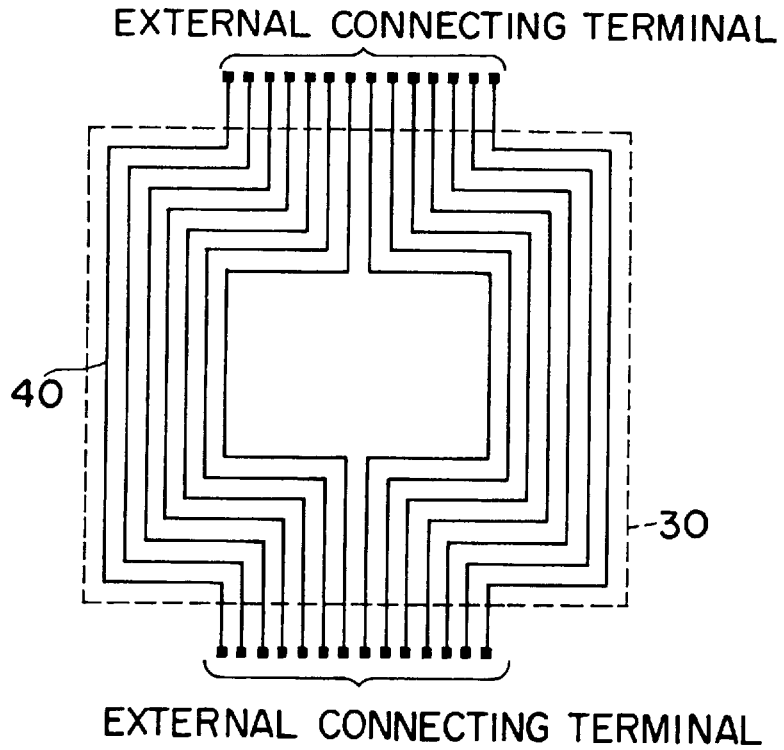

FIGS. 49 and 50 are plan views showing two planar coils for use in planar magnetic elements according to fifth aspect of the invention.

The coil shown in FIG. 49 is generally square, interposed between a pair of magnetic layers 30, comprising a plurality of one-turn coil conductors 40. The conductors 40 are arranged in the same plane and concentric to one another. Each conductor 40 has two terminals which extend from one side of the combined magnetic layers 30.

The coil shown in FIG. 50 is also generally square, interposed between a pair of magnetic layers 30, comprising a plurality of one-turn coil conductors 40. The conductors 40 are arranged in the same plane and concentric to one another. Each conductor 40 consists of two portions shaped symmetrically to each other. Either portion has two terminals, extending from the two opposite sides of the combined magnetic layers 30. Hence, each one-turn coil conductor 40 has four terminals, two of which extend from one side of the combined magnetic layers 30, and the remaining two of which extend from the opposite side of the combined magnetic layers 30.

In the planar magnetic elements of FIGS. 49 and 50, the magnetic layers 30 can be made of a soft-ferrite core, a soft magnetic ribbon, a magnetic thin film, or the like. When they are made of a soft magnetic alloy ribbon or a soft magnetic alloy film, it is necessary to insert an insulations layer into the gap between the planar coil and either magnetic layer 30.

The planar magnetic elements according to the fifth aspect of the invention do not need a through-hole conductor or terminal-leading conductors as the planar is magnetic element which have spiral planer coils. Hence, they can be manufactured more easily. Further, they can easily be connected to external circuits since the terminals of each one-turn coil 40 extend from the side or sides of the magnetic layers 30.

When any planer magnetic element according to the fifth aspect of the invention is used as an inductor, its inductance can be easily adjusted by connecting the one-turn coils 40 in various ways, as will be explained with reference to FIGS. 51 to 53.

Figure 51:
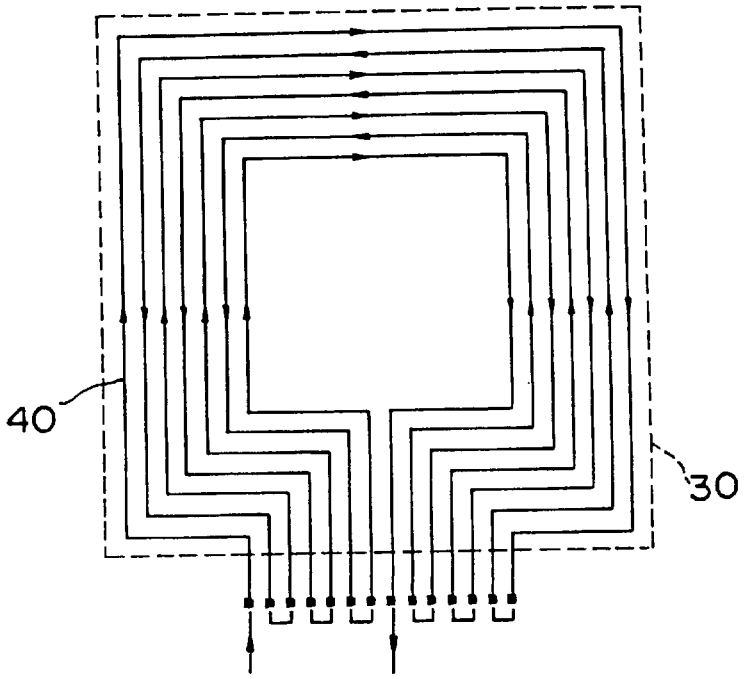

FIG. 51 shows a planar coil of the type shown in FIG. 49. All one-turn coils 40 forming this planar coil connected, end to end, to one another, except for the innermost one-turn coil and the outermost one-turn coil. The free end of the innermost one-turn coil 40 makes one input terminal of the planar coil, whereas the free end of the outermost one-turn coil makes the other terminal of the planar coil. The planar coil, formed of the one-turn coil 40 thus connected, generates a magnetic field which is similar to one generated by a planar coil having a meandering coil conductor.

Figure 52:
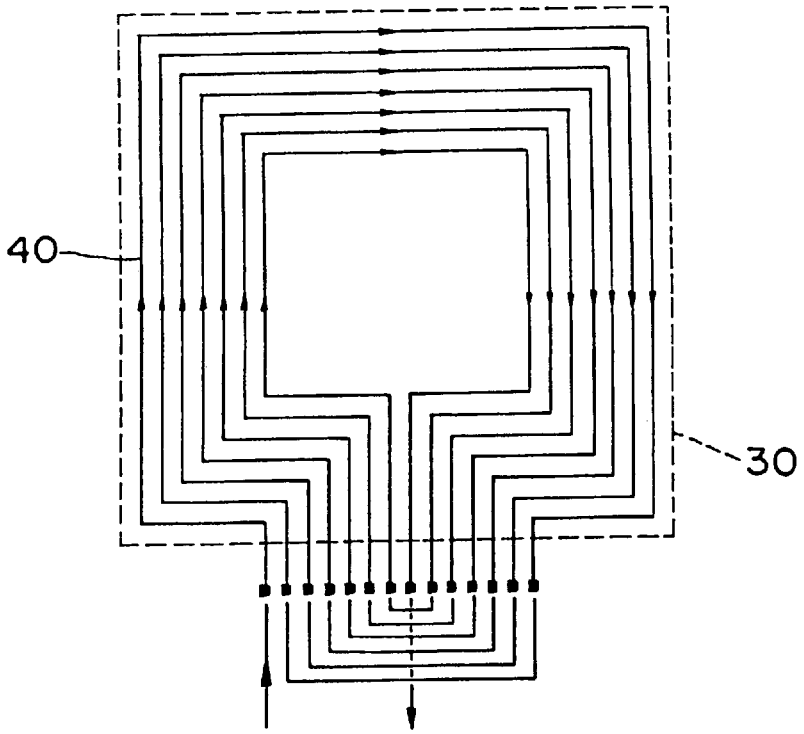

FIG. 52 shows a planar coil of the type shown in FIG. 49. One end of each one-turn coil 40 is connected to that end of the next one-turn coil 40 which is symmetrical with respect to the vertical axis in FIG. 52. The other end of the innermost one-turn coil is free. So is the other end of the outermost one-turn coil. In this planar coil, a current flows through in one direction through any one-turn coil, and in the opposite direction in the immediately next one-turn coil. This planar coil generates a magnetic field which is similar to one generated by a planar coil having a spiral coil conductor.

Figure 53:
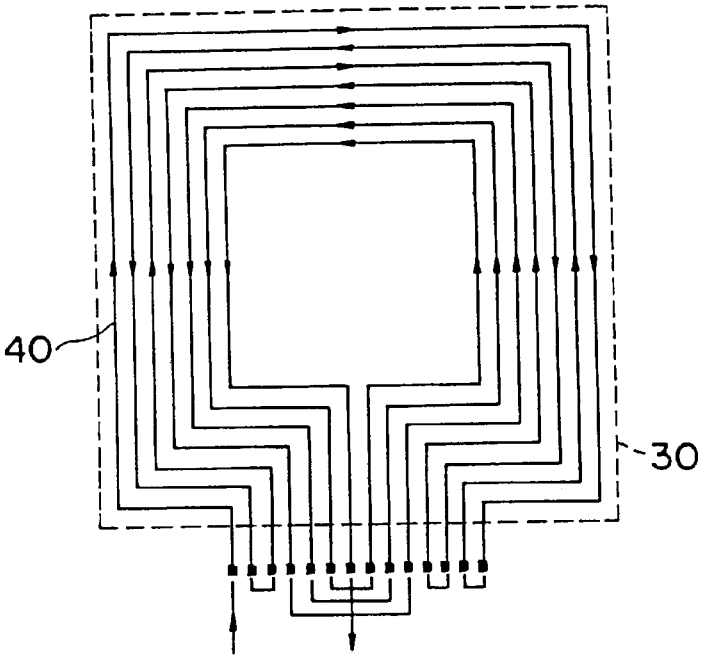

FIG. 53 shows a planar coil of the type shown in FIG. 49. Some outer one-turn coils 40 forming this planar coil connected, end to end, to one another, except for the outermost one-turn coil, and the remaining one-turn coils 40, i.e., the inner one-turn are connected, at one end, to that end of the next one-turn coil 40 which is symmetrical with respect to the vertical axis in FIG. 53. This planar coil generates a magnetic field which is similar to one generated by a planar coil having a coil which consists of a meandering portion and spiral portion.

Of the planar coils shown in FIGS. 51, 52, and 53, the coil of FIG. 52 has the highest inductance. The planar coil of FIG. 51 has the lowest inductance. The planar coil 53 has an intermediate inductance.

Hence, any planer inductor according to the fifth aspect of the invention can have its inductance adjusted easily, merely by changing the way of connecting the one-turn coils 40, as has been explained above. The one-turn coils 40 can be connected other ways than the three specific methods explained with reference to FIGS. 51, 52, and 53, so that the inductance of the planar inductor can have an inductance desirable to the user of the planar inductor.

Figure 54:
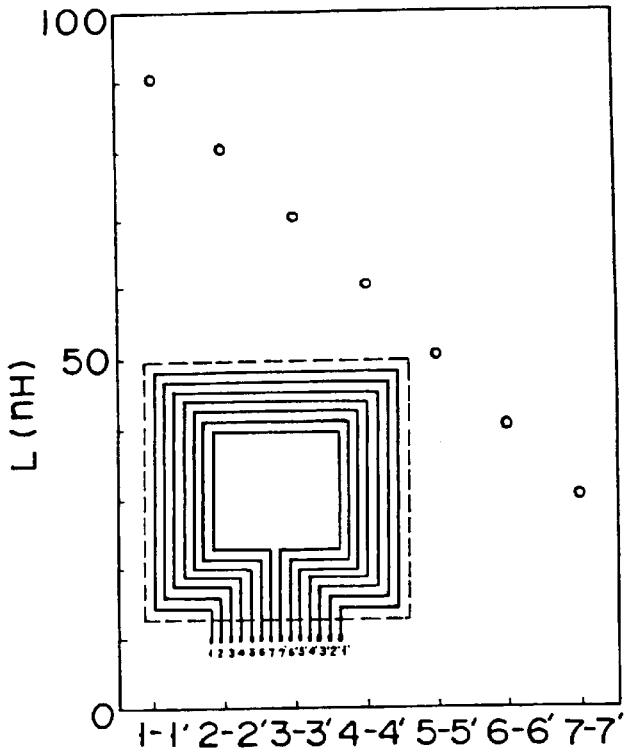

FIG. 54 is a diagram representing the inductance which each one-turn coils 40 of the planar magnetic element shown in FIG. 49 have when its terminals are connected to a power supply. As is evident from FIG. 54, the one-turn coils 40 have different inductances when they are individually connected to the same power supply. This means that the planar coil shown in FIG. 49 can have slightly different inductances, by connecting all or some of the one-turn coils 40 in various possible manners (including those explained with reference to FIGS. 51 to 53), employed either singly or in combination. In other words, the inductance of the planar coil (FIG. 49) can be minutely trimmed, over a broad range.

The planar magnetic element shown in FIG. 49 can be modified in various ways to function as a planar transformer, as will be described with reference to FIGS. 55 to 58. More specifically, the one-turn coils 40 of the element are divided into at least two groups, and the terminals of the one-turn coils of each group are connected in various ways.

Figure 55:
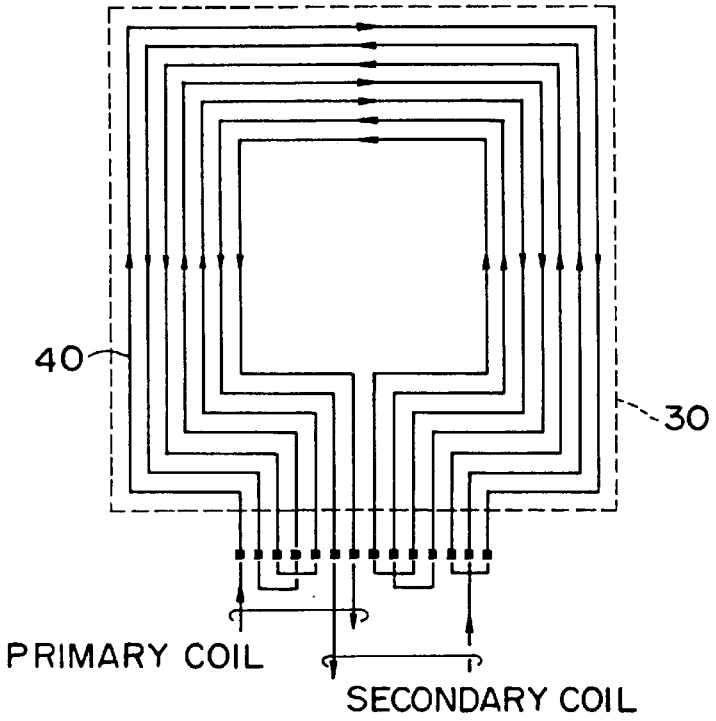
Figure 56:
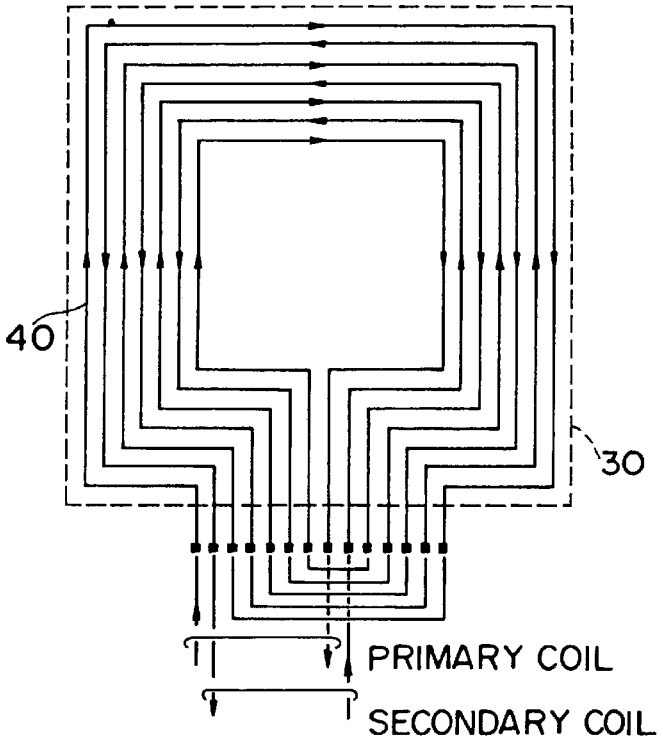
Figure 57:
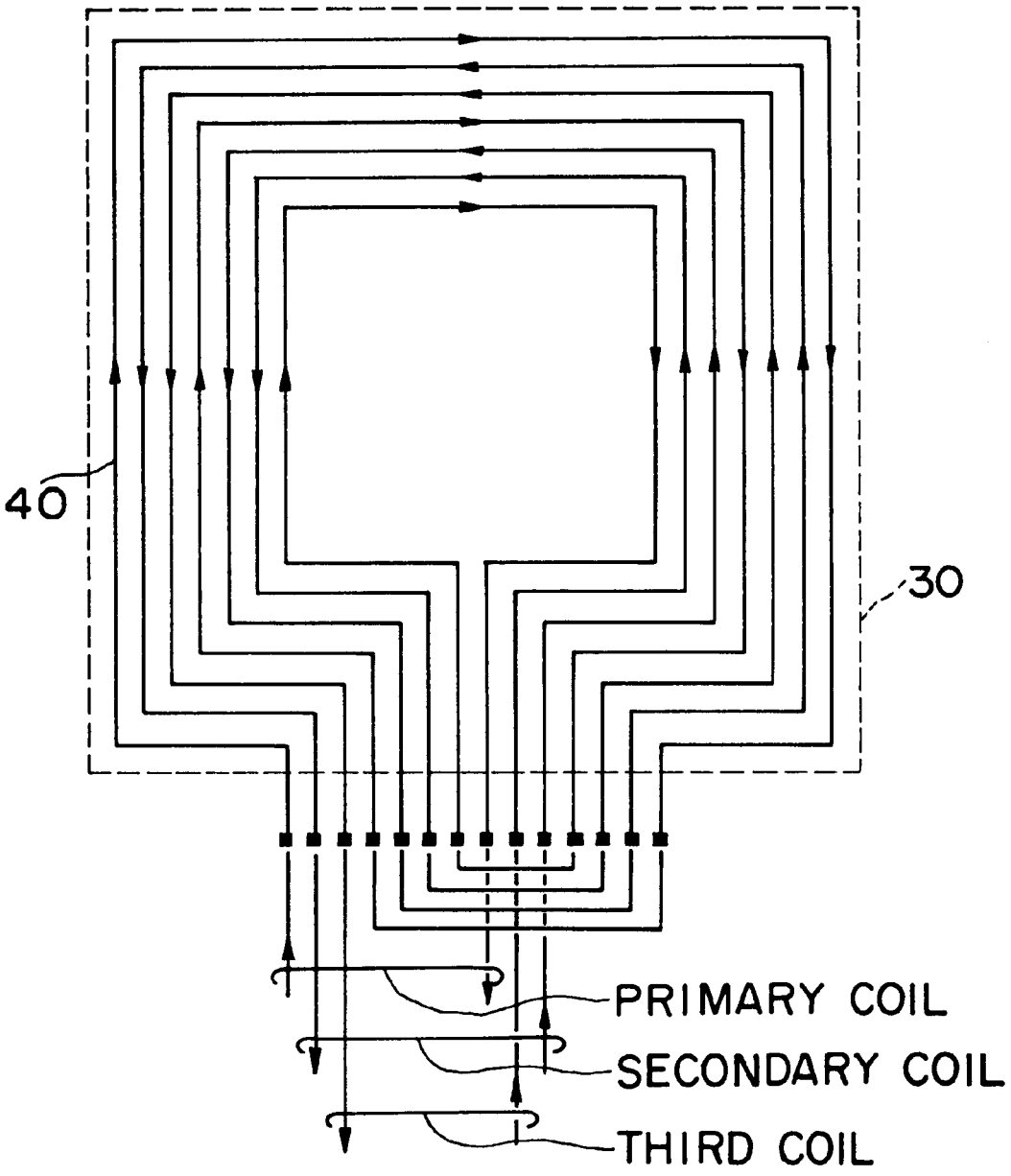
Figure 58:
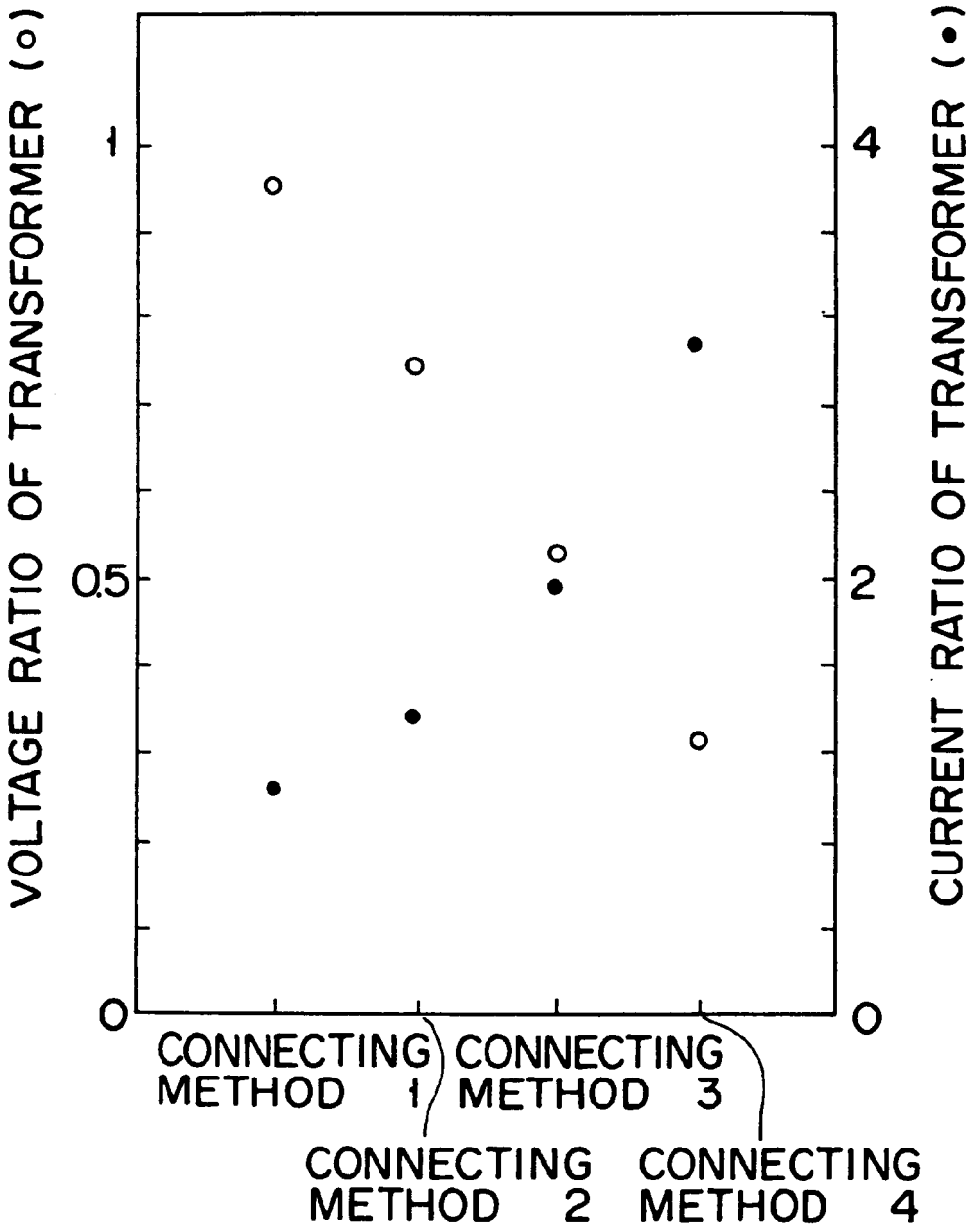

FIGS. 55 and 56 show transformers of one-input, one-output type. FIG. 57 shows a transformer of one-input two-output type. As for any transformer, wherein the one-turn coils 40 are divided into two or more groups, the manner of connecting the one-turn coils 40 is not limited to those illustrated in FIGS. 55 to 57. By connecting the one-turn coils 40 forming a primary coil, those forming a secondary coil, those forming a tertiary coil, and so on, in various ways, the inductance of the coil or the coefficient of coupling between the coils can be adjusted. Hence, the voltage ratio and current ratio of the transformer can be adjusted externally. FIG. 58 represents the relationship between the voltage and current ratios of the magnetic element shown in FIG. 49, on the one hand, and the manner of connecting the outer terminals, on the other;

The planar magnetic element shown in FIG. 50 can also be modified into a transformer, whose voltage ratio and current ratio can be more minutely adjusted than those of the transformer modified from the planar magnetic element of FIG. 49 which has less outer terminals. However, the more outer terminals, the more difficult it is for the user to correctly connect them correctly. In view of this, it would be recommended that a planar magnetic element have two to four outer terminals, as do the elements illustrated in FIGS. 51 and 55.

In the case of a planar inductor whose electric characteristics need not be adjusted externally and which needs to have a high inductance, the gap between any adjacent one-turn coils must be as narrow as the existing manufacturing process permits, and the terminals of the one-turn coils must be connected as is illustrated in FIG. 52, so that the inductor can have a very high inductance. In the case of a planar magnetic element which needs to have an excellent frequency characteristic at the expense of its inductance, the gap between any adjacent one-turn coils must be as broad as the manufacturing process permits, and the terminals of the one-turn coils must be connected as is shown in FIG. 51, so that this inductor can have a very good frequency characteristic. In the case of a planar transformer whose electric characteristics need not be adjusted externally, the gap between any adjacent one-turn coils must be as narrow as possible, whereby the transformer operates very efficiently for a particular purpose.

In order to miniaturize the planar magnetic elements according to the fifth aspect of the invention, it is desirable that they are produced by the same thin-film process as is employed in manufacturing semiconductor devices. When these elements are formed on a semiconductor substrate made of Si or GaAs, along with active elements such as transistors and passive elements such as resistors and capacitors, a small monolithic device can be manufactured. The planar magnetic elements can be located in the same plane as the active elements, or above or below the active elements.

Figure 59:
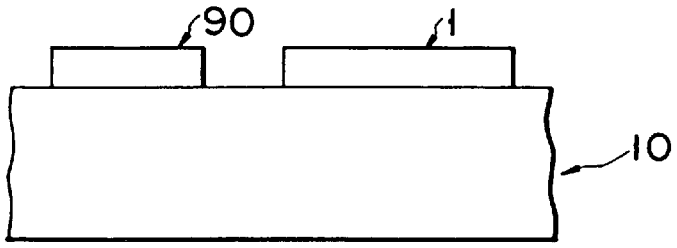
Figure 60:
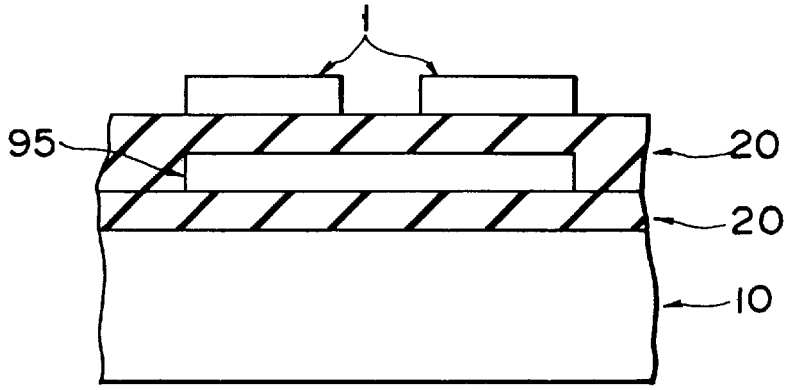
Figure 61:
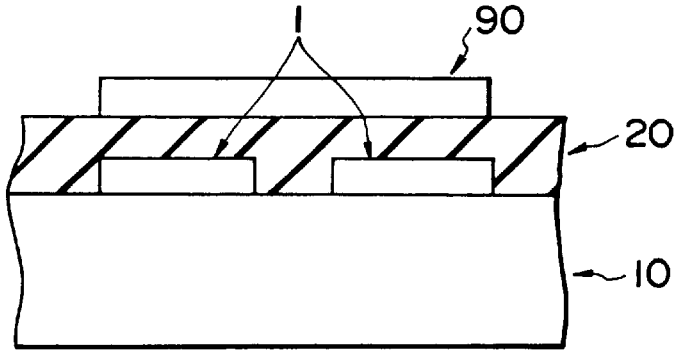

FIG. 59 is a sectional view showing an electronic device which comprises a semiconductor substrate 10, an active element 90 formed on the substrate 10, and a planar magnetic element according to the fifth aspect of the invention, also formed on the substrate 10. FIG. 60 is a sectional view of another device which comprises a semiconductor substrate 10, an active element 90 formed in the substrate 10, an insulative layer 20 formed on the substrate 10, a wiring layer 95 formed on the insulation layer 20, an insulation layer 20 covering up the wiring layer 95, and two planar magnetic elements 1 according to the fifth aspect of the invention, formed on the insulation layer 20. FIG. 61 is a sectional view showing an electric device which comprises a semiconductor substrate 10, two planer magnetic elements 1 according to the fifth aspect of the invention, formed on the substrate 10, an insulation layer covering up the planar magnetic elements 1, and an active element 90 formed on the layer 20. In these devices, the substrate 10, the active element 10, and the magnetic element or elements 1 are electrically connected by means of contact holes (not shown).

Not only the planar magnetic elements according to the fifth aspect, but also the planar magnetic elements according to any other aspect of the invention, each being either an inductor or a transformer, which comprises at least one planar coil, can be formed on a semiconductor substrate, along with active elements and passive elements, constituting an integrated circuit.

At last, but not least, the planar magnetic elements according to the sixth aspect of the present invention will be described, with reference to FIGS. 62A to 64.

Figure 62A:
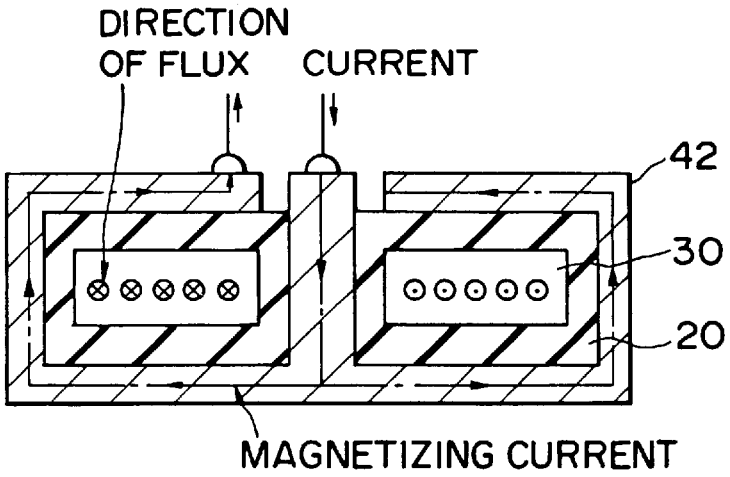
Figure 62B:
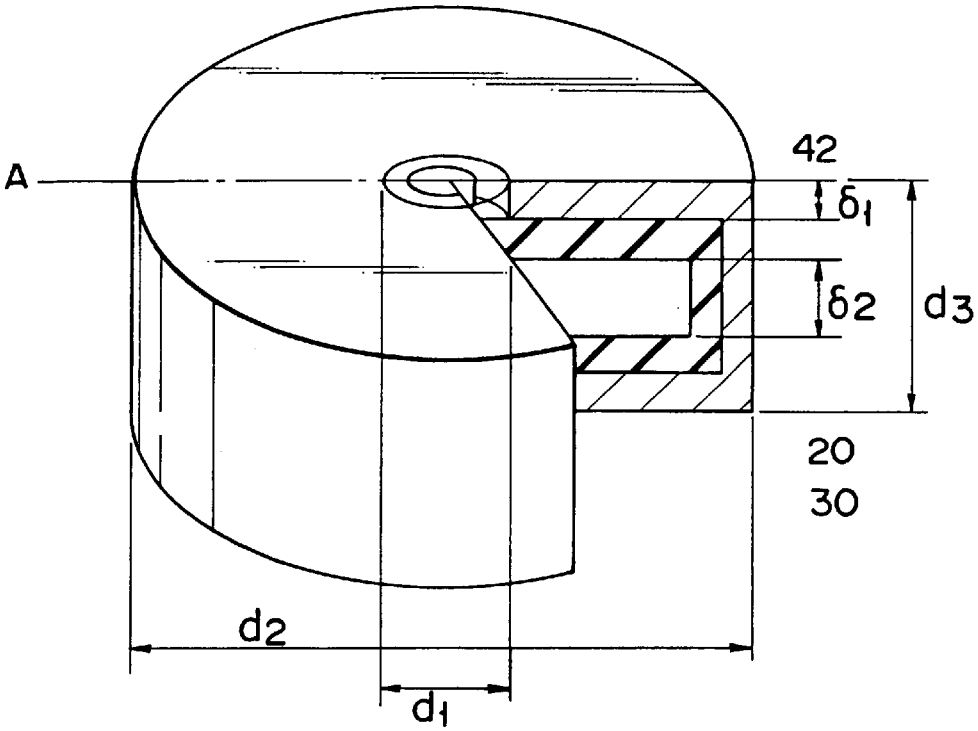
FIG. 62B is a partly sectional, perspective view showing the one-turn coil of FIG. 62A.

FIGS. 62A and 62B are a sectional view and a partly sectional perspective view, respectively, showing a one-turn coil according to the sixth aspect of the invention. As is shown in FIG. 62A, this one-turn coil comprises a hollow disk-shaped conductor 42, a hollow annular insulator 20 fitted in the conductor 42, and an annular magnetic member 30 embedded in the insulator 20. The hollow conductor 42 has a large cross-section at any portion. Thus, a large current can flow through the conductor 42 to magnetize the magnetic member 30. As is evident from FIGS. 62A and 62B, this one-turn coil has a completely shielded core, whereas the planar magnetic element of FIG. 17 has a partly exposed core. Virtually no magnetic fluxes generated by the magnetic member 30 leak from the one-turn coil. This one-turn coil has a current capacity far greater than those of the planar magnetic elements of FIGS. 17 an 18, though the element of FIG. 17 has a higher inductance at frequencies of less than 1 MHz, and the element of FIG. 18 has a higher inductance at frequencies of more than 1 MHz.

The one-turn core illustrated in FIGS. 62A and 62B has an inductance L which is represented as:

$$L=2\mu_s\cdot\delta_2\ \ln(d_1/d_2)\times10^{-7}$$

where $\mu_2$ is the specific permeability of the magnetic member 30, $d_1$ is the diameter of the pole-like portion of the conductor 42, d2 is the outside diameter of the disk-shaped conductor 42, and $\delta_2$ is the thickness of the magnetic member 30.

The DC resistance $R_{DC}$ (Ω) of the one-turn coil is given as follows:

$$R_{DC}=(\rho/\pi\delta_1)\ln(d_1/d_2)$$

where ρ is the resistivity of the conductor 40.

If the conductor 42 is made of aluminum which has a permissible current density of $10^8$ A/m$^2$, the permissible current (Imax) of the one-turn coil shown in FIGS. 62A and 62B is:

$$I\max=\pi\times10^8 d_1 d_2(\mathrm{A})$$

In the case of a planar inductor, which has an ordinary spiral planar coil having the same size as this one-turn coil, the cross section of the conductor of the planar coil is far smaller. Hence, the planar inductor has a permissible current Imax of only tens of amperes.

Figure 63A:
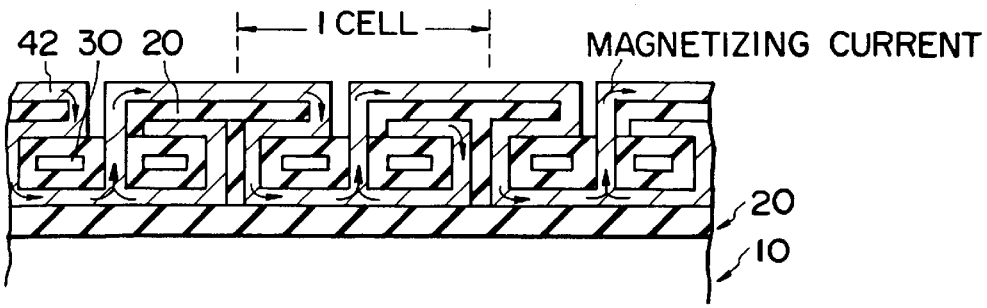
FIG. 63A is a sectional view illustrating one-turn coils of the type shown in FIG. 62A which are connected in series, forming a coil unit.
Figure 63B:
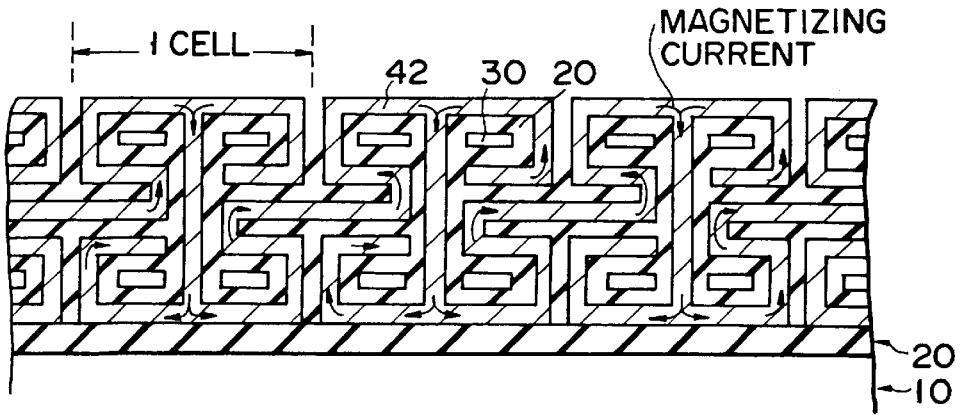
FIG. 63B is a sectional view showing a magnetic element according to the sixth aspect of the invention, which comprises a combination of two coil units of the type shown in FIG. 63A.

A plurality of one-turn coils of the type shown in FIGS. 62A and 62B can be connected in series, to form a coil unit. FIG. 63A is a sectional view illustrating such a coil unit. Obviously, this coil unit has a very high inductance. Further, a plurality of coil units of the type shown in FIG. 63A can be mounted one upon another, as is illustrated in FIG. 63B, thereby constituting a thicker coil unit, which has a higher inductance per unit area, than the coil unit shown in FIG. 63A.

Figure 64:
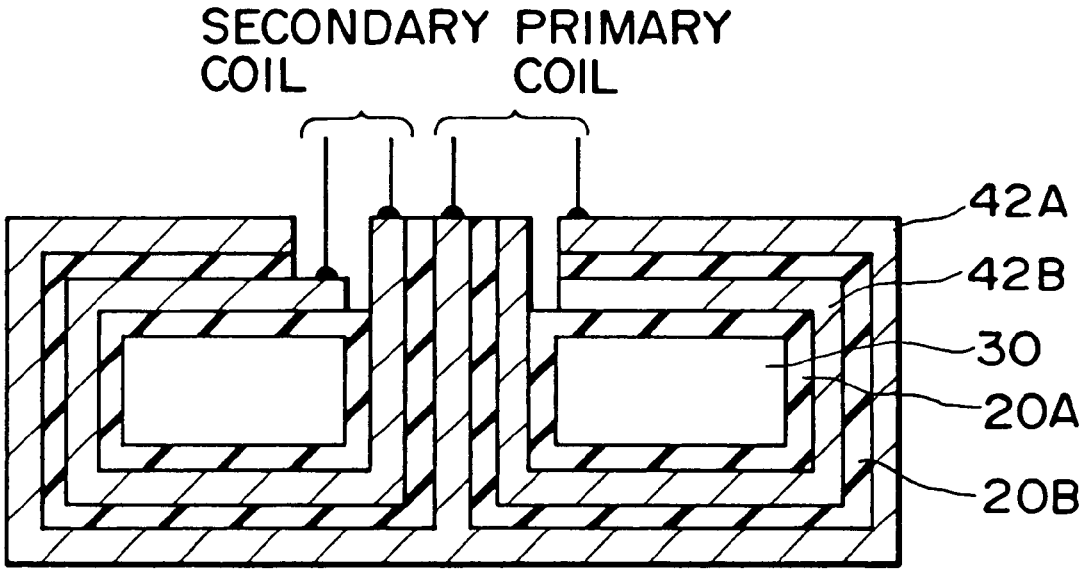

The one-turn coil shown in FIGS. 62A and 62B can be modified into a planer transformer of the type shown in FIG. 64. The planar transformer of FIG. 64 is characterized in that two hollow disk-shaped conductors 42A and 42B, used as primary coil and secondary coil, respectively, surround a magnetic member 30, with one insulator 20A covering the magnetic member 30 and another insulator 20B interposed between the conductors 42A and 42B. Two sets of hollow disk-shaped conductors can be used, the first set forming a primary coil, and the second set forming a secondary coil. The number of the first-group conductors and the number of the second-group conductors are determined in accordance with a desired winding ratio of the transformer.

The planar magnetic elements according to the six aspects of the invention have been described and explained in detail. According to the invention, the elements of different aspects, each having better characteristic than the conventional ones, can be used in any possible combination, thereby to provide new types of planar elements which have still better characteristics and which have better operability.

Selection of the Materials

Materials for the components (i.e., the substrate 10, the insulation members 20, the magnetic members 30, and the conductor 42) of the, planar magnetic elements according to the present invention will be described.

The coil conductor 42 is made of a low-resistivity metal such as aluminum (Al), an Al-alloys, copper (Cu), a Cu-alloys, gold (Au), or an Au-alloy, silver (Ag), or an Ag-alloy. Needless to say, materials for the conductor 42 are not limited to these examples. The rated current of the planar coil made of the coil conductor 42 is proportional to the permissible current density of the low-resistivity material of the conductor 42. Hence, it is desirable that the material be one which is highly resistant to electron migration, stress migration, or thermal migration, which may cut the coil conductor.

The magnetic members 30 are made of the material selected from many in accordance with the characteristics of the inductor or the transformer comprising these members 30 and also with the frequency regions in which the planar inductor or transformer comprising these members 30 are to be operated. Examples of the material for the members 30 are: permalloy, ferrite, (SENDUST), various amorphous magnetic alloys, or magnetic single crystal. If the inductor or transformer is used as a power-supply element, the members 30 should be made of material having a high saturation magnetic flux density.

The magnetic members 30 can be made of composite material. For instance, they can be each a laminate consisting of FeCo film and $SiO_2$ film, an artificial lattice film, a mixed-phase layer consisting of FeCo phase and $B_4C$ phase, or a particle-dispersed layer. If the magnetic members are formed on the coil conductor 42, they be electrically insulative. However, if the magnetic members are electrically conductive, an insulation layer must be interposed between them, on the one hand, and the coil conductor 42, on the other hand.

In order to eliminate the influence of the saturation of the magnetic members, it is desirable that the magnetic members be positioned, with their axes of difficult magnetic field aligned with the axis of magnetization of the planar coil, and generate an anisotropic magnetic field more intense than the magnetic field generated from the coil current. More specifically, the magnetic members should better be made of material which has high saturation magnetization and has an anisotropic magnetic field Hk having an appropriate intensity. Also, in order to minimize the stress effect resulting from the multilayered structure, it is preferable that the magnetic members be made of material having a small magnetostriction (e.g., $\lambda s<10^{-6}$).

Figure 65:
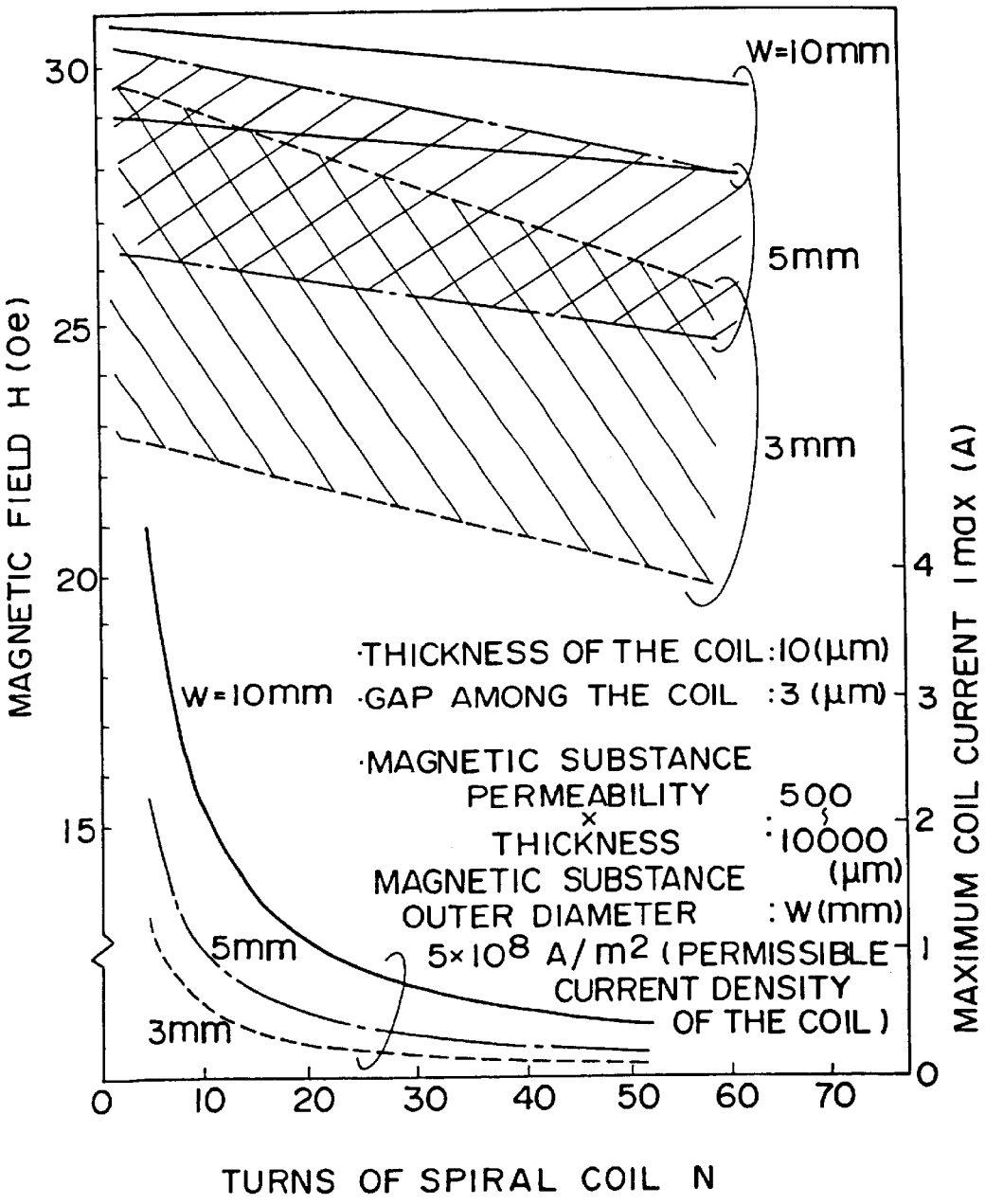
FIG. 65 is a diagram explaining the criterion of selecting a material for magnetic layers, and representing the relationship between the number of turns of a spiral planar coil, on the one hand, and the maximum coil current Imax and the intensity (H) of the magnetic field generated by supplying the current Imax to the spiral planar coil, on the other hand.

The criterion of selecting a material for magnetic members will now be explained, with reference to FIG. 65 which represents the relationship between the number of turns of a spiral planar coil, on the one hand, and the maximum coil current and the intensity (H) of the magnetic field generated from the permissible current flowing through the coil, on the other hand. This diagram has been prepared based on the experiment, wherein planar magnetic elements of various sizes were tested. Each of these elements comprises a planar coil having a different number of turns, two magnetic member having a different size, and two insulation layers each interposed between the coil and one of the magnetic layers. The coils incorporated in these elements are identical in the conductor used and the gap distance between the turns. The conductor is an Al—Cu alloy one having a thickness of 10 $\mu$m and a permissible current density of $5\times10^8$ A/m$^2$. The gap between the turns is 3 $\mu$m. The insulation layers have a thickness of 1 $\mu$m.

The magnetic field generated when the permissible current is supplied to the coil has an intensity of about 20 to 30 Oe at most. If the maximum coil current is set at 80% of the permissible current, then a magnetic field whose intensity is 16 to 40 Oe at most is applied to the magnetic members. In this case, the magnetic members need to have an anisotropic magnetic field Hk having an intensity of 16 to 24 Oe.

The intensity of the anisotropic magnetic field depends on the structural parameters of the magnetic element. Hence, the anisotropic magnetic field is not limited to one having an intensity of 16 Oe to 24 oe. Generally, it is preferred that this magnetic field have an intensity of 5 Oe or more to nullify the influence of the saturation of the magnetic members.

The material for the substrate 10 is not limited, provided that at least that surface of the substrate 10, which contacts a magnetic member or a conductor, is electrically insulative. However, to promote the readiness for micro-processing and facilitate the production of a one-chip device, it is desirable that the substrate 10 be made of semiconductor. When the substrate 10 is made of semiconductor, its surface must be rendered insulative, by forming an oxide film on it.

The insulation layers 20 can be made of an inorganic substance such as $SiO_2$ or $Si_3N_4$, or an organic substance such as polyimide. To reduce the inter-layer capacitive coupling, the layers 20 should better be made of material having as low a dielectric coefficient as possible. The layers 20 must be thick enough to maintain the magnetic anisotropy of either magnetic layer 30, despite the magnetic coupling between the magnetic layers 30. Their optimum thickness 20 depends on the material of the magnetic layers 30.

EXAMPLE 1

A magnetic element of the type shown in FIG. 6 was produced in the following method, and was tested for its characteristics.

The surface of a silicon substrate was thermally oxidized, thus forming a first $SiO_2$ film having a thickness of 1 μm. A Sendust film having a thickness of 1 μm was formed on the $SiO_2$ film by means of sputtering. Then, a second $SiO_2$ film having a thickness of 1 μm was formed on the Sendust film, also by sputtering.

An Al—Cu alloy layer having a thickness of 10 μm, which would be used as a coil conductor, was formed on the second $SiO_2$ film by means of sputtering. A fourth $SiO_2$ film, which had a thickness of 1.5 μm and would be used as an etching mask, was formed on the Al—Cu alloy layer. Further, a positive photoresist was coated on the fourth $SiO_2$ film. Photoetching was performed, thus patterning the the photoresist into one shaped like a spiral coil having turns spaced apart by a gap of 3 μm. $CF_4$ gas was applied to the resultant structure, thereby performing reactive ion etching, using the patterned photoresist as a mask. The exposed portions of the fourth $SiO_2$ film were removed, whereby an $SiO_2$ mask shaped like a spiral coil was formed. Next, $Cl_2$ gas and $BCl_3$ gas were applied to the resultant structure, thus performing low-pressure magnetron reactive ion etching. As a result, the exposed portions of the Al—Cu alloy layer were etched away, thereby forming a spiral coil conductor.

Simultaneously with the magnetron reactive ion etching, vertical anisotropic etching was achieved on the Al—Cu alloy layer. This etching was successful since the etching ratio of the Al—Cu alloy is 15 with respect to the $SiO_2$ mask and the first, second, and third $SiO_2$ films.

As a result, a square spiral planar coil was made which had a width of 2 mm, 20 turns, a conductor width of 37 μm, a conductor thickness of 10 μm, and an interturn gap of 3 μm. The gap aspect ratio of the spiral coil was 3.3 (=10 μm/3 μm).

Thereafter, the photoresist and the $SiO_2$ mask were removed. An $SiO_2$ film was formed on the surface of the entire structure by means of bias sputtering, thus filling the gaps among the turns with $SiO_2$. Etch-back method was performed, thereby making the upper surface of this $SiO_2$ film flat. Then, a Sendust film having a thickness of 1 μm was formed on this $SiO_2$, and a protection layer made of $Si_3N_4$ was formed on the Sendust film. As a result, a planar inductor was manufactured.

The planar inductor, thus produced, was tested by means of an impedance meter. At frequency of 2 MHz, the inductor exhibited a resistance (Ω) of 5.8Ω, an inductance (L) of 3.78 μH, and a quality coefficient (Q) of 8.

Further, the planar inductor was incorporated into a step-down chopper DC-DC converter and used as output choke coil. The DC-DC converter had an input voltage of 10 V, an output voltage of 5 V, and an output power of 500 mW. The DC-DC converter was tested to see how the planer inductor worked. The inductor functioned well. The power loss attributable to the planar inductor was 58 mw, and the power loss attributable to the other elements (e.g., semiconductor elements) was 156 mW. The operating efficiency of the DC-DC converter was 70% at the rated load.

A comparative planar inductor was produced by the same method as described above. The comparative inductor, however, was different in that its Al—Cu alloy conductor had a width of 21 μm, an inter-turn gap of 20 μm, and a thickness of 4 μm. Hence, the gap aspect ratio of the spiral coil incorporated in the comparative planar inductor was 0.2. The comparative inductor was tested by means of the impedance meter. At frequency of 2 MHz, it exhibited a resistance (R) of 10.3Ω, an inductance (L) of 3.7 μH, and a quality coefficient (Q) of 4.5. The comparative inductor was incorporated into a stepdown chopper DC-DC converter of the same type described above, and was used as output choke coil. The DC-DC converter was tested. It was found that the power loss attributable to the comparative planar inductor was 103 mW, and that the operating efficiency of the DC-DC converter was only 65%.

EXAMPLE 2

A planar transformer comprising two two square spiral planar coils and two magnetic layers was produced by the same method as the planer inductor of Example 1. The first coil, used as primary coil, had a width of 2 mm, 20 turns, a conductor width of 37 μm, a conductor thickness of 10 μm, an inter-turn gap of 3 μm, and a gap aspect ratio of 3.3. The second coil, used as secondary coil, was identical to the first coil, except that it had 40 turns. The magnetic layers were spaced apart by a distance of 23 μm.

The planar transformer was tested, using an impedance meter, for its electric characteristics. It had a primary-coil inductance of 3.8 μH, a secondary-side inductance of 14 μH, a mutual inductance of 6.8 μH, and a coupling coefficient of 0.93.

A 500 kHz sine-wave voltage having an effective value of 1 V was applied to the first coil of the planar transformer. As a result, the second coil generated a sine-wave voltage having an effective value of 1.7 V. When a purely resistive load of 200Ω was connected to the planar transformer, the voltage fluctuation of about 10% was observed.

The planar transformer was incorporated in a forward-type DC-DC converter which operated at 2 MHz switching frequency. and the DC-DC converter was tested. The DC-DC converter had an input voltage of 3 V, an output voltage of 5 V, and an output power of 100 mW. The DC-DC converter was tested to see how the planar transformer works. The test results showed that the power loss attributable to the transformer was 88 mW at the rated load of the DC-DC converter.

Further, in order to evaluate the ability of the planar transformer, a comparative planar transformer was made by the same method as described above, which comprised two square spiral planar coils and two magnetic layers. The first coil, used as primary coil, had a width of 2 mm, 20 turns, a conductor width of 37 μm, a conductor thickness of 10 μm, an inter-turn gap of 10 μm, and a gap aspect ratio of 1.0. The second coil, used as secondary coil, was identical to the first coil, except that it had 40 turns. The magnetic layers were spaced apart by a distance of 23 μm.

A 500 KHz sine-wave voltage having an effective value of 1 V was applied to the first coil of the comparative planar transformer. As a result, the second coil generated a sine-wave voltage having an effective value of 1.3 V. The voltage at the second coil is lower than in the planar transformer according to the invention. This is because the voltage drop at the first coil was great due to the high resistance of the first coil. Inevitably, the gain of the comparative transformer is less than that of the planar transformer according to the present invention.

When a purely resistive load of 200Ω was connected to the comparative planar transformer, the voltage fluctuation of about 18% was observed.

The comparative planar transformer was incorporated in a forward-type DC-DC converter of the same type described above. The DC-DC converter was tested to see how the comparative transformer works. The test results revealed that the power loss attributable to the trans former was 152 mW at the rated load of the DC-DC converter.

EXAMPLE 3

A magnetic element of the type shown in FIGS. 12A and 12B was produced in the following method, and was tested for its characteristics.

An $SiO_2$ insulation layer having a thickness of 1 μm was formed on a silicon substrate. Then, an aluminum layer having a thickness of 5 μm and a resistivity of $2.8\times10^{-6}$ Ωcm was formed on the $SiO_2$ layer by means of sputtering. The aluminum layer was subjected to photoresist etching, and was thereby patterned into a spiral planar coil having 200 turns. The coil had an inside diameter of 1 mm and an outside diameter of 5 mm. The coil consisted of 200 turns arranged at intervals of 10 μm, each having a width of 5 μm. Hence, its conductor aspect ratio was 1. The spiral planar coil had a resistance of 120Ω and an inductance of 0.14 mH.

The spiral planar coil, thus formed, was incorporated into a 0.1 W-class step-down chopper DC-DC converter whose operating frequency is 300 KHz. The DC-DC converter was tested to determine the performance of the planar coil. The planar coil was found to function as an inductor in the DC-DC converter.

A comparative spiral planar coil was made in the same method as described above. The comparative coil had the same inside and outside diameters as the spiral planar coil according to the invention. It had 130 turns arranged at intervals of 15 μm, each having a width of 10 μm. Hence, its conductor aspect ratio was 0.5. The comparative spiral planar coil had an inductance of 0.05 mH.

EXAMPLE 4

A spiral planar coil was made in the same method as Example 3, except that it comprised a Co—Si—B amorphous alloy conductor having a thickness of 2 μm and two $SiO_2$ layers sandwiching the conductor and having a thickness of 2 μm. The spiral planar coil had an inductance of 2 mH.

EXAMPLE 5

A planer transformer was produced which had two spiral planar coil located one above the other. The first (or lower) coil, used as primary coil, was identical to Example 4. The second coil (or upper) coil, used as secondary coil, was located substantially concentric with the first coil. It had 100 turns arranged at intervals of 20 μm, each having a thickness of 5 μm and a width of 5 μm. The conductor aspect ratio of the second coil was 1. The planar transformer was tested. The test results showed that the voltage ratio of this transformer was 2, which is equal to the ratio of the turns of the primary coil to the turns of the secondary coil.

EXAMPLE 6

A planar magnetic element identical, in structure, to Example 3 was made by a different method. First, an $SiO_2$ layer having a thickness of 4 μm on a silicon substrate. Then, a single-crystal aluminum layer, which had a thickness of 10 μm and a resistivity of $2.6\times10^{-6}$ cm) was formed on the $SiO_2$ layer by means of MBE method. The aluminum layer was subjected to photoresist etching, and was patterned into a spiral planar coil having an inside diameter of 1 mm and an outside diameter of 5 mm. This coil had 200 turns, each having a width of 5 μm, arranged at intervals of 10 μm. Hence, the coil had a conductor aspect ratio of 2. It had a resistance of 50Ω and an inductance of 0.14 mH.

The resistance of this coil was lower than that of Example 3. Therefore, the coil had a permissible current greater than that of Example 3. In view of this, the coil is suitable for use in large-power devices.

EXAMPLE 7

A planar magnetic element identical, in structure, to Example 3 was made by a different method. First, an $SiO_2$ layer having a thickness of 1 μm was formed on a silicon substrate. An Al—Si—Cu alloy layer having a thickness of 1 μm was formed on the $SiO_2$ layer by means of vapor deposition. Next, an $SiO_2$ layer having a thickness of 1 μm was formed on the Al—Si—Cu alloy layer by CVD method. A resist pattern was formed on this $SiO_2$ layer. The Al—Si—Cu alloy layer was cut by means of a magnetron RIE apparatus, thus forming a meandering square coil having an inside diameter of 1 mm and an outside diameter of 4 mm.

Further, an $SiO_2$ layer was formed on the meandering square coil, by means of plasma CVD method wherein monosilane ($SiO_4$) and nitrous oxide ($N_2O$) were used as materials. (The speed of growing the $SiO_2$ layer on the coil depended on the feeding rate of these materials.) The $SiO_2$ layer was formed, such that the gaps among the turns of the coil were bridged with this layer, thus forming cavities successfully, thanks to the narrow inter-turn gap of 1 μm and the large conductor aspect ratio of 2.5. The resultant planar magnetic element has an inductance of 1.6 mH.

Due to the cavities thus formed, the inter-turn capacitance was much greater than in a comparative planar magnetic element wherein the inter-turn gaps are filled with $SiO_2$, and the high-frequency characteristic was far better than in the comparative element. The inductance of the planar magnetic element did not decrease until the operating frequency was raised to 10 MHz, whereas the inductance of the comparative element sharply decreased at the operating frequency of about 800 KHz.

EXAMPLE 8

A planar magnetic element according to the second aspect of the invention was made by the method explained with reference to FIGS. 13A to 13D, which had cavities between the turns of the spindle planar coil.

First, an $SiO_2$ layer having a thickness of 1 μm was formed on a silicon substrate by thermal oxidation. Then, an aluminum layer having a thickness of 1 μm was formed on the $SiO_2$ layer. The resultant structure was left to stand in the atmosphere, whereby the surface of the aluminum layer was oxidized, forming an aluminum oxide film having a thickness of about 30 Å. Four other aluminum layers having a thickness of 1 μm were formed, one upon another. Each of these aluminum layers, but the uppermost one, was surface-oxidized in the same way as the first aluminum layer, thus forming an aluminum oxide film having a thickness of about 30 Å. As a result, a conductor layer having a thickness of 5 μm was formed on the $SiO_2$ layer.

Thereafter, a silicon oxide layer was formed on the conductor layer by plasma CVD. The resultant structure was subjected to dry etching, thereby forming a square meandering coil having a width of 5 mm. The meandering coil had 1000 repeated portions, each having a width of 2 μm and spaced apart from the next one by a distance of 0.5 μm. Then, a silicon oxide layer was formed on the meandering coil, thus forming cavities among the repeated portions.

A step-up chopper DC-DC converter whose input and output voltages were 1.5 V and 3 V, respectively, and whose output current was 0.2 mA was formed on the same silicon substrate, near the meandering coil, thereby manufacturing a one-chip DC-DC converter having a size of 10 mm (length)×5 mm (width)×0.5 mm (thickness).

The operating frequency of the switching element incorporated in the DC-DC converter was 5 MHz. The one-chip DC-DC converter was tested for its performance. The test results showed that it had functioned fully. However, its could not work well at a frequency of 500 KHz, due to the lack in impedance.

Figure 66:
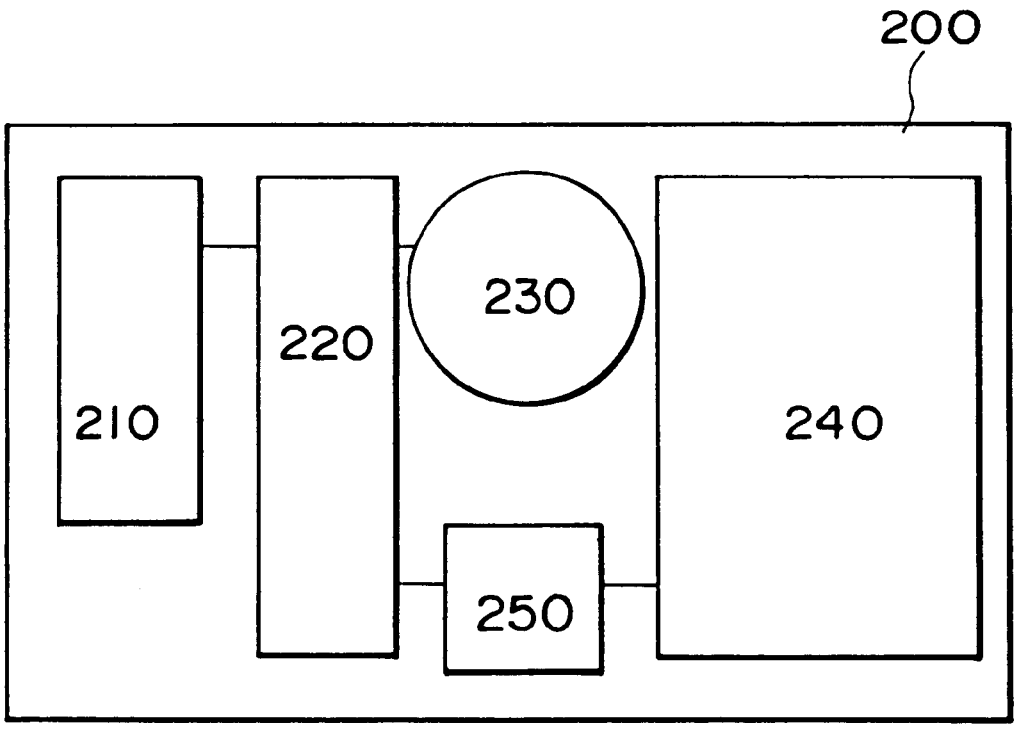
FIGS. 66 to 72 are diagrams illustrating various devices incorporating the magnetic elements of the invention.

The one-chip DC-DC converter was thin, so thin as to help produce a card-shaped pager, which has hitherto been difficult to accomplish. FIG. 66 schematically shows a card-shaped pager comprising the one-chip DC-DC converter according to the present invention. This pager comprises, besides the one-chip DC-DC converter 240, a substrate 200, an antenna 210, an operating circuit 220, an alarm device 230 (e.g., a piezoelectric buzzer). The components 210, 220, 230, and 240 are mounted on the substrate 200. Although not shown in FIG. 66, the pager further comprises a cover covering and protecting the components 210, 220, 230 and 240.

EXAMPLE 9

A planar magnetic element according to the third aspect of the invention, which is of the type shown in FIG. 23, was produced and tested for its ability. The element was manufactured by the following method.

First, a copper foil having a thickness of 100 $\mu$m was adhered to a first polyimide film. The copper foil was patterned into a spiral planer coil, by means of wet chemical etching. Then, a second polyimide film having a thickness of 7 $\mu$m was formed on the spiral planar coil. Two Co-based amorphous alloy foils having a thickness of 5 $\mu$m were formed on the first and second polyimide films, respectively. As a result, the first and second polyimide films sandwiched the coil, and the Co-based amorphous alloy foils sandwiched the coil and the polyimide films together, whereby a planar inductor was formed. The coil had a width $a_0$ of 11 mm. The permeability of the Co-based amorphous alloy foil was estimated to be 4500, and the distance a was about 1 mm since the gap among the turns of the coil was 114 $\mu$m. The Co-based foils, used as magnetic layers, had a width w of 15 mm ($=a_0+4\alpha$).

A DC current of 0.1 A was supplied to the planar inductor, and the leakage magnetic field in the vicinity of the planar inductor was measured by a high-sensitivity Gauss meter. The intensity of the leakage magnetic field was low, well within the detectable limits of the Gauss meter.

To determine whether the intensity of the leakage magnetic field, thus measured, was sufficiently low, in comparison with the magnetic fields leaking from the conventional planar inductors, a comparative planar inductor was produced by the same method as Example 9. The comparative inductor differs in that its magnetic layers had a width w of 12 mm ($=a_0+\alpha$). A DC current of 0.1 A was supplied to the comparative inductor, and the leakage magnetic field in the vicinity of the coil was measured by the same high-sensitivity Gauss meter. The leakage magnetic field had an intensity as high as about 30 gauss.

EXAMPLE 10

A planar magnetic element according to the third aspect of the invention was produced. This element was of the type shown in FIG. 29 and was a combination of Example 9 and the means according to the fourth aspect of the invention.

First, a first Co-based amorphous magnetic film having a thickness of 1 $\mu$m was formed on a semiconductor substrate by RF magnetron sputtering. A first insulation film ($SiO_2$) having a thickness of 1 $\mu$m was formed on the first magnetic film by RF sputtering. An Al—Cu alloy film having a thickness of 10 $\mu$m was formed on the insulation film by means of RF magnetron sputtering. The resultant structure was subjected to magnetron reactive ion etching, thereby patterning the Al—Cu alloy film into a spiral planar coil. A second insulation film ($SiO_2$) was formed on the top surface of the structure by bias sputtering, filling up the gaps among the coil turns and covering the coil entirely. The surface of the second insulation film was processed and rendered flat. A second Co-based amorphous magnetic film having a thickness of 1 $\mu$m was formed on the second insulation film by means of RF magnetron sputtering. As a result, a planar inductor was made.

The permeabilities of both Co-based amorphous magnetic films were measured by a magnetometer of sample-vibrating type. The permeability, thus measured, was about 1000. The spiral planar coil had a width $a_0$ was 4.5 mm, and the gap among the coil turns was 12 $\mu$m. From this inter-turn gap, the distance a was estimated to be 77 $\mu$m. Hence, the Co-based amorphous magnetic films were made to have a width w of 5 mm ($=a_0+6.5\alpha$). A DC current of 0.1 A was supplied to the planar inductor, and the leakage magnetic field in the vicinity of the planar inductor was measured by the high-sensitivity Gauss meter. The intensity of the leakage magnetic field was low, well within the detectable limits of the Gauss meter.

To determine whether the intensity of the leakage magnetic field, thus measured, was low enough, a comparative planar inductor was made by the same method as Example 10. The comparative inductor differed in that its magnetic layers had a width w of 4.6 mm ($=a_0+1.3\alpha$). A DC current of 0.1 A was supplied to the comparative inductor, and the leakage magnetic field in the vicinity of the inductor was measured by the high-sensitivity Gauss meter. The leakage magnetic field had an intensity as high as about 50 gauss.

EXAMPLE 11

Planar inductors having different values w (i.e., the width of the magnetic layers) were produced by same method as Example 9. These inductors were tested for their respective inductances. The planar inductor having a w value of 15 mm exhibited an inductance of 90 $\mu$H, about 1.3 times higher than that of the planar inductor whose w value was 12 mm. This increase in inductance was also observed in the planar inductor of Example 10.

EXAMPLE 12

Using the planar inductor of Example 9, a hybrid step-down chopper IC converter was fabricated which comprised switching elements (power MOSFETs), rectifying diodes, and a constant-voltage control circuit. The switching frequency of the IC converter was 100 KHz. Its input and output voltages were 10 V and 5 V, respectively, and its output power was 2 W. The planar inductance exhibited an inductance of 80 $\mu$H or more, thus functioning an output-controlling choke coil. As a matter of fact, when the IC converter was operated, the planar inductor worked well as a choke coil. There occurred but a little linking in the switching waveform of the MOSFETs. The output ripple voltage at the rated output (5 V, 0.5 A) had a peak value of about 10 mV, which was far from problematical.

To compare the ability of the planar inductor of Example 9 used as a choke coil, the comparative planar inductor, made for comparison with the inductor of Example 4, was incorporated in a hybrid DC-DC IC converter of the same type. This IC converter was operated. A great linking was found in the switching waveform of the MOSFETs. This is perhaps because a considerably intense magnetic field leaked from the comparative planar inductor. Further, the output ripple voltage at the rated output (5 V, 0.5 A) had a peak value of as much as 0.1 V, probably because the inductor failed to have an inductance of 80 $\mu$H and, hence, could not suppress the ripple.

EXAMPLE 13

A planer magnetic element according to the fourth aspect of the invention was produced which was of the type illustrated in FIG. 33, by the following method.

First, a copper foil having a thickness of 100 $\mu$m was adhered to a first polyimide film having a thickness to 30 $\mu$m. The copper foil was patterned by wet etching, into a rectangular spiral planer coil having 20 turns, a conductor width of 100 $\mu$m, and an interturn gap of 100 $\mu$m. A second polyimide film having a thickness of 10 $\mu$m was formed on the planar coil. Hence, the coil was sandwiched between the first and second polyimide films. Then, the resultant structure was sandwiched between first and second Co-based amorphous magnetic films both having a uniaxial magnetic anisotropy. These magnetic films had been prepared by forming Co-based amorphous magnetic films by rapidly quenching method using single roller, and by annealing these films in a magnetic field. Either magnetic film had an anisotropic magnetic field of 20 Oe, a permeability of 5000 along the hard axis of magnetization, and a saturation magnetic flux density of 10 kG. The structure consisting of the coil, two polyimide films, and two magnetic films was sandwiched between a third polyimide film and a fourth polyimide film, either having a thickness of 5 $\mu$m. Further, the resultant structure was sandwiched between third and fourth Co-based amorphous magnetic films, either exhibiting uniaxial magnetic anisotropy and having a thickness of 15 $\mu$m, thereby forming a planar inductor having a width of 10 mm. The first and second magnetic films were positioned with, their axes of easy magnetization aligned. The third and fourth magnetic films were arranged such that their axes of easy magnetization intersected with those of the first and second magnetic films.

The superimposed DC current characteristic of the planar inductor, thus produced, was evaluated. The inductance of the planar inductor remained unchanged at 12.5 $\mu$H until the input current was increased to 400 mA. It started decreasing at the input current of 500 mA or more.

The planar inductor was used as output choke coil in a step-down chopper DC-DC converter whose input and output voltages were 12 V and 5 V, respectively. The DC-DC converter had a switching-frequency of 500 KHz and could output a load current up to 400 mA. Its maximum output power was 2 W, and its operating efficiency was 80%.

A comparative planar inductor 13*a* was made in the same method as Example 13, except that the Co-based amorphous magnetic ribbons were ones not further processed after the rapidly quenching method. Another comparative planar inductor 13*b* was made in the same method as Example 13, except that the Co-based amorphous magnetic ribbons were ones annealed but not in a magnetic field whatever. The magnetic sheets of the inductor 13*a* had permeability of 2000, whereas those of the inductor 13*b* had permeability of 10000. The magnetic sheets of neither comparative inductor exhibited unequivocal magnetic anisotropy.

The superimposed DC current characteristics of Example 13 and the comparative inductors 13*a* and 13*b* were measured. The comparative inductor 13*b* had an inductance higher than that of Example 13. However, its inductance remained constant until the DC current was increased to 200 mA only, and much decreased when the DC current was over 250 mA. On the other hand, the inductance of the comparative inductor 13*a* was lower than that of Example 13, started gradually decreasing at a small DC current. Both comparative inductors 13*a* and 13*b* were inferior to Example 13 in terms of frequency characteristic, too. In particular, their power loss abruptly increased at a frequency of 100 KHz or more. At the frequency of 1 MHz, their quality coefficients Q were half or less the quality coefficient Q of Example 9.

The comparative inductors 13*a* and 13*b* were used as output chopper coil in DC-DC converters of the same type. These DC-DC converters were tested to determine their maximum output powers and operating efficiencies. Their maximum load currents were limited to about 200 mA, inevitably because of the poor superimposed DC current characteristics of the inductors 13*a* and 13*b*. Hence, their maximum output powers were about half that of the DC-DC converter having the inductor of Example 13, and their operating efficiencies were only about 70% of that of the DC-DC converter having Example 13.

EXAMPLE 14

A planer transformer was made whose primary coil had 20 turns and was identical to the spiral planar coil used in the inductor of Example 13, and whose secondary coil was identical thereto, except that it had ten turns. The secondary coil was formed on an insulation layer covering the primary coil. The primary-coil inductance of this transformer exhibited superimposed DC current characteristic substantially the same as the planer inductor of Example 13.

The planar transformer was incorporated into a for ward DC-DC converter whose input and output voltages were 12 V and 5 V, respectively. Further, the planar inductor of Example 13 was used as output choke coil in the forward DC-DC converter. The DC-DC converter was tested for its characteristics. It had a switching frequency of 500 KHz, and obtained a rated output similar to that of the DC-DC converter whose output choke coil was the inductor of Example 13. As a result, the transformer helped to miniaturize insulated DC-DC converters.

Two comparative planer transformer were made. The first comparative transformer was identical to that of Example 14, except that the same magnetic films as those used in the inductor of the comparative inductor 13*a* were incorporated. These second comparative transformer was identical to that of Example 14, except that the same magnetic films as those used in the comparative is inductor 13*b* were incorporated. These comparative planar transformers were tested. Their primary-coil inductances were similar to those of the comparative planar inductors 13*a* and 13*b*, respectively.

These comparative planar transformers were incorporated into forward DC-DC converters of the same type described above, and these DC-DC converters were tested for their characteristics. The results showed that neither DC-DC converter could perform normal power conversion because the comparative planar transformer was magnetically saturated.

EXAMPLE 15

A planar inductor of the type shown in FIG. 35, according to the fourth aspect of the invention, was produced by the following method.

First, one major surface of a silicon substrate was thermally oxidized, thus forming an $SiO_2$ film having a thickness of 1 μm. Then, a CoZrNb amorphous magnetic film having a thickness of 1 μm was formed on the $SiO_2$ film in a magnetic field of 100 Oe by means of an RF magnetron sputtering apparatus. This CoZrNb film exhibited a uniaxial magnetic anisotropy and emanating an anisotropic magnetic field of 50 Oe. Next, an $SiO_2$ film having a thickness of 500 nm was deposited on the magnetic film by plasma CVD or RF sputtering. Three other CoZrNb films and three other $SiO_2$ films were formed in the same method, thereby providing multi-layer structure consisting of four magnetic films and four insulation films, which were alternately formed one upon another. The uppermost $SiO_2$ film had a thickness of 1 μm. Any adjacent two magnetic films were so formed that their axes of easy magnetization intersect with each other at right angles.

Then, an Al-0.5%Cu film having a thickness of 10 μm was formed on the uppermost $SiO_2$ film, by either a DC magnetron sputtering apparatus or a ultra high-vacuum vapor-deposition apparatus. An $SiO_2$ film having a thickness of 1.5 μm was deposited on the Al-0.5%Cu film. A positive-type photoresist was spin-coated on this $SiO_2$ film, and was patterned in a spiral form by means of photolithography. Using the spiral photoresist as a mask, $CF_4$ gas was applied to the surface of the resultant structure, thus carrying out reactive ion etching on the uppermost $SiO_2$ film. Further, $Cl_2$ gas and $BCl_3$ gas were applied to the structure, conducting reactive ion etching on the Al-0.5%Cu film. The Al-0.5%Cu film was thereby etched, forming a spiral planar coil having 20 turns, a conductor width of 100 μm, and an inter-turn gap of 5 μm. A polyamic acid solution, which is a precursor of polyimide, was spin-coated on the surface of the resultant structure, forming a film having a thickness of 15 μm and filling the gaps among the turns of the coil. This film was cured at 350° C., and was made into a polyimide film. $CF_4$ gas and $O_2$ gas were applied to the structure, thus performing reactive ion etching on the polyimide film to the thickness of 1 μm measured from the top of the coil conductor.

Thereafter, four insulation layers and four magnetic layers were alternately formed, one upon another, in the same method as described above. Each adjacent pair of the magnetic films were so formed that their axes of easy magnetization intersect each other at right angles, like those formed below the spiral planar coil.

During the manufacture of the planar inductor, each magnetic film was repeatedly heated and cooled, but it remained heat-resistant. Its magnetic property was virtually unchanged after the manufacture of the inductor. In other words, the heat applied while producing the inductor imposed but an extremely little influence on the magnetic properties of the magnetic films.

The electric characteristics of the planar inductor, thus made, were evaluated. The inductor had an inductance L of 2 μH and a quality coefficient Q of 15 (at 5 MHz). The inductor was tested for its superimposed DC current characteristic, and its inductance remained constant until the superimposed DC current was increased to 150 mA, and started decreasing when the superimposed DC current was increased to 200 mA.

This planar inductor was used as output choke coil in a step-down chopper DC-DC converter whose input and output voltages were 12 V and 5 V, respectively. The DC-DC converter could output a load current as much as 150 mA at the switching frequency of 4 MHz. Its maximum output power was 0.75 W, and its operating efficiency was 70%.

Another planar inductor was produced which was identical to the one described above, except that the insulation layer filling the gaps among the coil turns was formed of $SiO_2$, not polyimide, by means of either CVD method or bias sputtering. This planar inductor exhibited electric characteristics similar to those of the planar inductor described above.

A comparative planar inductor was made in the same method as the inductor of Example 15, except that the CoZrNb amorphous magnetic films were not formed in a magnetic field. Each of the magnetic films thus formed exhibited a permeability of 10000, and exhibited unequivocal magnetic anisotropy. The comparative inductor had an inductance about five times higher than that of the inductor of Example 15. Its inductance, however, remained constant until the DC current was increased to 10 mA only; it started increasing significantly when a current of 20 mA or more was superimposed on the input DC current.

The comparative planar inductor was used as output choke coil in a DC-DC converter of the same type as the inductor of Example 15 was incorporated into. The DC-DC converter, including the comparative inductor, was tested. It had a maximum load current of about 10 mA, because of the poor superimposed DC current characteristic of the comparative inductor. Inevitably, its maximum output power was one tenth or less of the maximum output power of the DC-DC converter having the inductor of Example 15.

EXAMPLE 16

A planer transformer was made whose primary coil had 20 turns and was identical to the spiral planar coil of the inductor of Example 15, and whose secondary coil was identical thereto, except that it had ten turns and was formed on an insulation layer made of polyimide, having a thickness of 2 μm and covering the primary coil. The primary-coil inductance of this transformer exhibited superimposed DC current characteristic substantially the same as the planer inductor of Example 15.

The planar transformer was incorporated into a fly-back DC-DC converter whose input and output voltages were 12 V and 5 V, respectively. Further, the planar inductor of Example 15 was used as output choke coil in the flyback DC-DC converter. The flyback DC-DC converter was tested for its characteristics. Its rated output power was comparable with that of the DC-DC converter having the planar inductor of Example 15. Since all its magnetic elements were planar, the fly-back DC-DC converter was sufficiently small and light.

A comparative planar transformer was produced in the same method as that of Example 16, except that the CoZrNb amorphous magnetic films were formed in no magnetic fields. The primary-coil inductance of this planar transformer was substantially equal to that of the planer inductor which was made for comparison with the inductor of Example 15. The comparative transformer was incorporated in to a flyback DC-DC converter of the same type as described above. When this flyback DC-DC converter was tested, an excessive peak current flowed through the switching power MOSFETs used in the converter because the comparative planar transformer was saturated magnetically. The peak current broke down the MOSFETS.

EXAMPLE 17

A planar inductor of the type illustrated in FIG. 36, according to the fourth aspect of the invention, was made by the following method.

First, a copper foil having a thickness of 100 μm was adhered to a first polyimide film having a thickness to 30 μm.

The copper foil was patterned by wet etching, into a rectangular spiral planer coil having 20 turns, a conductor width of 100 μm, and an interturn gap of 100 μm. A second polyimide film having a thickness of 10 μm was formed on the planar coil. Thus, the planar coil was sandwiched between the first and second polyimide films.

The resultant structure was sandwiched between two rectangular magnetic layers. Either magnetic layer had been formed of four Co-based amorphous magnetic films in the form of isosceles triangles, each having a base of 12 mm and a height of 6 mm. Each of these triangular magnetic films had been prepared by forming Co-based amorphous magnetic film by rapidly quenching method using single roller and by annealing this amorphous magnetic film in a magnetic field of 200 Oe extending parallel to the base of the triangular film. They had an anisotropic magnetic field of 20 Oe, a coercive force of 0.01 Oe along the hard axis of magnetization, a permeability of 5000 along the hard axis of magnetization, and a saturation magnetic flux density of 10 kG. The planar inductor, thus made, had a width of 12 mm.

The superimposed DC current characteristic of the planar inductor was evaluated. The inductance of the inductor remained unchanged at 12.5 μH until the input current was increased to 200 mA. It started decreasing at the input current of 250 mA or more.

The planar inductor was used as output choke coil in a step-down chopper DC-DC converter whose input and output voltages were 12 V and 5 V, respectively. The DC-DC converter had a switching-frequency of 500 KHz and could output a load current up to 200 mA. Its maximum output power was 1 W, and its operating efficiency was 80%.

A comparative planar inductor 17*a* was made in the same method as Example 17, except that the Co-based amorphous magnetic films were ones not further processed after the molten-bath cooling method. Another comparative planar inductor 17*b* was made in the same method as Example 17, except that the Co-based amorphous magnetic films were ones annealed but not in a magnetic field whatever. The magnetic films of the inductor 17*a* had permeability of 2000, whereas those of the inductor 17*b* had permeability of 10000. The magnetic films of neither comparative inductor exhibited unequivocal magnetic anisotropy.

The superimposed DC current characteristics of Example 17 and the comparative inductors 17*a* and 17*b* were measured. The comparative inductor 17*b* had an inductance higher than that of Example 17. However, its inductance remained constant until the DC current was increased to 100 mA only, and much decreased when the DC current was over 120 mA. On the other hand, the inductance of the comparative inductor 17*a* was lower than that of Example 17, started gradually decreasing at a small DC current. Both comparative inductors 17*a* and 17*b* were inferior to Example 17 in terms of frequency characteristic, too. In particular, their power loss abruptly increased at a frequency of 100 KHz or more. At the frequency of 1 MHz, their quality coefficients Q were half or less the quality coefficient Q of Example 13.

The comparative inductors 17*a* and 17*b* were used as output chopper coil in DC-DC converters of the same type. These DC-DC converters were tested to determine their maximum output powers and operating efficiencies. Their maximum load currents were limited to about 100 mA, inevitably because of the poor superimposed DC current characteristics of the inductors 17*a* and 17*b*. Hence, their maximum output powers were about half that of the DC-DC converter having the inductor of Example 17, and their operating efficiencies were only about 70% of that of the DC-DC converter having Example 17.

EXAMPLE 18

A planer transformer was made whose primary coil had 20 turns and was identical to the spiral planar coil of the inductor of Example 17, and whose secondary coil was identical thereto and had been formed by the same method of Example 17 on an insulation layer covering the primary coil, except that it had ten turns. The primary-coil inductance of this transformer exhibited superimposed DC current characteristic substantially the same as the planer inductor of Example 17.

The planar transformer was incorporated into a forward DC-DC converter whose input and output voltages were 12 V and 5 V, respectively. Further, the planar inductor of Example 5 was used as output choke coil in the DC-DC converter. The forward DC-DC converter was tested for its characteristics. When driven at a switching frequency of 500 KHz, the transformer exhibited a rated output power which was comparable with that of the step-down chopper DC-DC converter having the planar inductor of Example 17. obviously, the transformer of Example 17 contributed to miniaturization of insulated DC-DC converters.

A comparative planar transformer was produced which was identical in structure to that of Example 17, except its magnetic films were of the type incorporated in the comparative inductor 17*a*. Another comparative planar transformer was made which was identical in structure to that of Example 17, except its magnetic films of the type incorporated in the comparative inductor 17*b*. The primary-coil inductances of both comparative transformers 18' were substantially the same as that of the planar inductor of Example 17. The comparative transformers 19' were incorporated in to to forward DC-DC converters of the same type as that including the transformer of Example 18. When tested, these DC-DC converters could not perform normal power conversion because their components transformers were magnetically saturated.

EXAMPLE 19

A planar inductor of the type shown in FIG. 36, according to the fourth aspect of the invention, was produced by the following method.

First, one major surface of a silicon substrate was thermally oxidized, thus forming an $SiO_2$ film having a thickness of 1 μm. A negative-type photoresist was spin-coated on the $SiO_2$ film. Photolithography was performed on the photoresist, thereby forming two openings in the photoresist. These openings were in the shape of isosceles triangles contacting at their apecies, each having a base of 5 mm and a height of 2.5 mm. Then, a CoZrNb amorphous magnetic film having a thickness of 1 μm was formed, partly on the photoresist and partly on the exposed portions (either in the shape of an isosceles triangle) of the $SiO_2$ film. The magnetic film was formed in a magnetic field of 100 Oe by means of an RF magnetron sputtering apparatus. It exhibited a uniaxial magnetic anisotropy and emanating an anisotropic magnetic field of 50 Oe. Next, the photoresist was dissolved with a solvent, and was remove from the $SiO_2$ film. As a result, that portion of the magnetic film which was formed on the photoresist was lifted off, and two CoZrNb amorphous magnetic films in the form of isosceles triangles were formed on the $SiO_2$ film.

Thereafter, a photoresist was spin-coated on the upper surface of the resultant structure. Photolithography was conducted on this photoresist, thereby forming two openings in the photoresist. The openings were in the shape of isosceles triangles contacting at their apices, each having a base of 5 mm and a height of 2.5 mm. They are located, with their axes extending at right angles to those of the two CoZrNb amorphous magnetic films already formed on the $SiO_2$ film. Next, a CoZrNb amorphous magnetic film having a thickness of 1 μm was formed, partly on the photoresist and partly on the exposed portions (either shaped like an iso-sceles triangle) of the $SiO_2$ film. The magnetic film was formed in a magnetic field of 100 Oe by means of the RF magnetron sputtering apparatus. It exhibited a single-axis magnetic anisotropy and emanating an anisotropic magnetic field of 50 Oe. Next, the photoresist was dissolved with a solvent, and was remove from the $SiO_2$ film. As a result, that portion of the magnetic film which was formed on the photoresist was lifted off, and two other CoZrNb amorphous magnetic films, either shaped like an isosceles triangle, were formed on the $SiO_2$ film.

As a result, a square CoZrNb amorphous magnetic film was formed on the $SiO_2$ film, which consisted of the four triangular magnetic films and whose sides were 5 mm long each. Each of the four triangular magnetic film had an axis of easy magnetization which extended along its base.

Further, an $SiO_2$ film having a thickness of 1.5 λm was deposited on the magnetic film by plasma CVD or RF sputtering. An Al-0.5%Cu film having a thickness of 10 μm was formed on the uppermost $SiO_2$ film, by either a DC magnetron sputtering apparatus or a high-vacuum vapor-deposition apparatus. An $SiO_2$ film having a thickness of 1.5 μm was deposited on the Al-0.5%Cu film.

A positive-type photoresist was spin-coated on this $SiO_2$ film. The photolithography was conducted, patterning the photoresist into a square spiral form, the sides of which were aligned with those of the square CoZrNb amorphous magnetic film. Using the patterned photoresist as a mask, $CF_4$ gas was applied to the surface of the resultant structure, thus carrying out reactive ion etching on the uppermost $SiO_2$ film. Further, $Cl_2$ gas and $BCl_3$ gas were applied to the structure, conducting reactive ion etching on the Al-0.5%Cu film. The Al-0.5%Cu film was thereby etched, forming a spiral planar coil having 20 turns, a conductor width of 100 μm, and an inter-turn gap of 5 μm. A polyamic acid solution, which is a precursor of polyimide, was spin-coated on the surface of the resultant structure, forming a film having a thickness of 15 μm and filling the gaps among the turns of the coil. This film was cured at 350° C., and was made into a polyimide film. $CF_4$ gas and $O_2$ gas were applied to the structure, thus performing reactive ion etching on the polyimide film to the thickness of 1 μm measured from the top of the coil conductor.

Next, another CoZrNb amorphous magnetic film, identical to the first one, was formed on the polyimide film, in the same method as explained above. As a result, a planar inductor of the structure shown in FIG. 36 was manufactured. During the manufacture of the planar inductor, the lower magnetic film was heated and cooled, but it remained heat-resistant. Its magnetic property was virtually unchanged after the manufacture of the inductor. In other words, the heat applied while producing the inductor imposed but an extremely little influence on the magnetic properties of the lower magnetic film.

The electric characteristics of the planar inductor, thus made, were evaluated. The inductor had an inductance L of 2 μH and a quality coefficient Q of 15 (at 5 MHz). The inductor was tested for its superimposed DC current characteristic. Its inductance remained constant up until the superimposed DC current was increased to 80 mA, and started decreasing when the superimposed DC current was increased to 100 mA.

A planar inductor of the type shown in FIG. 36 was made which was identical to the one described above, except that the insulation layer filling the gaps among the coil turns was formed of $SiO_2$, not polyimide, by means of either CVD method or bias sputtering. This planar inductor exhibited electric characteristics similar to those of the planar inductor described above.

The planar-inductor was used as output choke coil in a step-down chopper DC-DC converter whose input and output voltages were 12 V and 5 V, respectively. The DC-DC converter could output a load current as much as 80 mA at the switching frequency of 4 MHz. Its maximum output power was 0.4 W, and its operating efficiency was 70%.

A comparative planar inductor was made in the same method as the inductor of Example 19, except that the CoZrNb amorphous magnetic films were formed in no magnetic field. Each of the magnetic films thus formed exhibited a permeability of 10000, and exhibited unequivocal magnetic anisotropy. The comparative inductor had an inductance about five times higher than that of the inductor of Example 15. Its inductance, however, remained constant until the DC current was increased to about 8 mA only; it started much increasing when a current of 10 mA or more was superimposed on the input DC current.

The comparative planar inductor was used as output choke coil in a DC-DC converter of the same type as the inductor of Example 19 was incorporated into. The DC-DC converter, including the comparative inductor, was tested. It had a maximum load current of about 8 mA, because of the poor superimposed DC current characteristic of the comparative inductor. Inevitably, its maximum output power was one tenth or less of the maximum output power of the DC-DC converter having the inductor of Example 19.

EXAMPLE 20

A planer transformer was made whose primary coil had 20 turns and was identical to the spiral planar coil of the inductor of Example 19, and whose secondary coil was identical thereto, except that it had ten turns and had been formed on a polyimide film having a thickness of 2 μm and covering the primary coil. The primary-coil inductance of this transformer exhibited superimposed DC current characteristic substantially the same as the planer inductor of Example 19.

The planar transformer was incorporated into a flyback DC-DC converter whose input and output voltages were 12 V and 5 V, respectively. Further, the planar inductor of Example 19 was used as output choke coil in the DC-DC converter. The forward DC-DC converter was tested for its characteristics. The transformer exhibited a rated output power which was comparable with that of the DC-DC converter having the transformer of Example 20 contributed to miniaturization of insulated DC-DC converters.

A comparative planar transformer was produced which was identical in structure to that of Example 20, except its magnetic films were of the type incorporated in the inductor made for comparison with Example 19. The primary-coil inductance of this comparative transformer was substantially the same as that of the planar inductor of Example 19. The comparative transformers was incorporated into the flyback DC-DC converters of the same type as that including the transformer of Example 20. When this flyback DC-DC converter was tested, an excessive peak current flowed through the switching power MOSFETs used in the converter because the comparative planar transformer was saturated magnetically. The peak current broke down the MOSFETS.

EXAMPLE 21

A planar inductor of the type shown in FIG. 38, according to the fourth aspect of the invention, was produced by the following method.

First, one major surface of a silicon substrate was thermally oxidized, thus forming an $SiO_2$ film having a thickness of 1 $\mu$m. Then, a positive-type photoresist was spin-coated on the $SiO_2$ film. The photoresist was patterned into a plurality of rectangular concentric grooves. Using the patterned photoresist as mask, reactive ion etching was performed on the $SiO_2$ by applying $CF_4$ gas thereto. As a result, the $SiO_2$ film came to have rectangular concentric grooves each having a width $\delta$ of 2 $\mu$m and a depth W of 0.5 $\mu$m. The gap L between any two adjacent concentric groove was 4 $\mu$m. Next, the photoresist was removed.

Next, a CoZrNb amorphous magnetic film having a thickness of 2 $\mu$m was formed on the grooved $SiO_2$ film by means of an RF magnetron sputtering apparatus, while rotating the silicon substrate. This magnetic film was formed in no magnetic fields, and no anisotropy other than shape anisotropy was imparted to the CoZrNb amorphous magnetic film. (Under the same sputtering conditions, a CoZrNb amorphous magnetic film was on a smooth $SiO_2$ film formed by thermal oxidation and having a smooth surface. virtually no magnetic anisotropy was detected at that portion of the magnetic film which is at the center of rotation.) Since the magnetic film was formed on the grooved $SiO_2$, it had a plurality of rectangular concentric projections on its lower surface. This magnetic film was used as lower magnetic layer.

Thereafter, an $SiO_2$ film having a thickness of 500 nm was deposited on the magnetic film by plasma CVD or RF sputtering. An Al-0.5%Cu film having a thickness of 10 $\mu$m was formed on the uppermost $SiO_2$ film, by either a DC magnetron sputtering apparatus or a high-vacuum vapor-deposition apparatus. An $SiO_2$ film having a thickness of 1.5 $\mu$m was formed on the Al-0.5%Cu film. A positive-type photoresist was spin-coated on this $SiO_2$ film, and was patterned in a spiral form by means of photolithography. Using the spiral photoresist as a mask, $CF_4$ gas was applied to the surface of the resultant structure, thus carrying out reactive ion etching on the uppermost $SiO_2$ film. Further, $Cl_2$ gas and $BCl_3$ gas were applied to the structure, conducting reactive ion etching on the Al-0.5%Cu film. The Al-0.5%Cu film was thereby etched, forming a spiral planar coil having 20 turns, a conductor width of 100 $\mu$m, and an interturn gap of 5 $\mu$m. A polyamic acid solution, which is a precursor of polyimide, was spin-coated on the surface of the resultant structure, forming a film having a thickness of 15 $\mu$m and filling the gaps among the turns of the coil. This film was cured at 350° C., and was made into a polyimide film. $CF_4$ gas and $O_2$ gas were applied to the structure, thus performing reactive ion etching on the polyimide film to the thickness of 1 $\mu$m measured from the top of the coil conductor.

A CoZrNb amorphous magnetic film having a thickness of 2.5 $\mu$m was formed on the polyimide film by means of an RF magnetron sputtering apparatus. Then, a positive-type photoresist was spin-coated on the CoZrNb amorphous magnetic film. The photoresist was patterned into a plurality of rectangular concentric grooves. Using the patterned photoresist as mask, reactive ion etching was performed on the CoZrNb magnetic film by applying $Cl_2$ gas and $BCl_3$ gas thereto. As a result, the magnetic film came to have rectangular concentric grooves each having a width $\delta$ of 2 $\mu$m and a depth W of 0.5 $\mu$m. The gap L between any two adjacent concentric groove was 4 $\mu$m. This magnetic film was used as upper magnetic layer.

During the manufacture of the planar inductor, the lower magnetic layer was repeatedly heated and cooled, but it remained heat-resistant. Its magnetic property was virtually unchanged after the manufacture of the inductor. In other words, the heat applied while producing the inductor imposed but an extremely little influence on the magnetic properties of the lower magnetic layer.

The electric characteristics of the planar inductor, thus made, were evaluated. The inductor had an inductance L of 0.8 $\mu$H and a quality coefficient Q of 7 (at 5 MHz). The inductor was tested for its DC-superimposing characteristic, and its inductance remained constant up until the superimposed DC current was increased to 300 mA, and started decreasing when the superimposed DC current was increased to 350 mA.

Concentric grooves can be made in the $SiO_2$ film on which the lower magnetic layer was formed, and in the upper magnetic layer, by other method than photolithography. Micro-machining can be applied to cut grooves in the $SiO_2$ film and the upper magnetic layer. In Example 21, concentric grooves are formed in only one surface of the $SiO_2$ film and in only one surface of the upper magnetic layer. Instead, they can be formed in both surfaces thereof.

The magnetic layers, both the upper and the lower, can be made of insulative magnetic material such as soft ferrite. If this is the case, either magnetic layer can be laid directly on the planar coil, and the coil can be used as mold for forming a spiral groove in either magnetic layer.

Another planar inductor was produced which was identical to the one described above, except that the insulation layer filling the gaps among the coil turns was formed of $SiO_2$, not polyimide, by means of either CVD method or bias sputtering. This planar inductor exhibited electric characteristics similar to those of the planar inductor described above.

A comparative planar inductor 21*a* was made by the same method as the inductor of Example 21, except that neither the lower $SiO_2$ film nor the upper CoZrNb film was patterned to have grooves.

Also, a comparative planar inductor 21*b* was made by the same method as the inductor of Example 21, except that the lower $SiO_2$ film and the upper CoZrNb film was patterned, thus forming rectangular concentric grooves each having a width $\delta$ of 2 $\mu$m and a depth W of 1 $\mu$m, with gap L of 20 $\mu$m between any two adjacent concentric groove. The dimensional features of the grooves formed in the upper magnetic film do not satisfy inequality (5).

Although both comparative inductors 21*a* and 21*b* had an inductance about eight times greater than that of the inductor of Example 21, their inductance decreased very much when a DC current of 10 mA or more was superimposed.

EXAMPLE 22

A planar magnetic element according to the fourth aspect of the invention, which is of the type shown in FIG. 43, was produced by the following method.

First, a copper foil having a thickness of 100 $\mu$m was adhered to a first polyimide film having a thickness of 40 $\mu$m. The copper foil was patterned into a spiral planer coil, by means of wet chemical etching. This coil was rectangular, having 20 turns, a conductor width of 100 $\mu$m, and an inter-turn gap of 100 $\mu$m. Then, a second polyimide film having a thickness of 30 $\mu$m was formed on the spiral planar coil. Two Co-based amorphous alloy foils having a thickness of 15 $\mu$m were formed on the first and second polyimide films, respectively. As a result, the first and second polyimide films sandwiched the coil, and the Co-based amorphous alloy foils sandwiched the coil and the polyimide films together. Both Co-based amorphous alloy foils had a permeability of 5000 along their axes of magnetization and a saturation flux density of 10 KG. They had been prepared by rapidly quenching method using single roller, and by annealing these films in a magnetic field. Either Co-based amorphous alloy foil had a uniaxial magnetic anisotropy due to the annealing, and emanated an anisotropic magnetic field of 20 Oe.

Then, the structure consisting of the coil, two polyimide films, and two Co-based amorphous alloy foils was sandwiched between two other polyimide films, each having a thickness of 5 $\mu$m. As a result of this, a planar inductor was made, which had a size of 5 mm×10 mm. Its inductance as 12.5 $\mu$H. The inductance remained constant until the DC current was increased to 400 mA, and started decreasing when the DC current was increased to 500 mA.

EXAMPLE 23

A planar transformer was produced whose primary coil was identical to the coil incorporated in the inductor of Example 22, and whose secondary coil was identical thereto, except that it had ten turns, not 20 turns. The transformer is identical in structure to the inductor of Example 22, except that it had the secondary coil. The transformer was tested, and it exhibited superimposed DC current characteristic similar to that of the planar inductor of Example 22.

EXAMPLE 24

A planar inductor of the type shown in FIG. 35, according to the fourth aspect of the invention, was produced by the following method.

First, one major surface of a silicon substrate was thermally oxidized, thus forming an $SiO_2$ film having a thickness of 1 $\mu$m. Then, a CoZrNb amorphous magnetic film having a thickness of 1 $\mu$m was formed on the $SiO_2$ film in a magnetic field of 100 Oe by means of an RF magnetron sputtering apparatus. This CoZrNb magnetic film exhibited a uniaxial magnetic anisotropy and emanating an anisotropic magnetic field of 50 Oe. Next, an $SiO_2$ film having a thickness of 500 Å was deposited on the magnetic film by plasma CVD or RF sputtering. Three other CoZrNb films and three other $SiO_2$ films were formed in the same method, thereby providing multi-layer structure consisting of four magnetic films and four insulation films, alternately formed one upon another. The four magnetic films were so formed that their axes of easy magnetization were aligned with one another.

Then, an Al%-0.5%Cu film having a thickness of 10 $\mu$m was formed on the uppermost $SiO_2$ film, by either a DC magnetron sputtering apparatus or a high-vacuum vapor deposition apparatus. An $SiO_2$ film having a thickness of 1.5 $\mu$m was deposited on the Al-0.5%Cu film. A positive-type photoresist was spin-coated on this $SiO_2$ film, and was patterned in a spiral form by means of photolithography. Using the spiral photoresist as a mask, $CF_4$ gas was applied to the surface of the resultant structure, thus carrying out reactive ion etching on the uppermost $SiO_2$ film. Further, $Cl_2$ gas and $BCl_3$ gas were applied to the structure, conducting reactive ion etching on the Al-0.5%Cu film. The Al-0.5%Cu film was thereby etched, forming two spiral planar coils, arranged with their minor axes aligned and each having a 20 turns, a conductor width of 100 $\mu$m, and an inter-turn gap of 5 $\mu$m.

A polyamic acid solution, which is a precursor of polyimide, was spin-coated on the surface of the resultant structure, forming a film having a thickness of 15 $\mu$m and filling the gaps among the turns of the coil. This film was cured at 350° C., and was made into a poly imide film. $CF_4$ gas and $O_2$ gas were applied to the structure, thus performing reactive ion etching on the polyimide film to the thickness of 1 $\mu$m measured from the top of the coil conductor.

Thereafter, four insulation layers and four magnetic layers were alternately formed, one upon another, in the same method as described above.

During the manufacture of the planar inductor, the four magnetic films located below the coils were repeatedly heated and cooled, but they remained heat-resistant. Their magnetic property was virtually unchanged after the manufacture of the inductor. In other words, the heat applied while producing the inductor imposed but an extremely little influence on the magnetic properties of the magnetic films located below the coils.

The electric characteristics of the planar inductor, thus made, were evaluated. The inductor had an inductance L of 2 $\mu$H and a quality coefficient Q of 15 (at 5 MHz). The inductor was tested for its superimposed DC current characteristic, and its inductance remained constant until the superimposed DC current was increased to 150 mA, and started decreasing when the superimposed DC current was increased to 200 mA.

Another planar inductor was produced which was identical to the one described above, except that the insulation layer filling the gaps among the coil turns was formed of $SiO_2$ (made from organic silane), not polyimide, by means of either CVD method or bias sputtering. This planar inductor exhibited electric characteristics similar to those of the planar inductor described above.

EXAMPLE 25

A planar transformer was produced whose primary coil was identical to the coil incorporated in the inductor of Example 24, and whose secondary coil was identical thereto, except that it had ten turns, not 20 turns. The transformer is identical in structure to the inductor of Example 22, except that it had the secondary coil, and either coil was sandwiched between two polyimide layers having a thickness of 2 $\mu$m. The transformer was tested, and it exhibited superimposed DC current characteristic similar to that of the planar inductor of Example 22.

EXAMPLE 26

The inductor of Example 22 was incorporated into a step-down chopper DC-DC converter and used as output choke coil. The DC-DC converter had an input voltage of 10 V, an output voltage of 5 V, and an output power of 500 mW. The DC-DC converter was tested to see how the planer inductor workee. It could output a load current up to 400 mA at a switching frequency of 500 KHz. Its maximum output current was 2 W, and its operating efficiency was 80%.

EXAMPLE 27

The planar transformer of Example 23 was incorporated into a forward DC-DC converter whose input and output voltages were 12 V and 5 V, respectively. Further, the planar inductor of Example 22 was used as output choke coil in the forward DC-DC converter. The DC-DC converter was tested for its characteristics. It had a switching frequency of 500 KHz, and obtained a rated output similar to that of the DC-DC converter of Example 26. As a result, the transformer helped to miniaturize insulated DC-DC converters.

EXAMPLE 28

The inductor of Example 24 was incorporated into a step-down chopper DC-DC converter and used as output choke coil. The DC-DC converter had an input voltage of 10 V, an output voltage of 5 V, and an output power of 500 mW. The DC-DC converter was tested to see how the planer inductor works. It could output a load current up to 150 mA at a switching frequency of 500 KHz. Its maximum output current was 0.75 W, and its operating efficiency was 70%.

EXAMPLE 29

The planar transformer of Example 25 was incorporated into a flyback DC-DC converter whose input and output voltages were 12 V and 5 V, respectively. Further, the planar inductor of Example 24 was used as output choke coil in the forward DC-DC converter. The flyback DC-DC converter was tested for its characteristics. Its rated output was similar to that of the step-down chopper DC-DC converter of Example 28. Since all its magnetic elements were planar, the flyback DC-DC converter was sufficiently small and light.

EXAMPLE 30

A planer magnetic element according to the fifth aspect of the invention was produced which was of the type illustrated in FIG. 49, by the following method.

First, a copper foil having a thickness of 100 $\mu$m was adhered to a first polyimide film having a thickness to 30 $\mu$m. The copper foil was patterned by wet etching using ferric chloride as etchant, into a rectangular spiral planer coil having 20 concentric square turns, a conductor width of 100 $\mu$m, and an inter-turn gap of 100 $\mu$m. A second polyimide film having a thickness of 10 $\mu$m was formed on the planar coil. Hence, the coil was sandwiched between the first and second polyimide films. Then, the resultant structure was sandwiched between two square Co-based amorphous magnetic films, each having a size of 10×10 mm and having no magnetic strain, thus forming a planar magnetic element.

(a) The ends of the concentric turns of the planar magnetic element were connected in the specific fashion illustrated in FIG. 52, thereby producing a planar inductor similar to one having a spiral coil. This planar inductor was tested with an LCR meter. It had an inductance of about 20 $\mu$H at a frequency of 500 KHz, and had a quality coefficient Q of 10.

This planar inductor was incorporated into a hybrid IC DC-DC converter having a switching frequency of 500 KHz, and was used as output choke coil. The hybrid IC DC-DC converter operated well. Hence, the planar inductor helped to miniaturize DC power supplies.

Also, the planar inductor was incorporated into a filter for removing high-frequency components from the DC-bias supply lines connected to the power MOSFETs used in a 10 MHz non-linear power amplifier. Thanks to the use of the planar inductor, the filter was sufficiently small.

(b) The ends of the concentric turns of the planar magnetic element were connected in the specific fashion shown in FIG. 51, thereby producing a planar inductor similar to one having a meandering coil. The planar inductor, thus made, was tested with the LCR meter. It had an inductance of about 300 H. It exhibited good frequency characteristic, even at several tens of megahertz.

The planar inductor was used in a low-pass filter connected to the output of a 20 MHz non-linear power amplifier. Due to the use of the planar inductor, the low-pass filter was far smaller than those which had a conventional hollow coil.

(c) The ends of the concentric turns of the planar magnetic element were connected in the specific manner illustrated in FIG. 55, thereby producing a planar transformer comprising a primary coil and a secondary coil. The primary coil had 7 turns, whereas the secondary coil had 2 turns. The voltage ratio of the transformer was about 0.25.

(d) The planer transformer, thus fabricated, was used to adjust the output impedance of a 1 MHz power amplifier to the resistance of the load connected to the amplifier. The output impedance of the power amplifier was 200Ω, and the resistance of the load was 50Ω. The ends of the concentric turns of either coil were connected in various ways, until the output impedance was best adjusted to the load resistance. The output impedance of a power amplifier cannot be so well adjusted to the load resistance, with the conventional planar transformers.

EXAMPLE 31

Planar magnetic elements of the type shown in FIG. 49 and planar magnetic elements of the type shown in FIG. 50 were produced, either type by the following method.

First, an $Fe_{40}Co_{60}$ alloy film having a thickness of 3 $\mu$m was formed on a silicon substrate by means of RF sputtering. A $SiO_2$ film having a thickness of 1 m was formed on the alloy film by RF sputtering. Then, an Al—Cu alloy film having a thickness of 10 $\mu$m was formed on the $SiO_2$ film. A $SiO_2$ film was formed on the Al—Cu alloy film and patterned by the known method. Using the patterned $SiO_2$ film as mask, magnetron reactive ion etching was performed on the Al—Cu alloy film, whereby the Al—Cu alloy film was etched, forming ten coil turns. Each turn had the same conductor with of 200 82 m. The gap among the turns was 5 $\mu$m. The sides of the innermost turn were 0.81 mm long, whereas those of the outermost turn were 4.5 mm long. A $SiO_2$ film was formed on the resultant structure by plasma CVD, thereby filling the gaps among the turns and covering the planar coil consisting the ten turns. This $SiO_2$ was subjected to resist etch-back method, whereby its upper surface as made smooth and flat. Then, an $Fe_{40}Co_{60}$ alloy film having a thickness of 3 $\mu$m was formed on the $SiO_2$ film.

Figure 67:
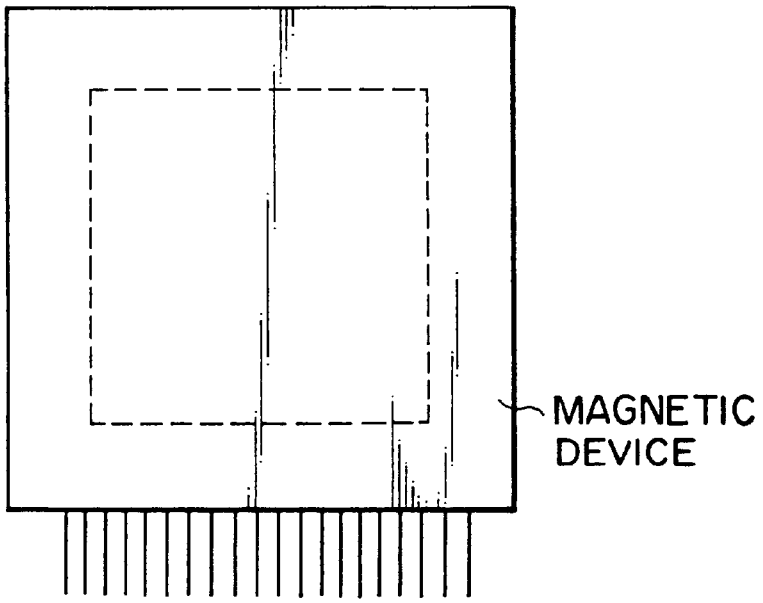

(a) The terminals of the planar magnetic element of the type shown in FIG. 49 were connected to a lead frame by bonding wires, and then encapsulated within a resin casing, thereby producing a single in-line packaged (SIP) device which had 20 pins as is shown in FIG. 67. This device was combined with a semiconductor relay, so that its inductance could be changed stepwise by operating an external electronic device. Hence, this magnetic planar element could better serve as an adjusting element.

Figure 68:
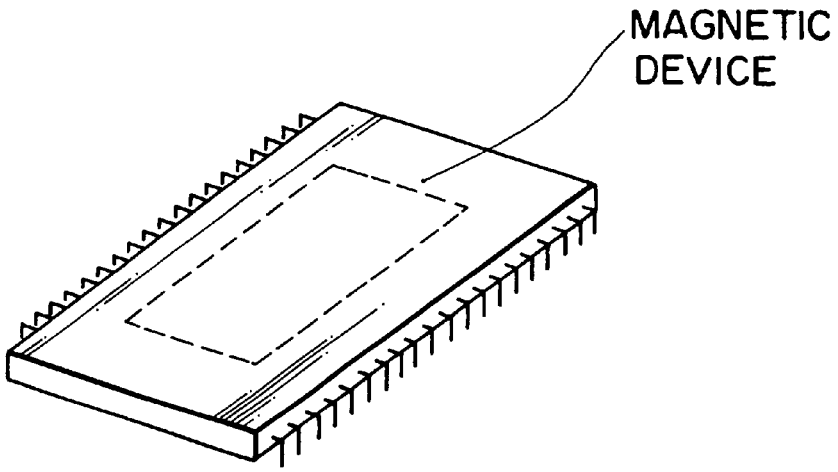

(b) The terminals of the planar magnetic element of the type shown in FIG. 50 were connected to a lead frame by bonding wires, and then encapsulated within a resin casing, thereby producing a dual in-line packaged (DIP) device which had 40 pins as is shown in FIG. 68. The device was combined with a semiconductor relay, so that its inductance could be changed stepwise by operating an external electronic device. Hence, this magnetic planar element could better serve as an adjusting element.

Figure 69:
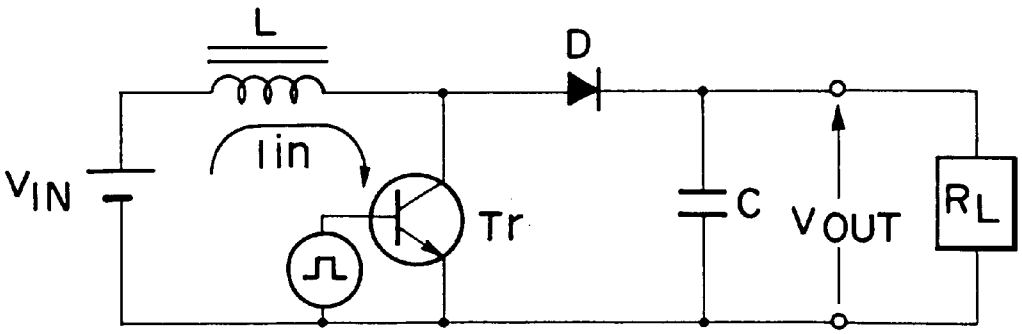
Figure 70:
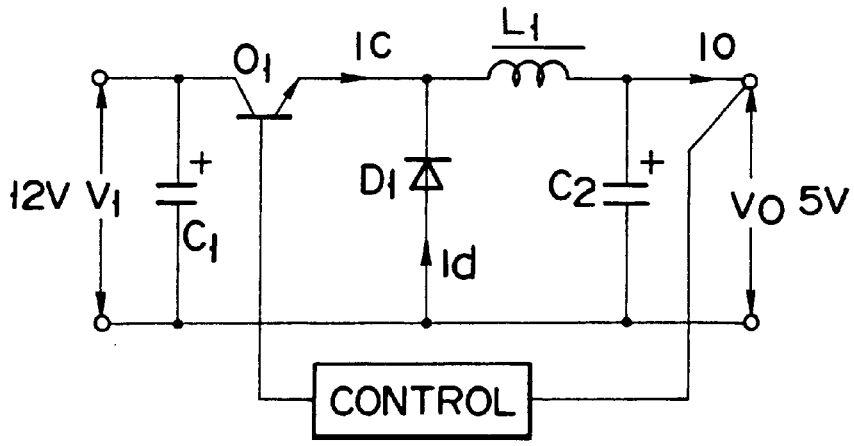
Figure 71:
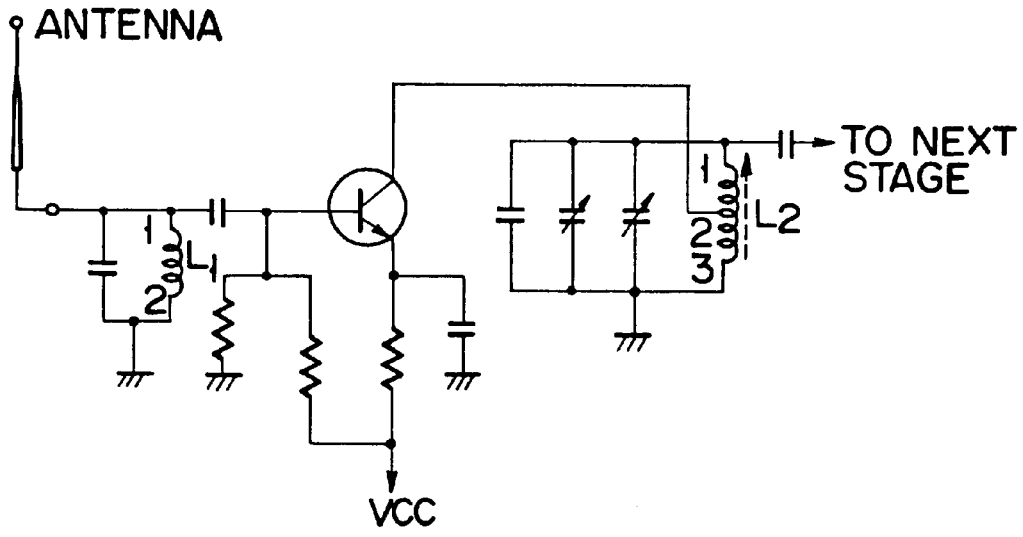
Figure 72:
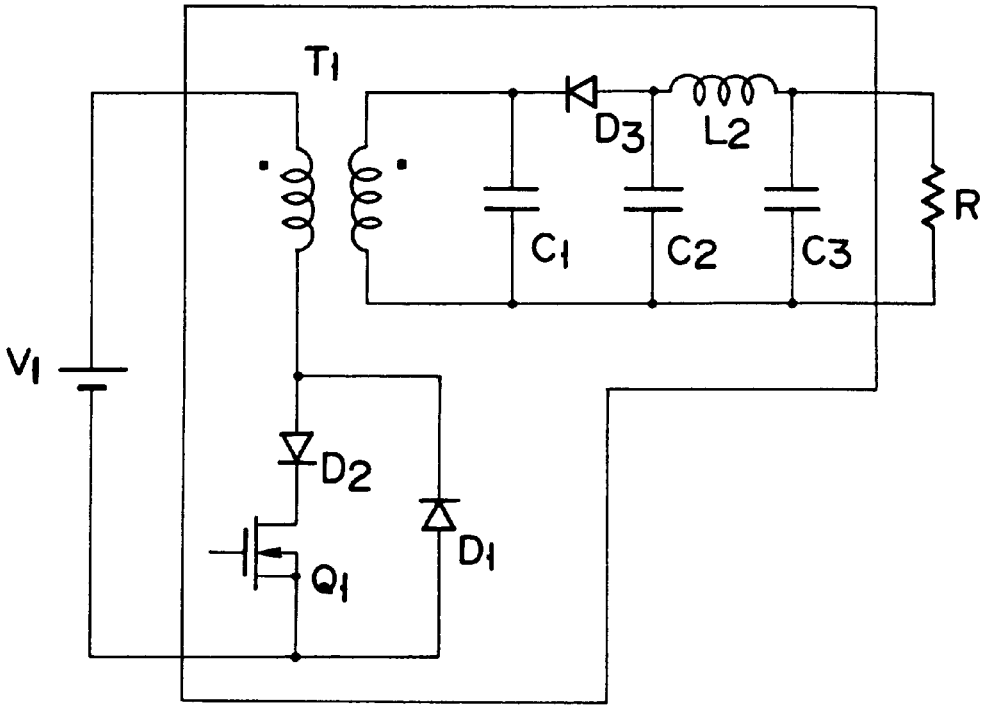

(c) A SIP device of the type shown in FIG. 67 was manufactured by the same method as the SIP device (a), except that the planar element and the lead frame were encapsulated in an Mn—Zn ferrite casing. This SIP device can be used in various apparatuses, such as a step-up chopper DC-DC converter, a step-down chopper DC-DC converter, an RF circuit for use in flat pagers, and a resonant DC-DC converter. FIG. 69 shows an example of a step-up chopper DC-DC converter. FIG. 70 illustrates an example of a step-down chopper DC-DC converter. FIG. 71 shows an example of an RF circuit. FIG. 72 illustrates an example of a resonant DC-DC converter.

EXAMPLE 32

A one-turn planer inductor of the type shown in FIG. 62A was made which comprised a silicon substrate, an aluminum conductor, and insulation layers made of silicon oxide. The structural parameters of the one-turn planar inductor, as defined in FIG. 62B, were as follows:

$d_1=1\times10^{-3}$ (m)

$d_2=5\times10^{-3}$ (m)

$\delta_1=1\times10^{-6}$ (m)

$\delta_2=1\times10^{-6}$ (m)

$\mu_s=10^4$ $\rho=2.65\times10^{-8}$ ($\Omega$m)

$d_3=14\times10^{-6}$ (m)

The planar inductor exhibited the following electric characteristics:

$L$=32 (nH)

$R_{DC}$=14 (m$\Omega$)

$I$max=630 (mA)

$Q_{1\ HHZ}$=15

$Q_{10\ MHz}$=150

Q is the quality coefficient, which is the ratio of inductance L effective to DC resistance. The greater the value Q, the better.

The one-turn planar inductor was tested, and there was detected virtually no magnetic fluxes leaking from the inductor.

Figure 73:
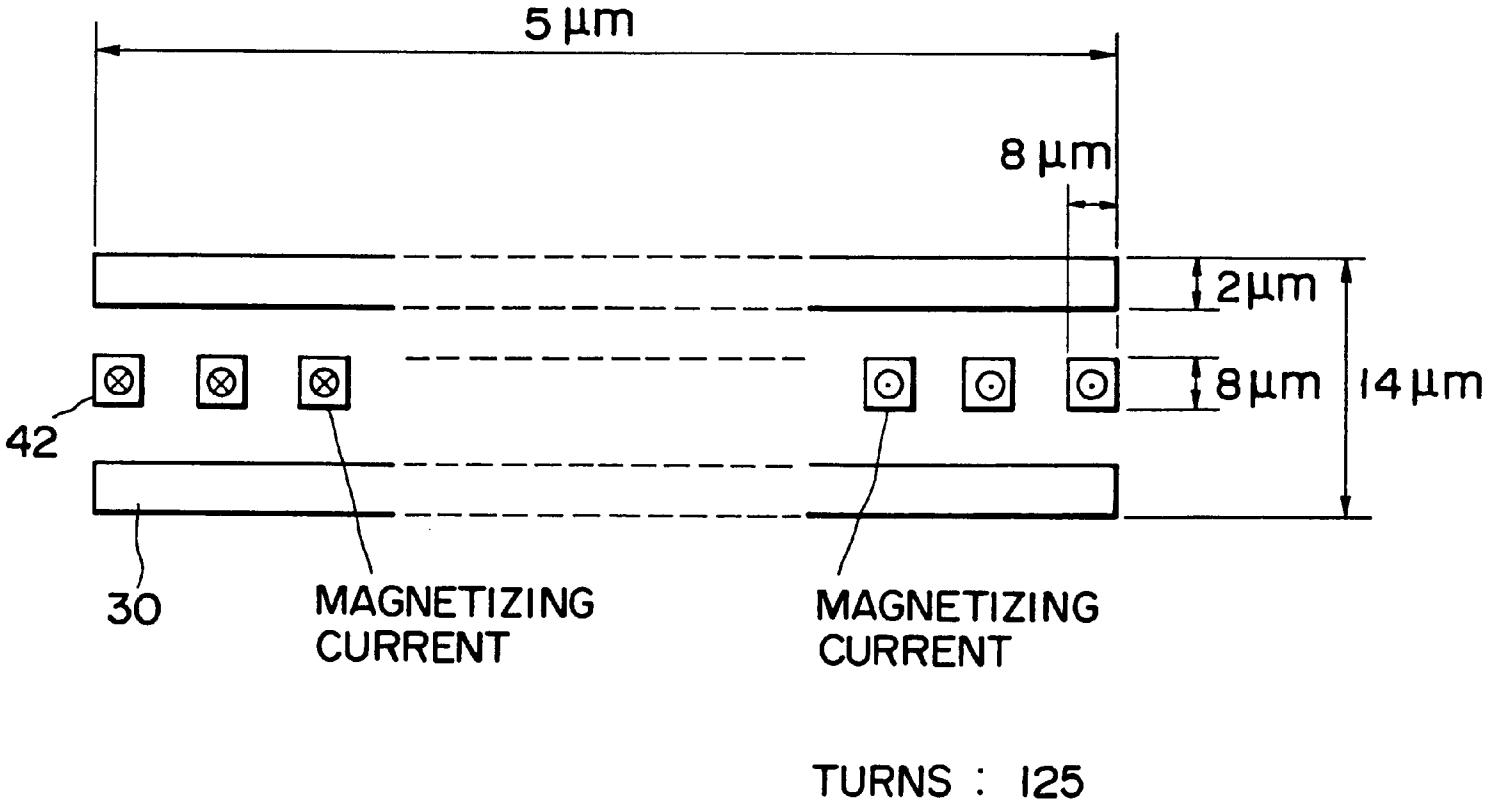
FIG. 73 is a section of a planar coil for one embodiment.

A comparative inductor was produced which had the structure illustrated in FIG. 73. As is shown in FIG. 73, the comparative inductor had the same size as Example 32, that is, $d_2=5\times10^{-3}$ (m), $d_3=14\times10^{-6}$ (m), but comprised a 124-turn spiral planar coil, not a one-turn coil. Two magnetic layers 30 are located below and above the coil conductor 42, respectively.

The comparative inductor exhibited the following electric characteristics:

$L$=900 ($\mu$H)

$RDC$=600 ($\Omega$)

$I$max=6.4 (mA)

$Q_{1\ MHZ}$=9

$Q_{10\ MHZ}$=90

Obviously, the one-turn planar inductor of Example 32 has a great current capacity, and is suitable for use in a large power supply. Although its inductance is rather low, its impedance is sufficiently high at high operating frequencies.

What is claimed is:

1. A planar magnetic element, comprising:

a semiconductor substrate;

at least one patterned conductive layer formed on said semiconductor substrate; and a insulation layer formed on said at least one patterned conductive layer, wherein said at least one patterned layer is patterned in the shape of a planar coil having a plurality of turns and having a gap aspect ratio greater than one, said gap aspect ratio being the ratio of the thickness of said at least one patterned conductive layer to a width of a gap between any adjacent two of said plurality of turns.

2. The planar magnetic element according to claim 1 wherein said gap has a first part filled with an insulating material and wherein a remaining part of said gap is a cavity which extends between turns of adjacent coils which form said gap.

3. The planar magnetic element according to claim 1, wherein said gap has a void.

4. The planar magnetic element according to claim 1, wherein said element is formed by at least one of a PVD (Physical Vapor Deposition) process, a CVD (Chemical Vapor Deposition) process, an epitaxial growth process and an electro-plating process.

5. A DC/DC converter, comprising:

a switching element; and a planar magnetic element, wherein said planar magnetic element includes a semiconductor substrate, at least one patterned conductive layer formed on said semiconductor substrate; and a insulation layer formed on said at least one patterned conductive layer, wherein said at least one patterned layer is patterned in the shape of a planar coil having a plurality of turns and having a gap aspect ratio greater than one, said gap aspect ratio being the ratio of the thickness of said at least one patterned conductive layer to a width of a gap between any adjacent two of said plurality of turns.

6. The DC/DC converter according to claim 5 wherein said gap has a first part filled with an insulation material and wherein a remaining part of said gap is a cavity which extends between turns of adjacent coils which form said gap.

7. The DC-DC converter according to claim 5, wherein said gap has a void.

8. The DC-DC converter according to claim 5, wherein said converter is formed by at least one of a PVD (Physical Vapor Deposition) process, a CVD (Chemical Vapor Deposition) process, an epitaxial growth process and an electro-plating process.

9. A planar magnetic element comprising:

a semiconductor substrate;

at least one patterned conductive layer formed on said semiconductor substrate; and a insulation layer formed on said at least one patterned conductive layer, wherein said at least one patterned layer is patterned in the shape of a planar coil having a plurality of turns and having a gap aspect ratio of from one to five, said gap aspect ratio being the ratio of the thickness of said at least one patterned conductive layer to a width of a gap between any adjacent two of said plurality of turns.

10. The planar magnetic element according to claim 9, wherein said gap has a void.

11. A DC-DC converter, comprising:

a switching element; and a planar magnetic element, wherein said planar magnetic element includes a semiconductor substrate, at least one patterned conductive layer formed on said semiconductor substrate; and a insulation layer formed on said at least one patterned conductive layer, wherein said at least one patterned layer is patterned in the shape of a planar coil having a plurality of turns and having a gap aspect ratio of from one to five, said gap aspect ratio being the ratio of the thickness of said at least one patterned conducive layer to a width of a gap between any adjacent two of said plurality of turns.

12. The DC-DC converter according to claim 11, wherein said gap has a void.

* * * * *